US007549266B2

(12) United States Patent
Yuyama et al.

(10) Patent No.: US 7,549,266 B2
(45) Date of Patent: Jun. 23, 2009

(54) DEVICE FOR CONTAINING AND DISPENSING TABLETS

(75) Inventors: Shoji Yuyama, Osaka (JP); Katsunori Yoshina, Osaka (JP); Takafumi Imai, Osaka (JP); Yoshinori Kumano, Osaka (JP); Masahito Miyashita, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 328 days.

(21) Appl. No.: 10/586,945

(22) PCT Filed: Jan. 17, 2005

(86) PCT No.: PCT/JP2005/000470

§ 371 (c)(1),
(2), (4) Date: Jul. 25, 2006

(87) PCT Pub. No.: WO2005/073086

PCT Pub. Date: Aug. 11, 2005

(65) Prior Publication Data

US 2007/0157551 A1 Jul. 12, 2007

(30) Foreign Application Priority Data

Jan. 30, 2004 (JP) ..... 2004-024896

(51) Int. Cl.
*B65B 5/08* (2006.01)

(52) U.S. Cl. ..... 53/281; 53/168; 53/237; 53/55

(58) Field of Classification Search ..... 53/131.5, 53/55, 154, 168, 171, 238, 281, 237, 53, 53/54, 505, 506, 319
See application file for complete search history.

(56) References Cited

U.S. PATENT DOCUMENTS

| | | | | |
|---|---|---|---|---|
| 5,891,371 | A * | 4/1999 | Lepper et al. | 264/2.1 |
| 5,946,883 | A | 9/1999 | Yuyama et al. | |
| 6,115,996 | A | 9/2000 | Yuyama et al. | |
| 6,308,494 | B1 | 10/2001 | Yuyama et al. | |
| 6,449,927 | B2 * | 9/2002 | Hebron et al. | 53/501 |

(Continued)

FOREIGN PATENT DOCUMENTS

| | | |
|---|---|---|
| JP | 10-033636 | 2/1998 |

(Continued)

*Primary Examiner*—Louis K Huynh
(74) *Attorney, Agent, or Firm*—Wenderoth, Lind & Ponack, L.L.P.

(57) ABSTRACT

A compact tablet storage and take-out apparatus capable of quickly discharging and filing tablets. The tablet storage and take-out apparatus includes: a cylindrical drum; a drum driving device; a plurality of tablet cassette mounting bases fitted to an outer surface of the drum; tablet cassettes which are detachably mounted on the tablet cassette mounting bases; and a guide passage for guiding discharged tablets inside the drum. Moreover, the apparatus includes a transfer robot provided inside the drum so as to be liftable and also rotatable. The transfer robot is operable to transfers a vial between a delivery position located outside an opening formed in an upper end or a lower end of the drum and a tablet filling position. The position of at least one of the drum and the transfer robot is controlled so that an opening of the vial held by the transfer robot agrees with an outlet of the guide passage.

26 Claims, 52 Drawing Sheets

U.S. PATENT DOCUMENTS

| | | | | |
|---|---|---|---|---|
| 2001/0001358 | A1 | 5/2001 | Yuyama et al. | |
| 2004/0026442 | A1 * | 2/2004 | Hutchinson | 221/123 |
| 2006/0006190 | A1 * | 1/2006 | Janet et al. | 221/211 |
| 2006/0259195 | A1 * | 11/2006 | Eliuk et al. | 700/245 |

FOREIGN PATENT DOCUMENTS

| | | |
|---|---|---|
| JP | 2001-294305 | 10/2001 |

* cited by examiner

[FIG.1]
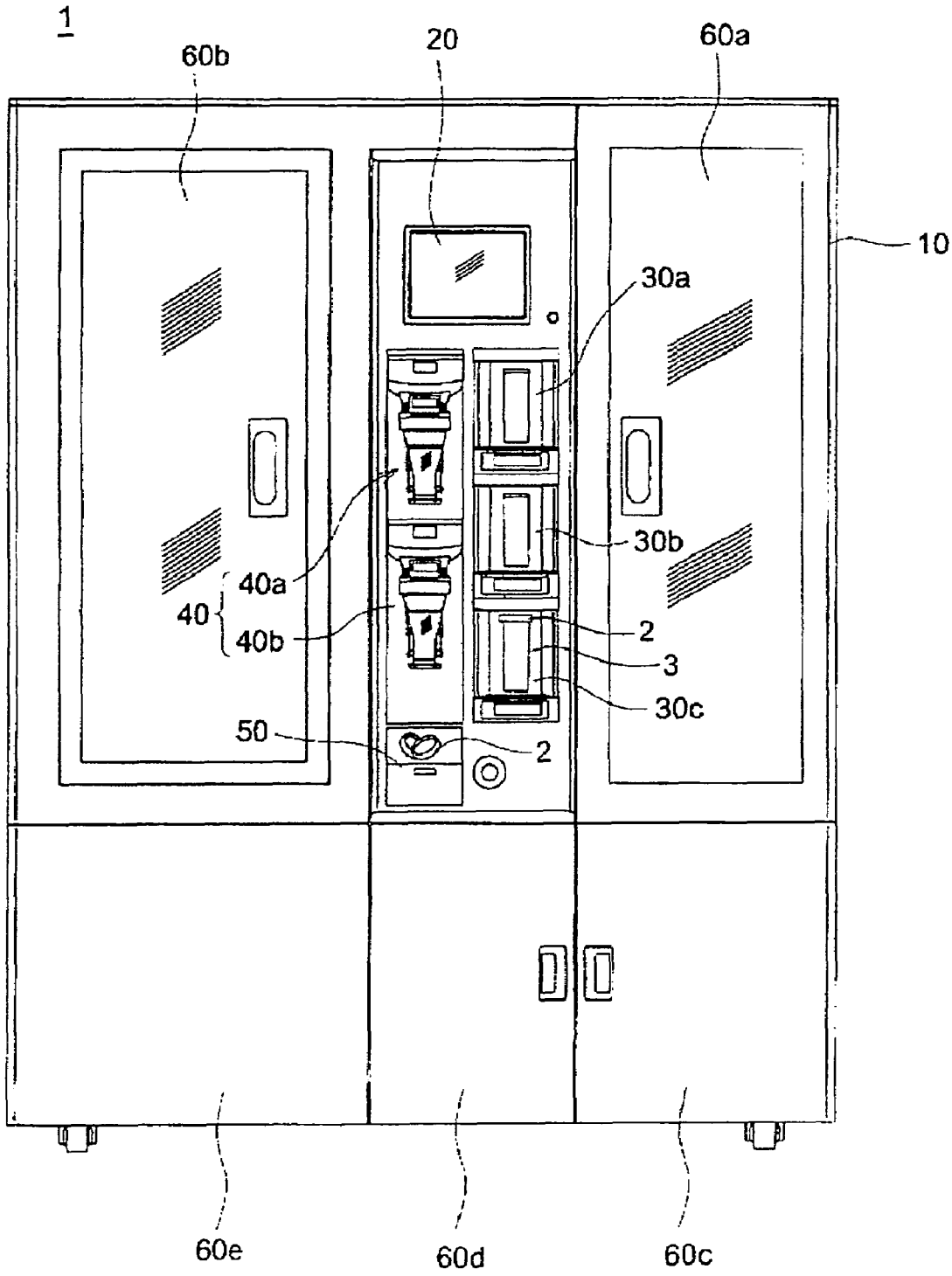

[FIG.2]
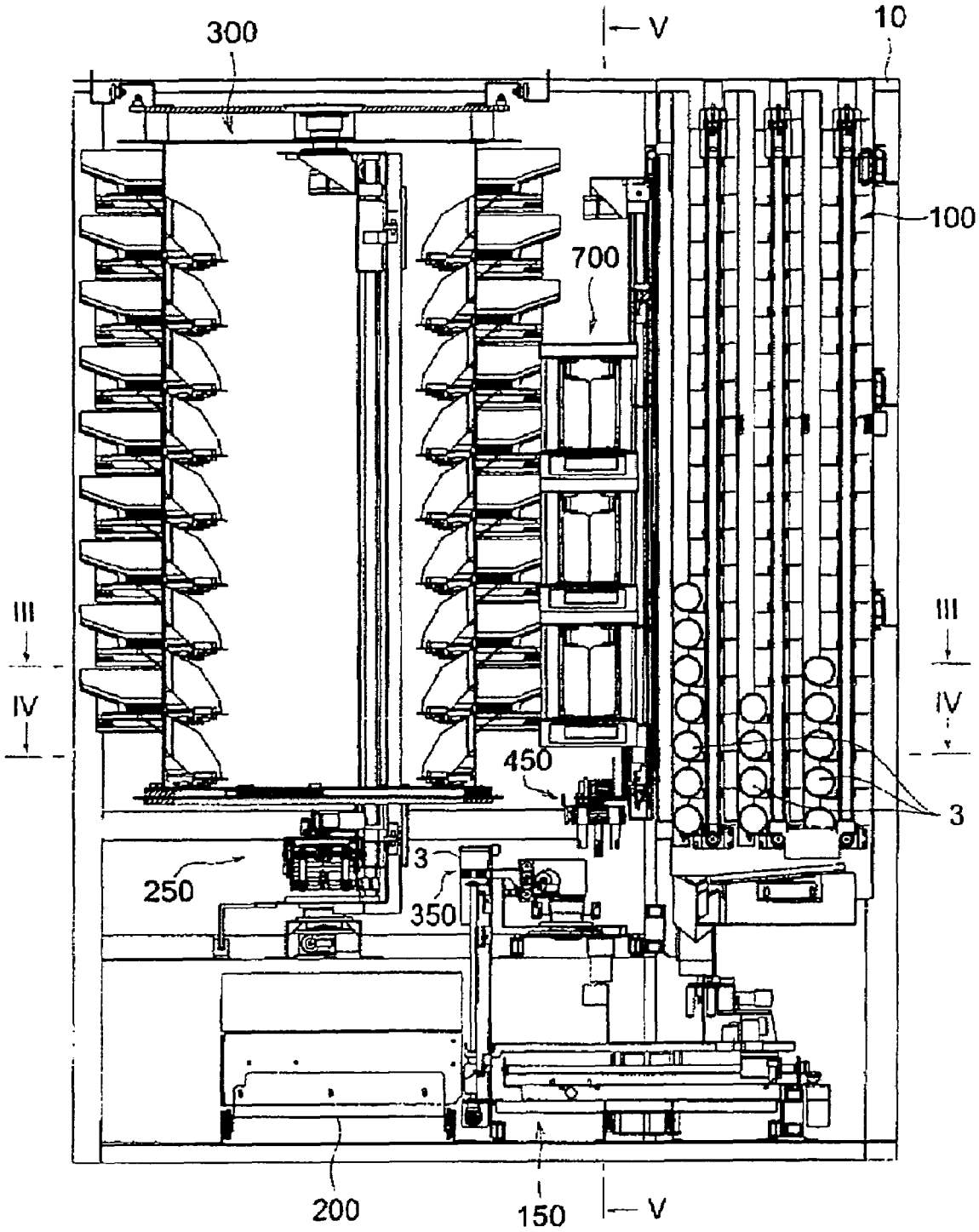

[FIG.3]
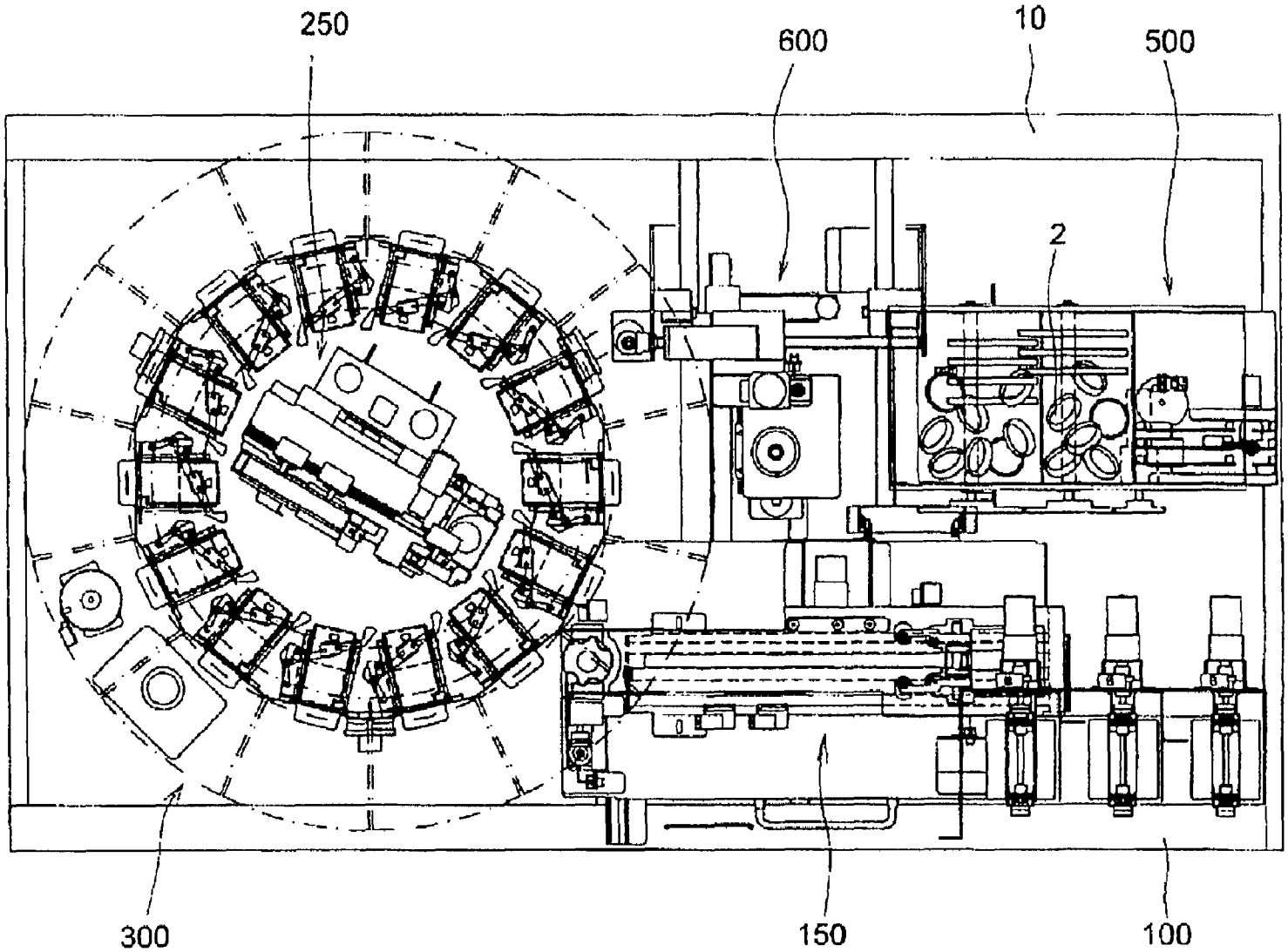

[FIG.4]
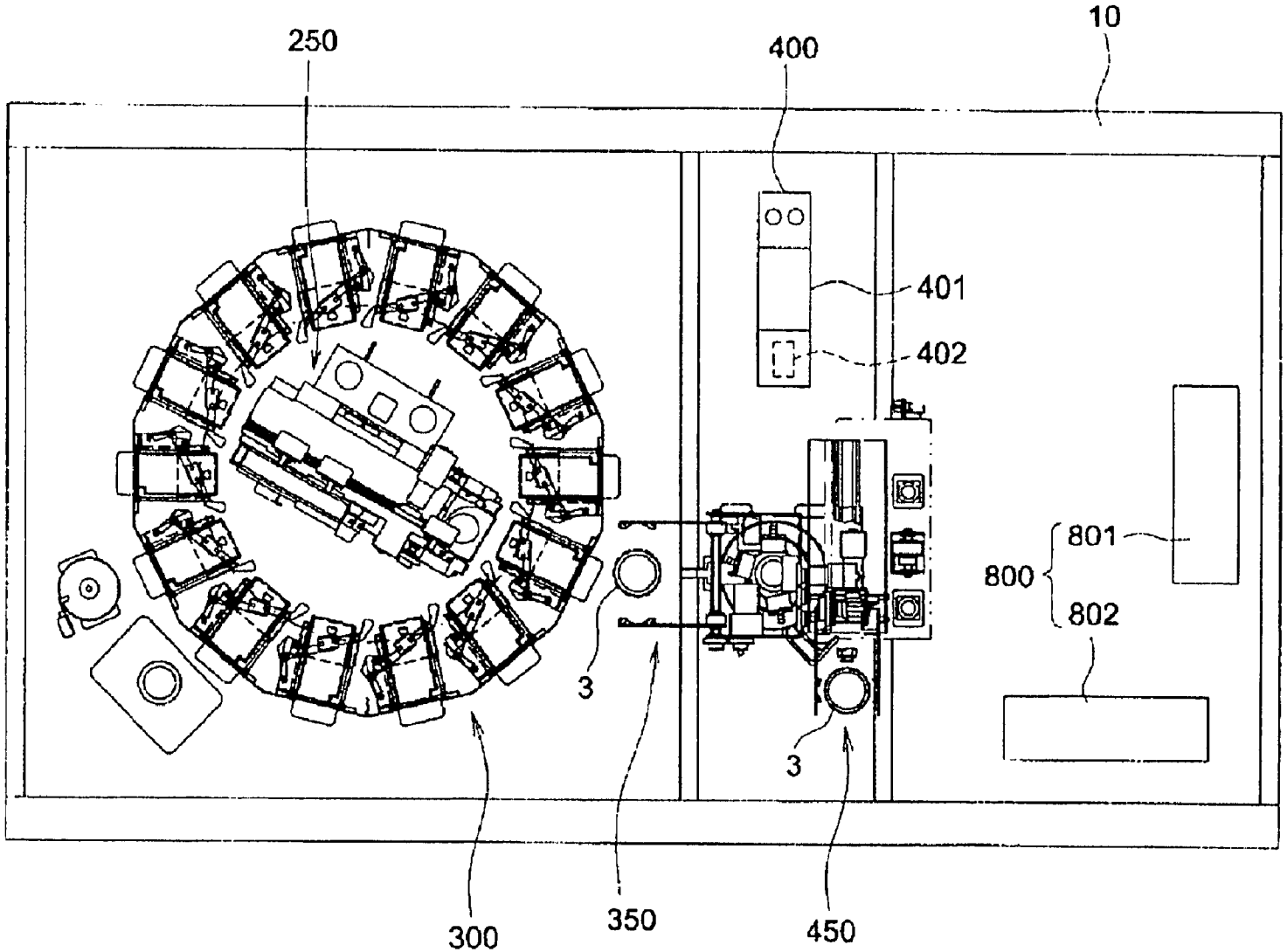

[FIG.5]
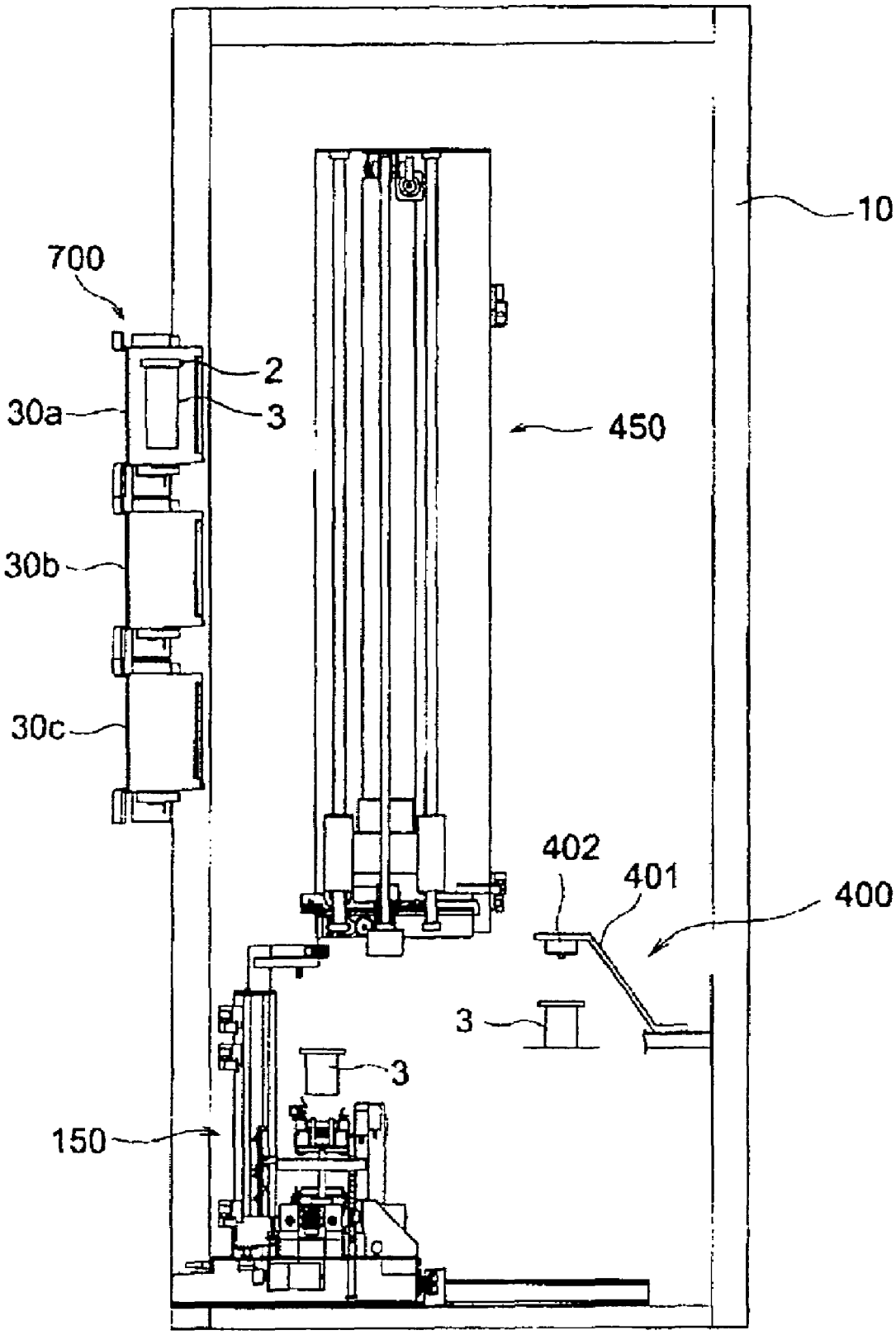

[FIG. 6]
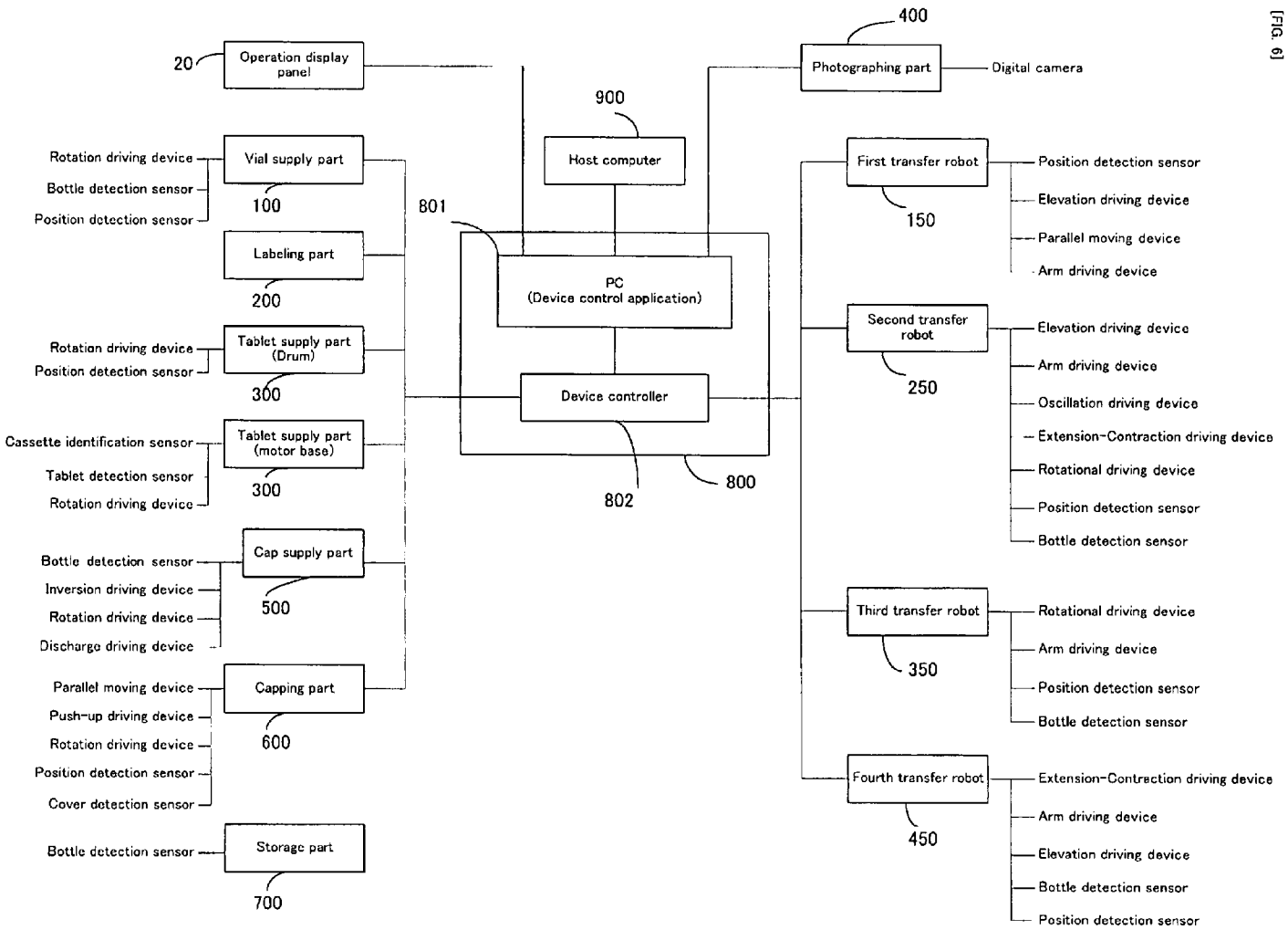

[FIG.7]
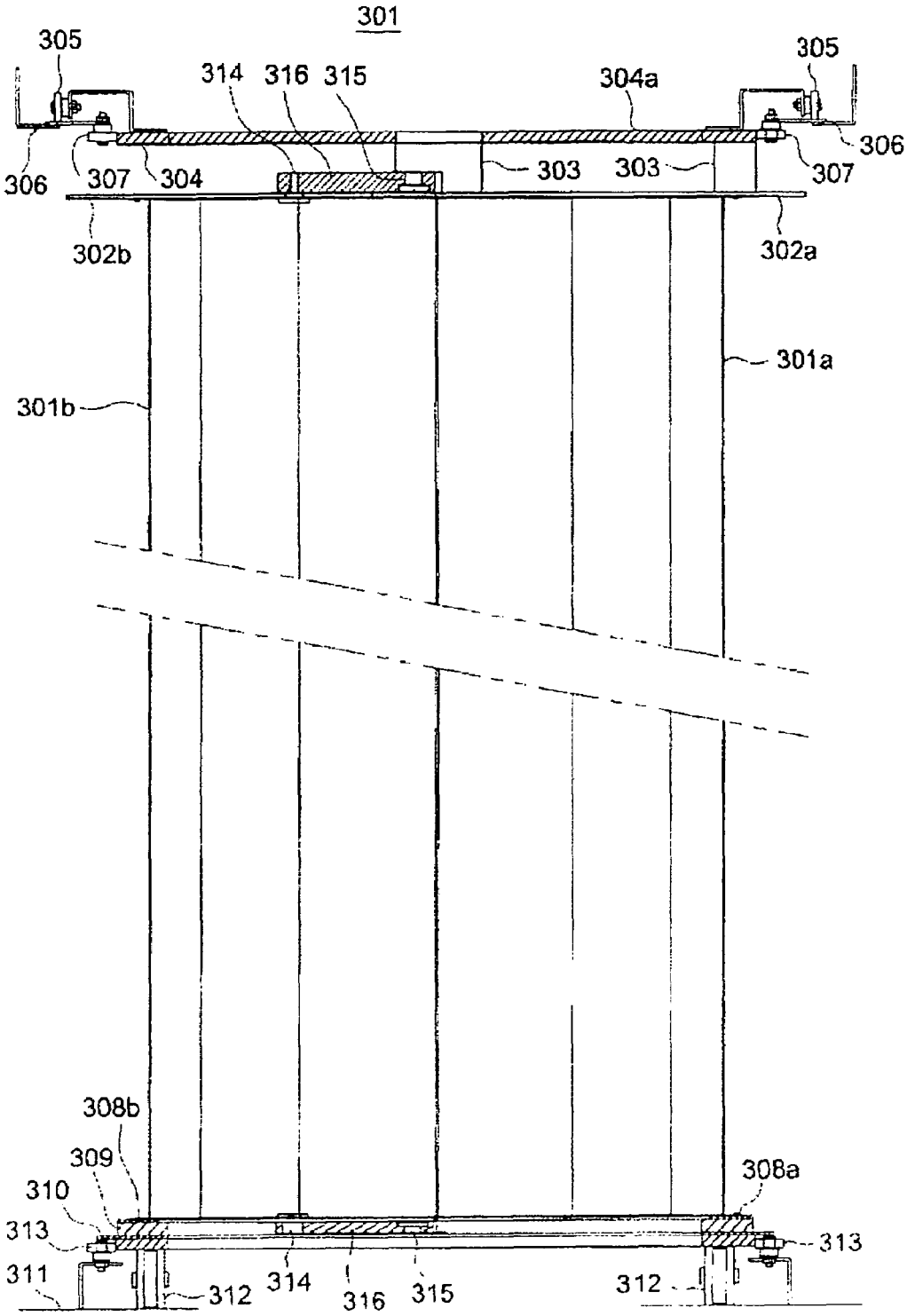

[FIG.8]
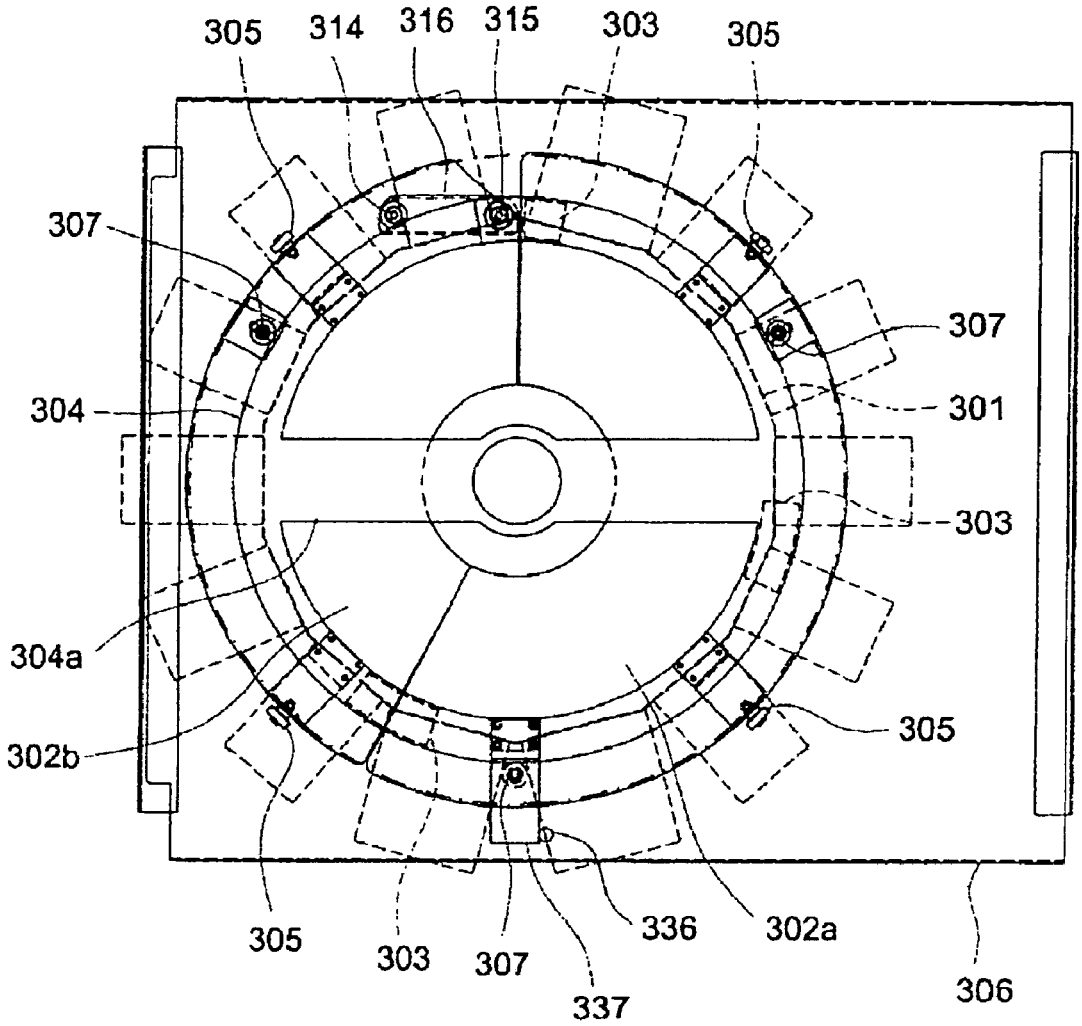

[FIG.9]
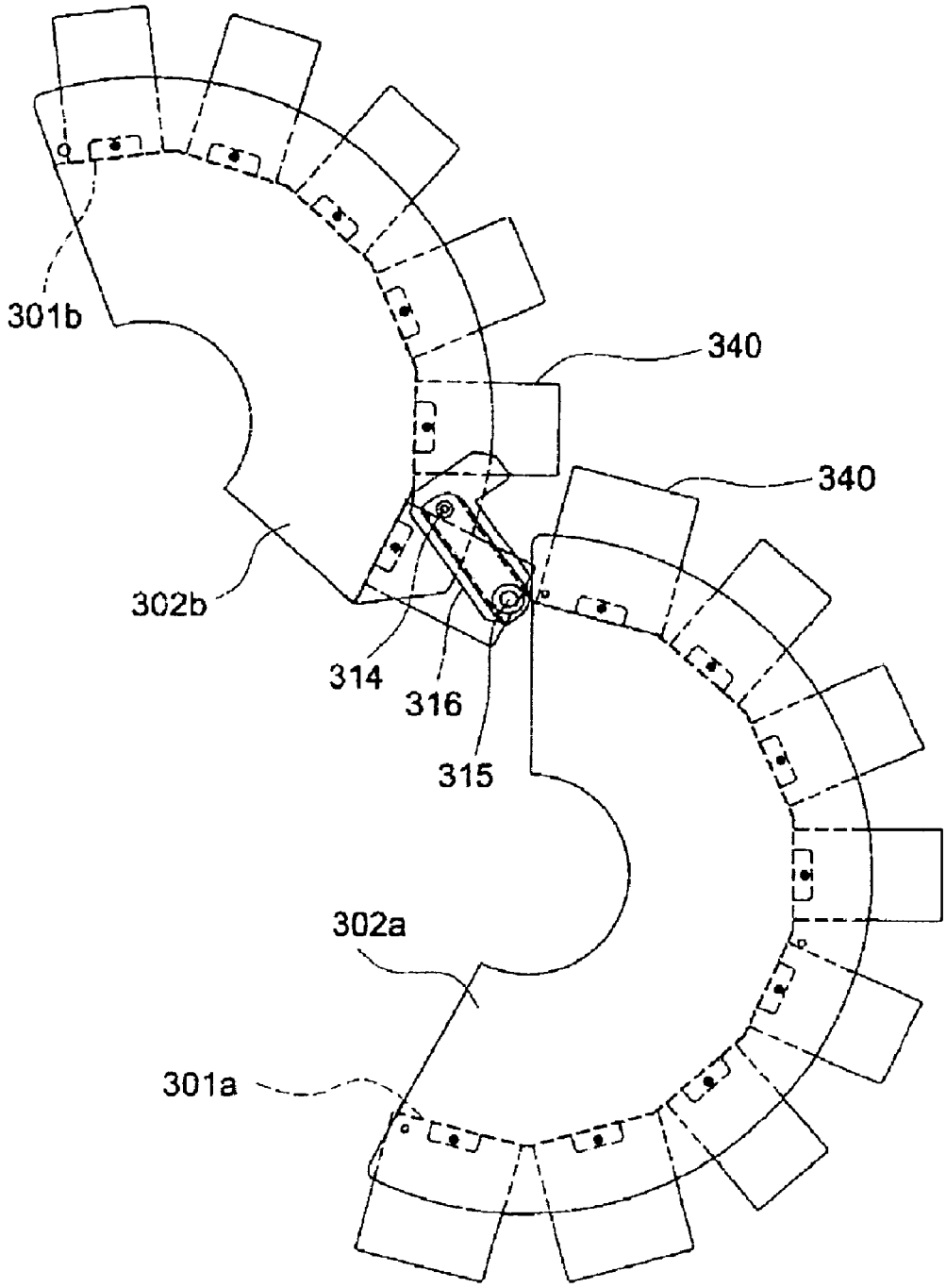

[FIG.10]
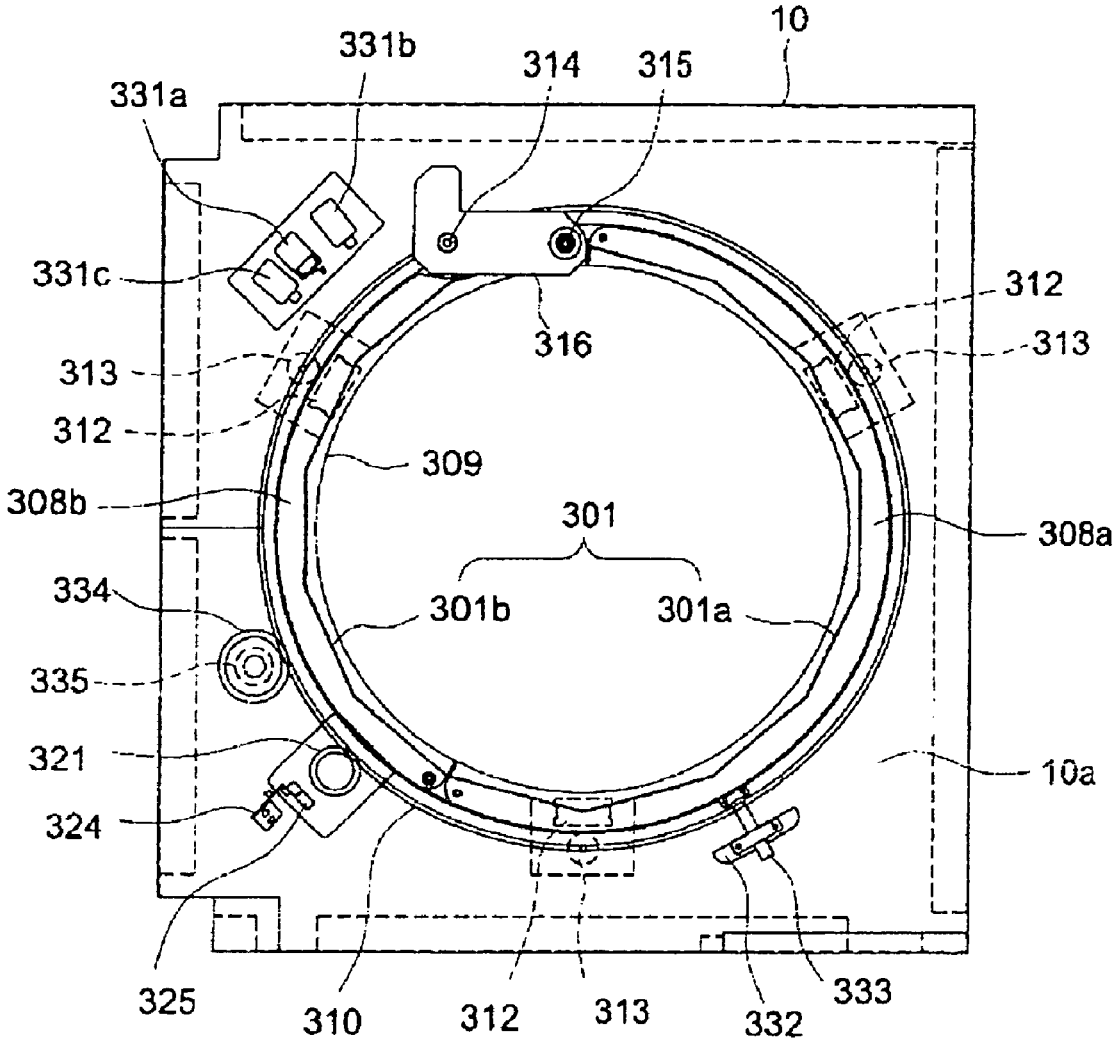

[FIG.11]
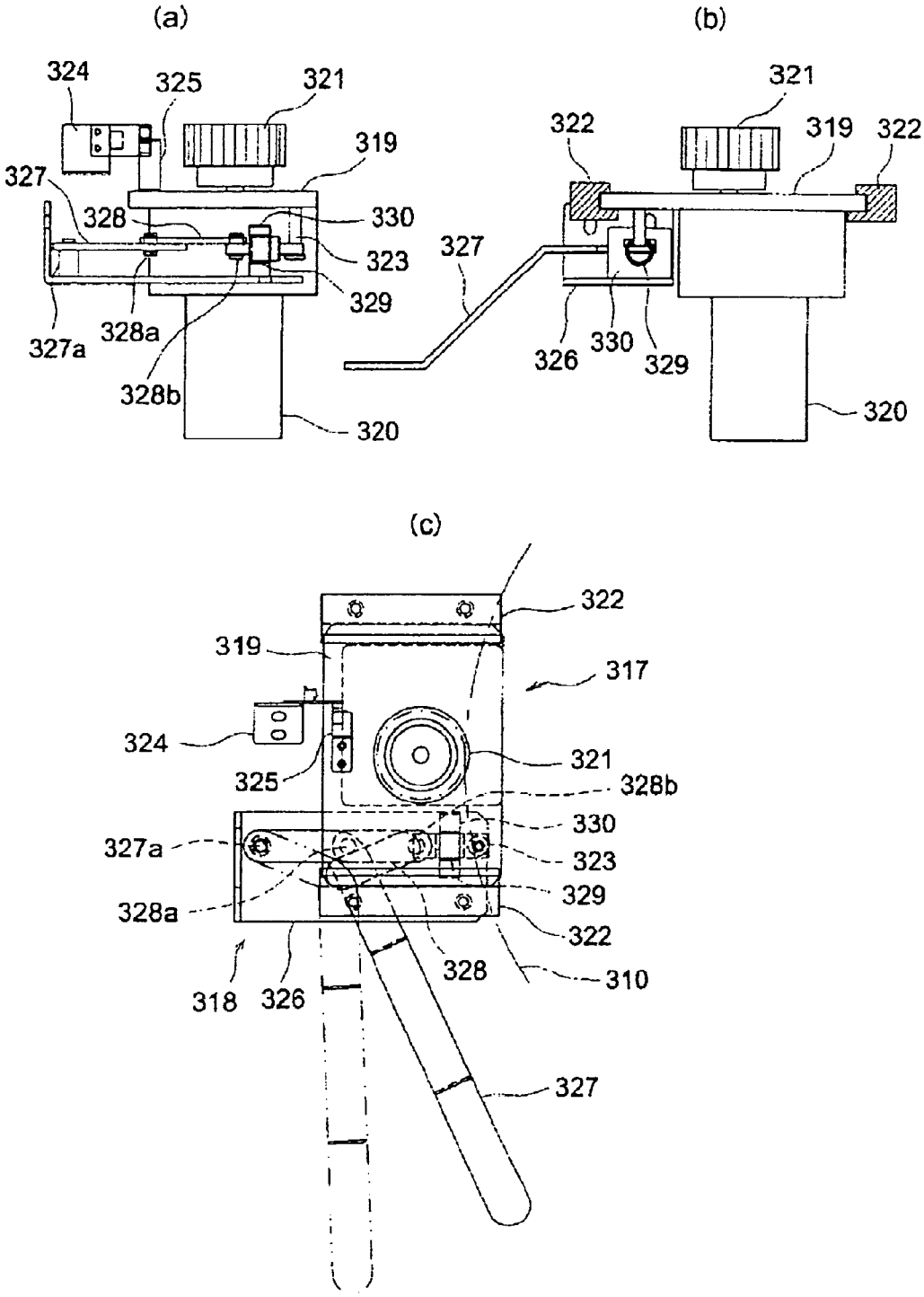

[FIG.12]
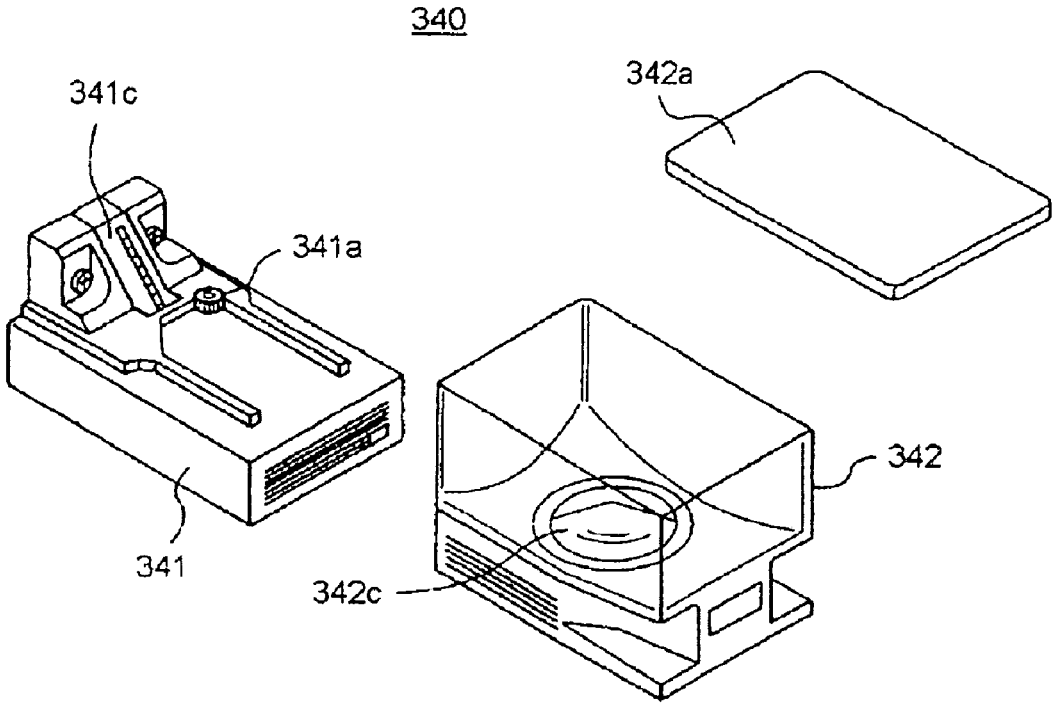

[FIG.13]
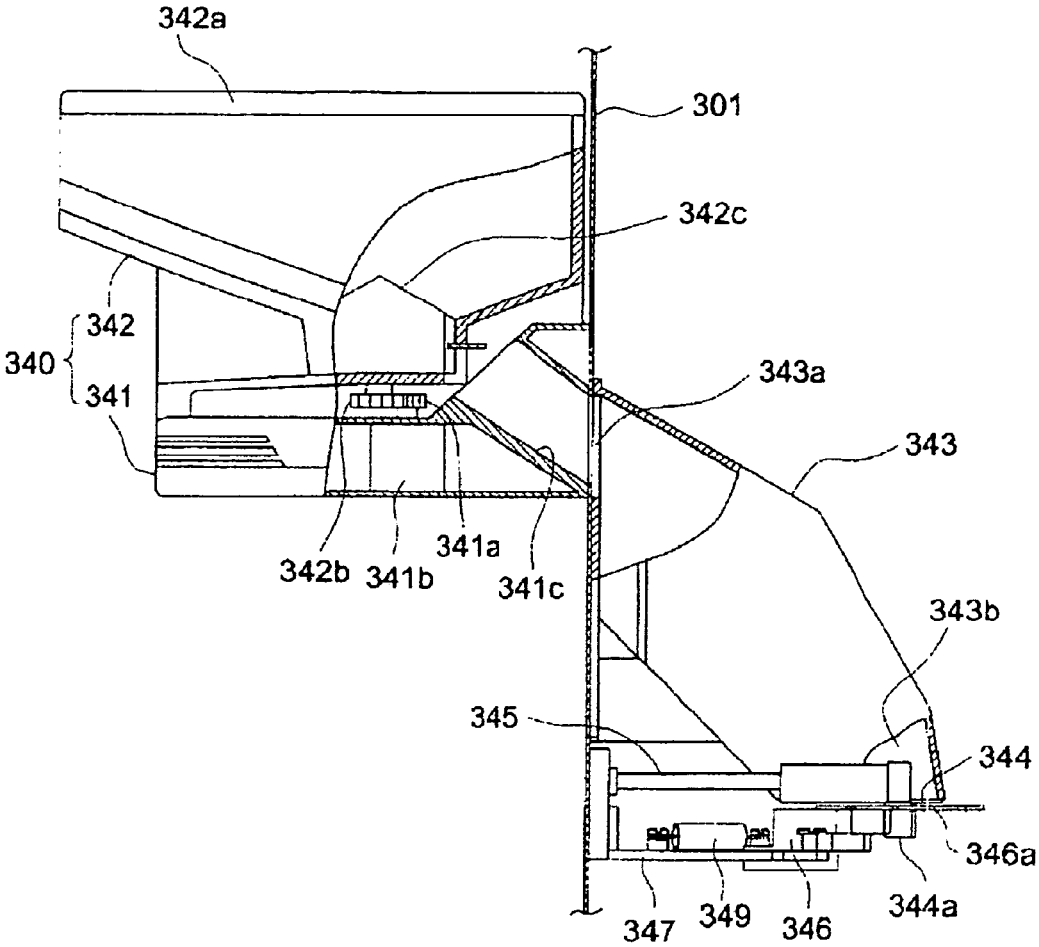

[FIG.14]
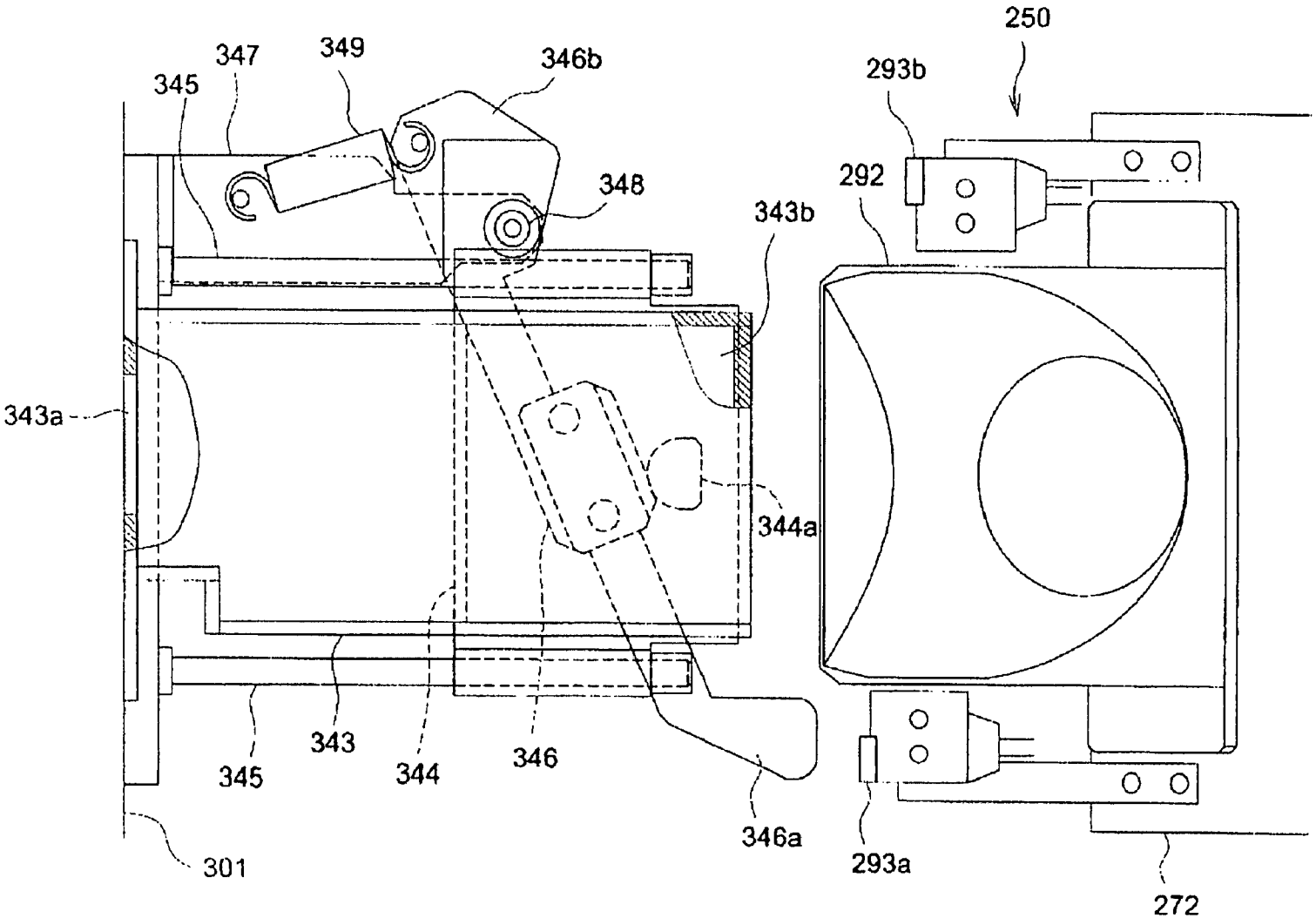

[FIG.15]
(a)
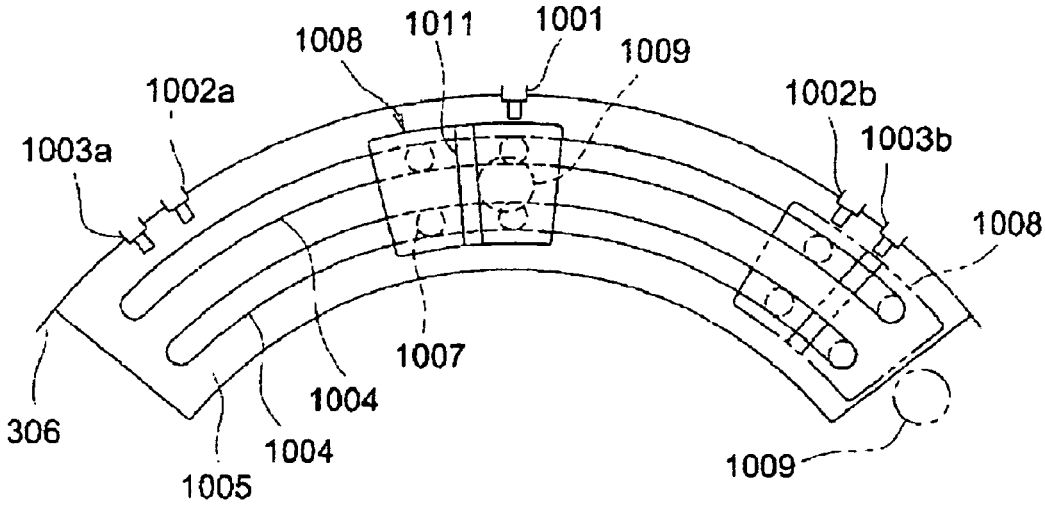
(b)
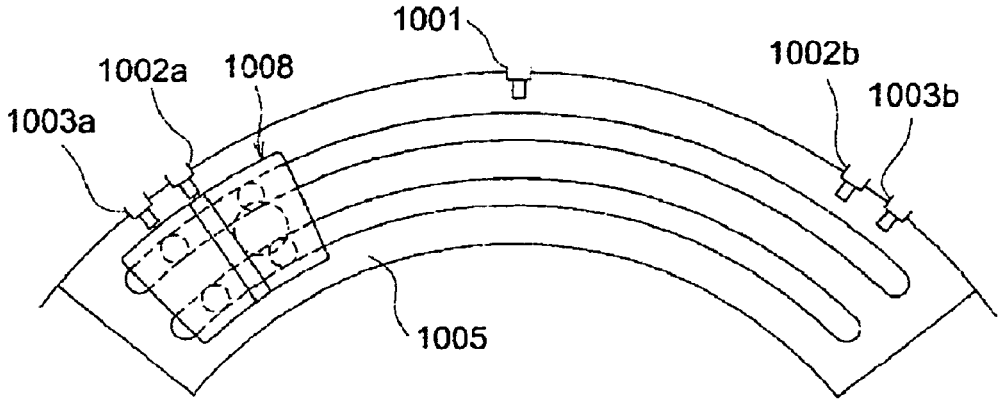
(c)
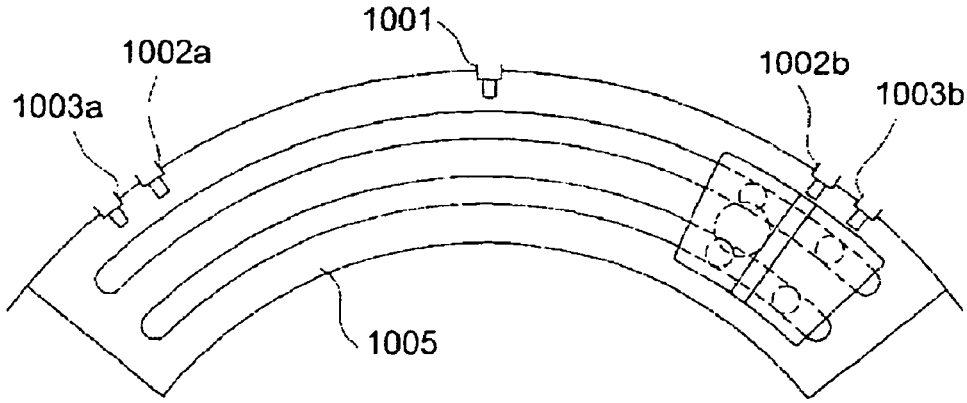

[FIG.16]
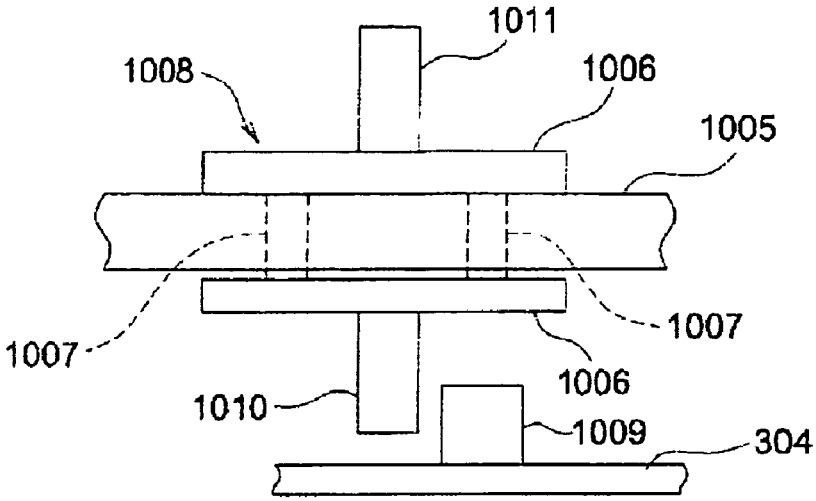
[FIG.17]
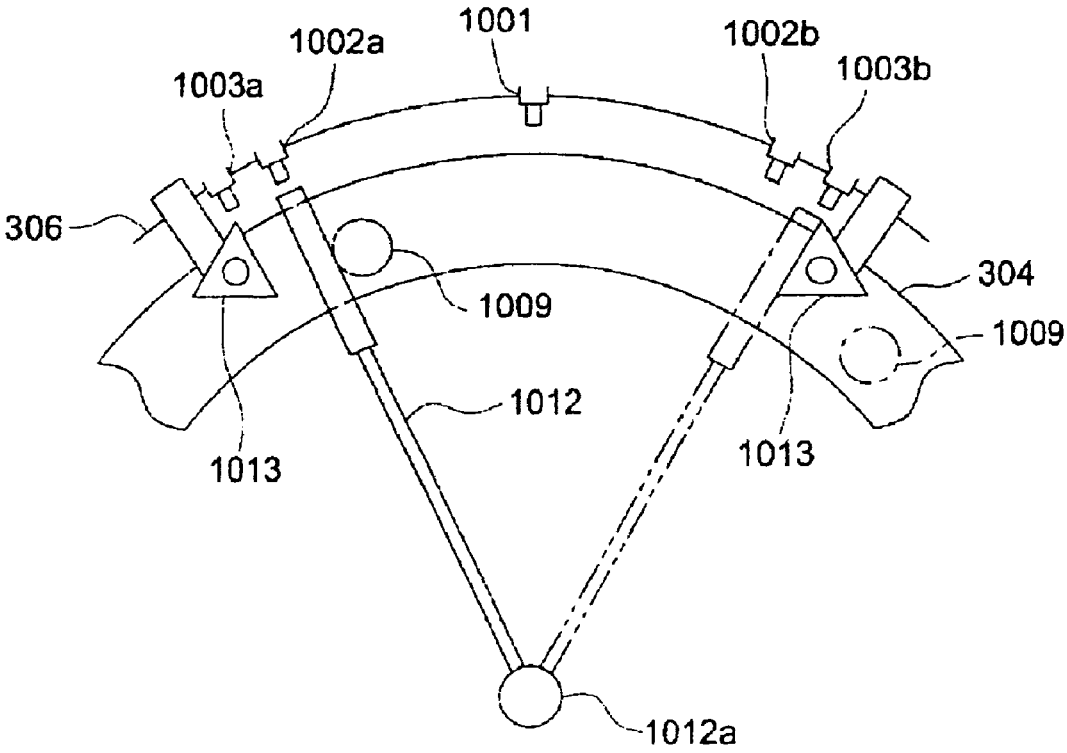

[FIG.18]
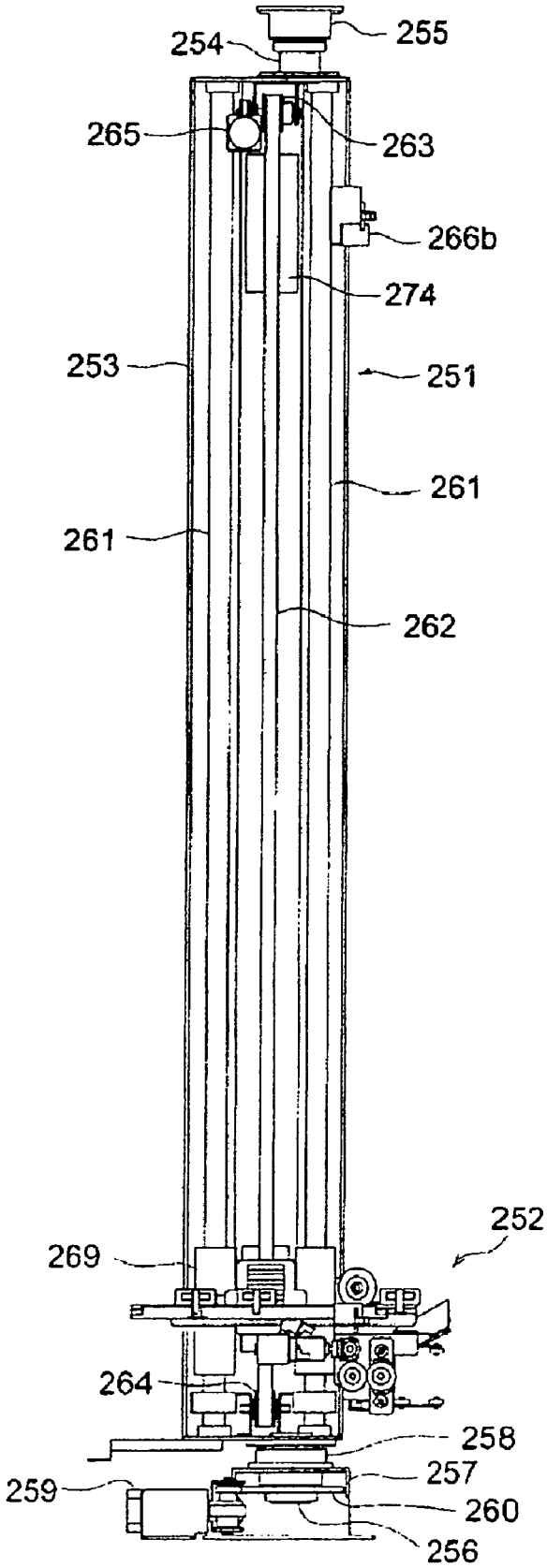

[FIG.19]
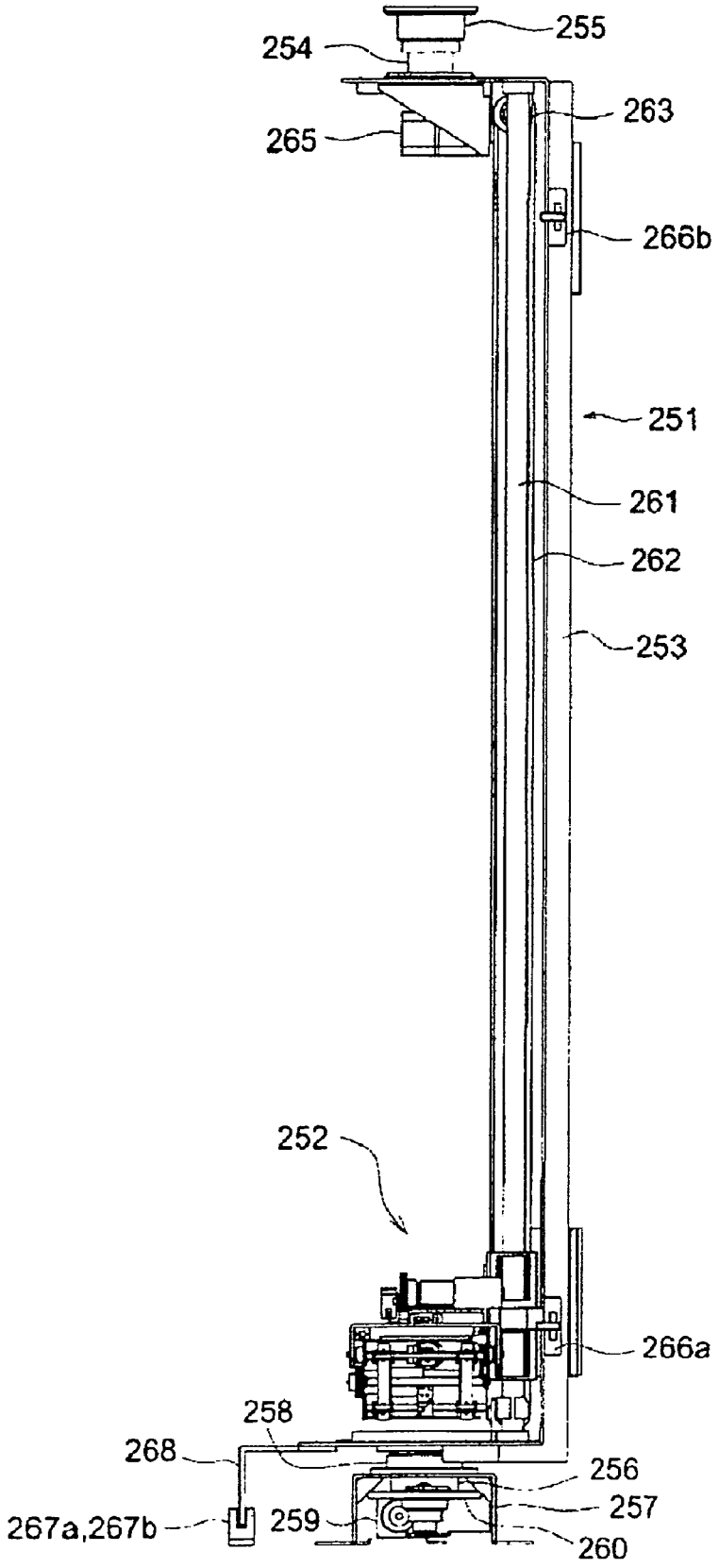

[FIG.20]
(a)
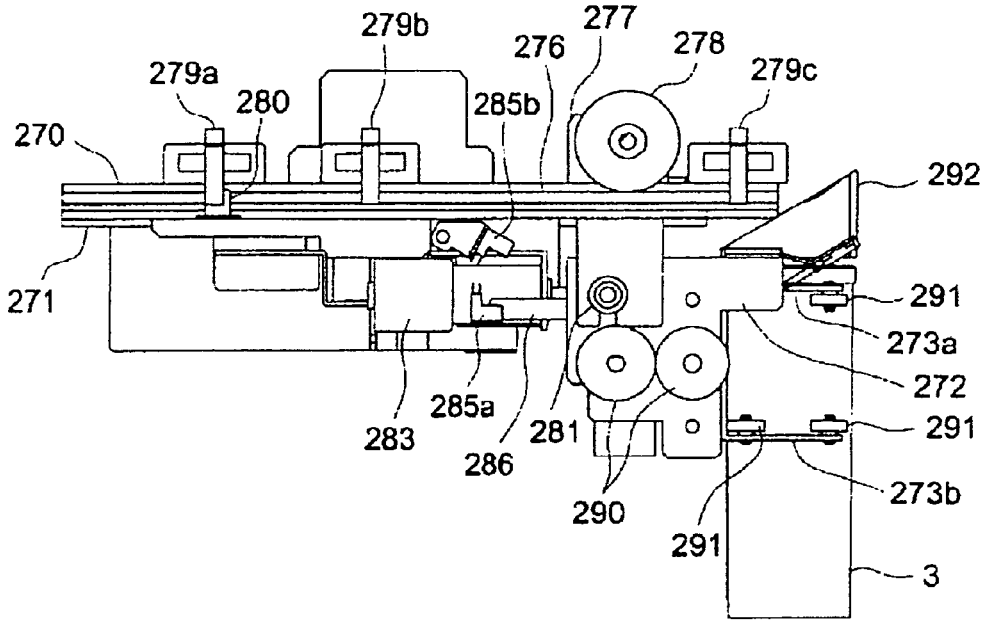
(b)
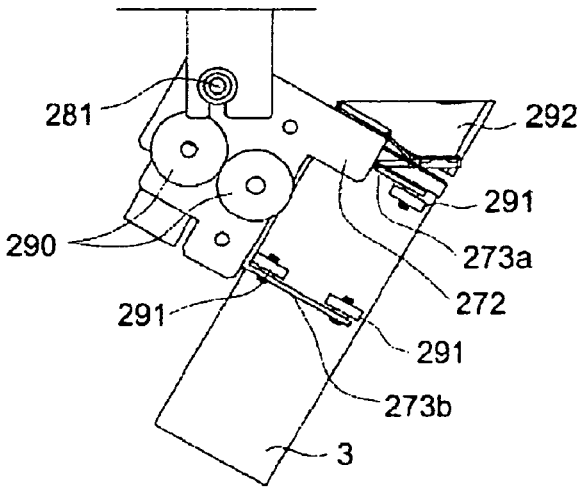

[FIG.21]
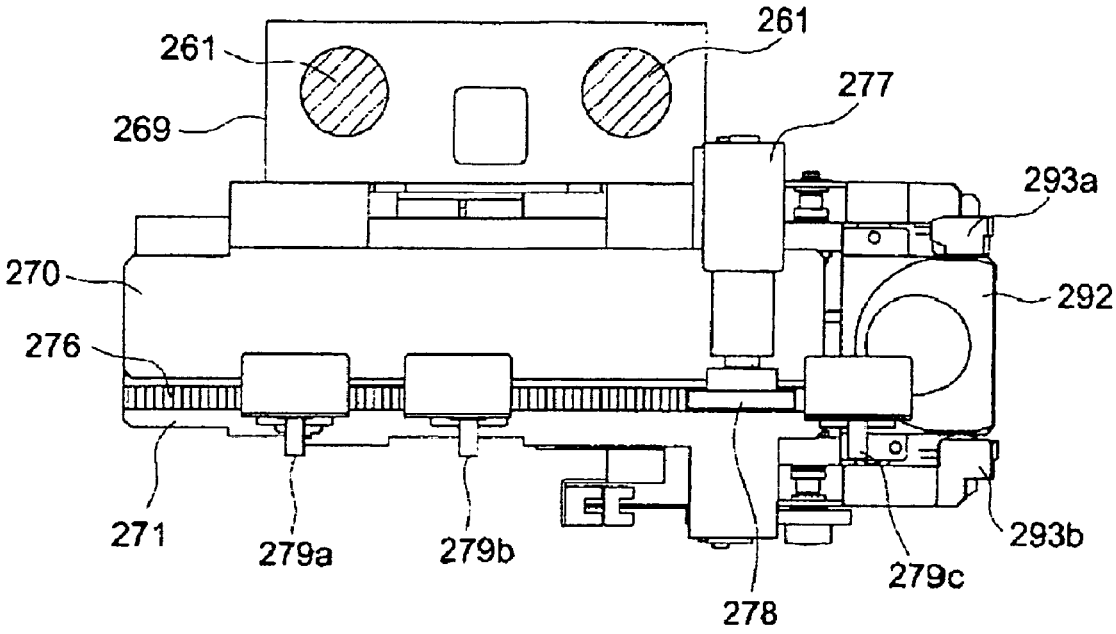

[FIG.22]
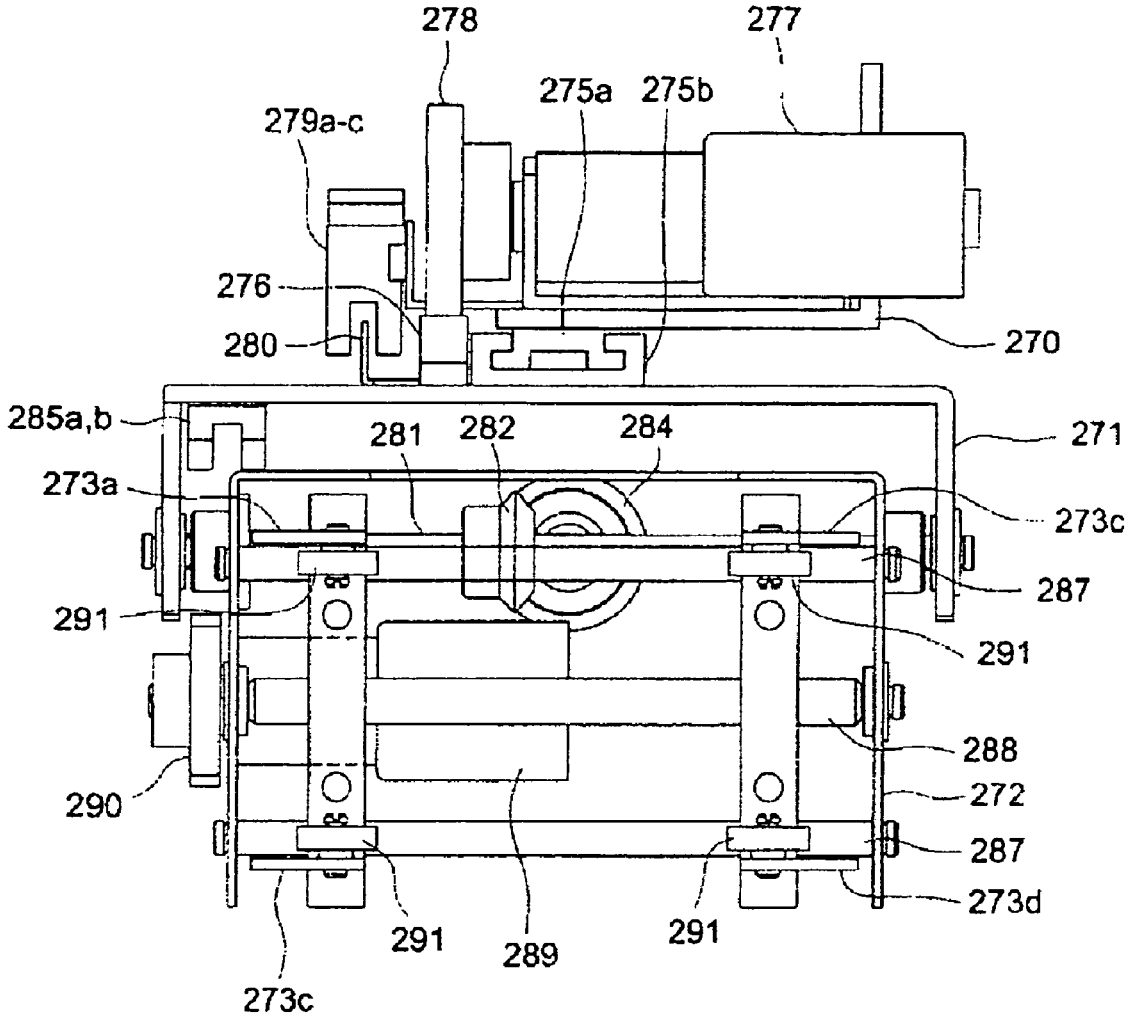

[FIG.23]
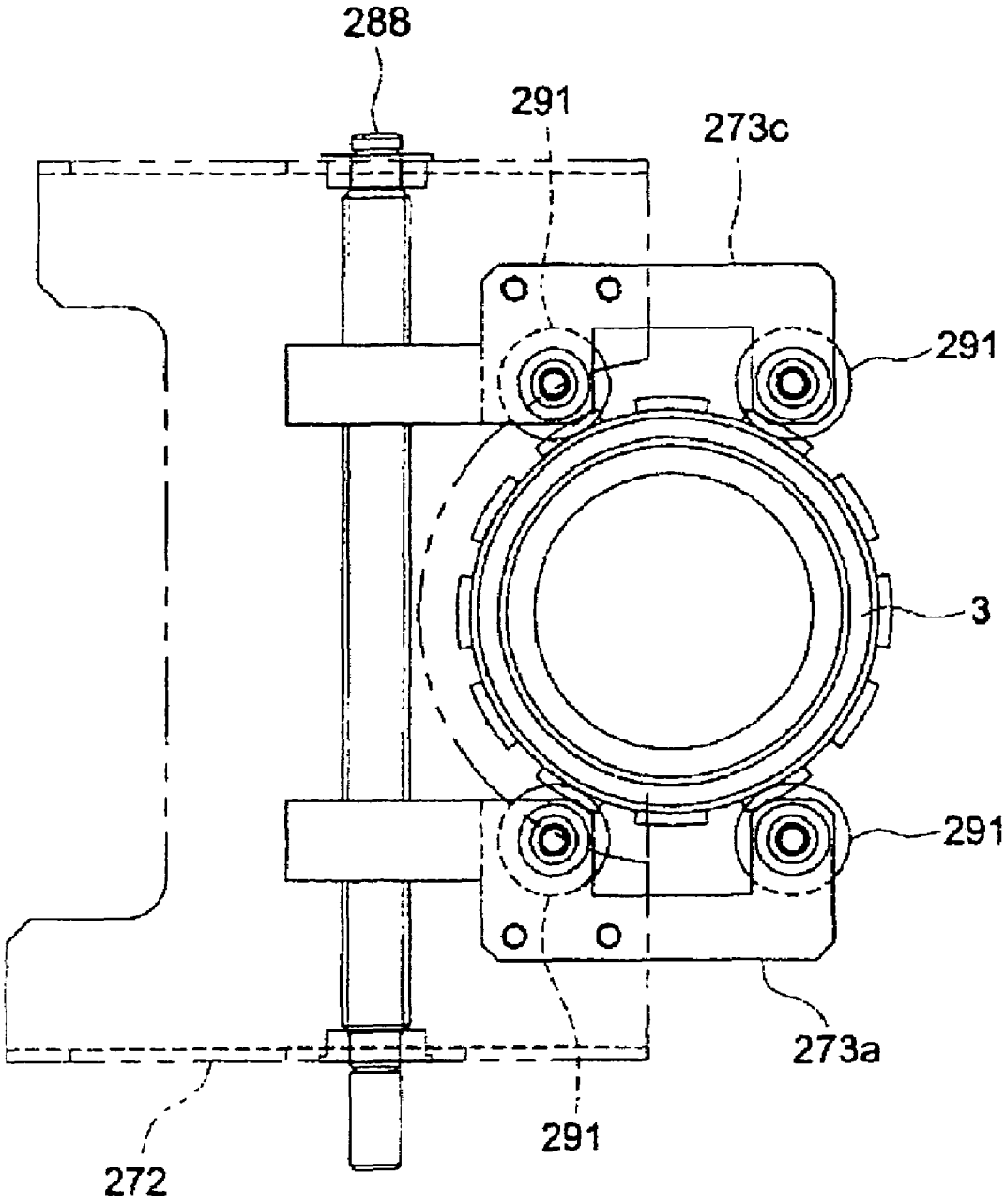

[FIG. 24]
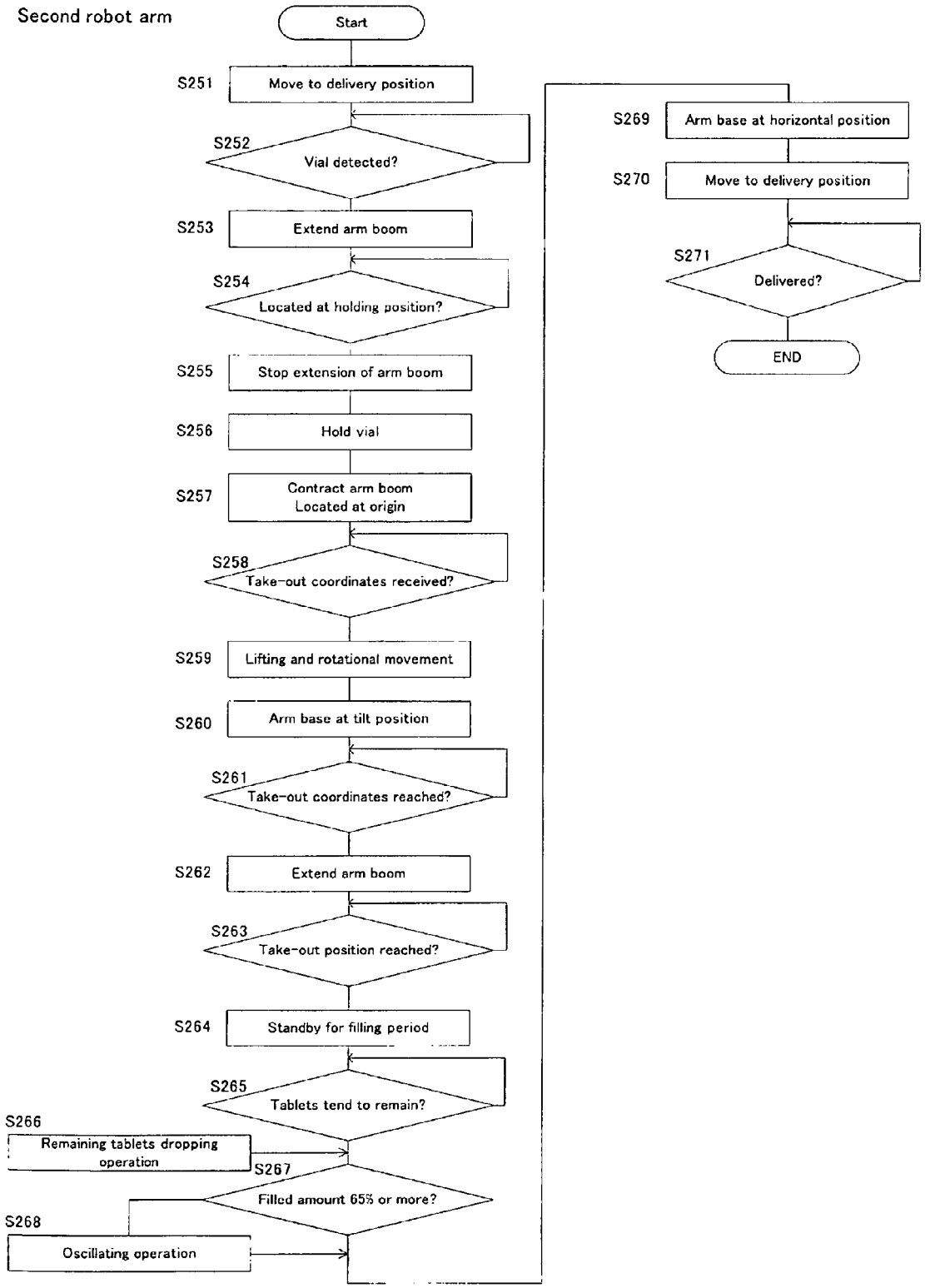

[FIG. 25]
Mutual control
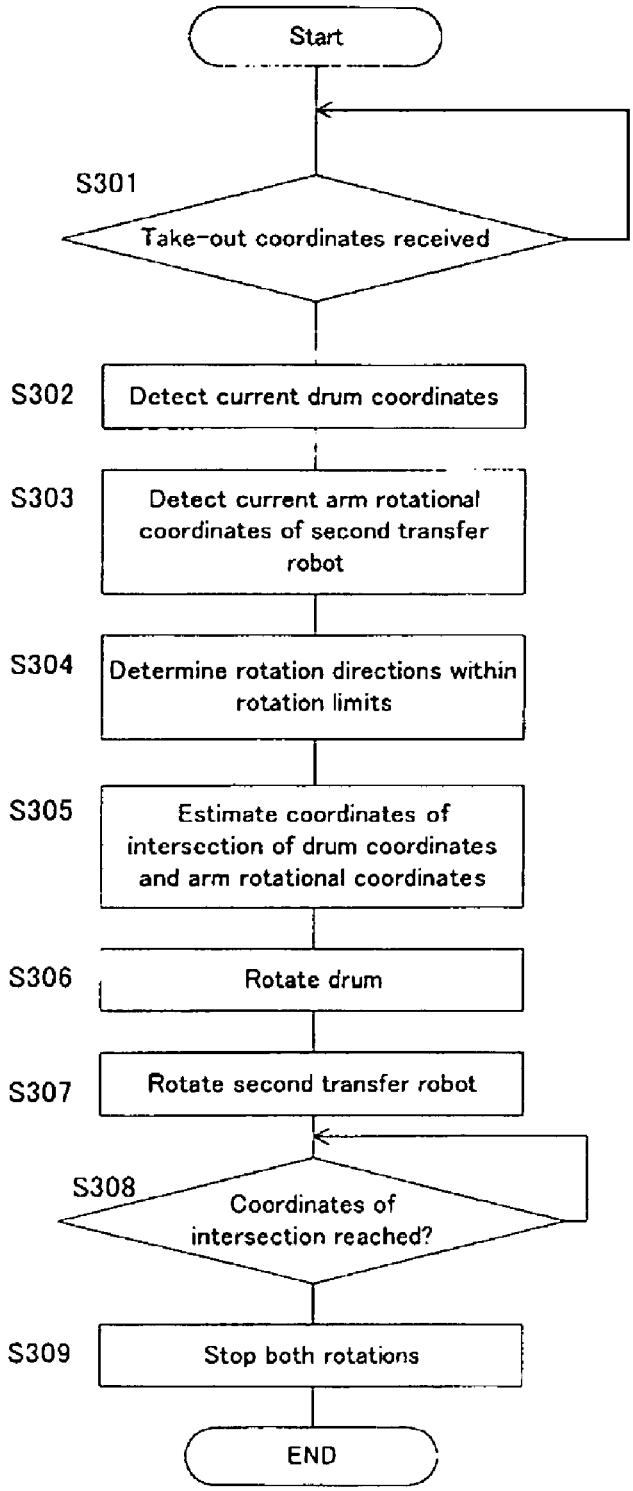

[FIG. 26]
Drum control
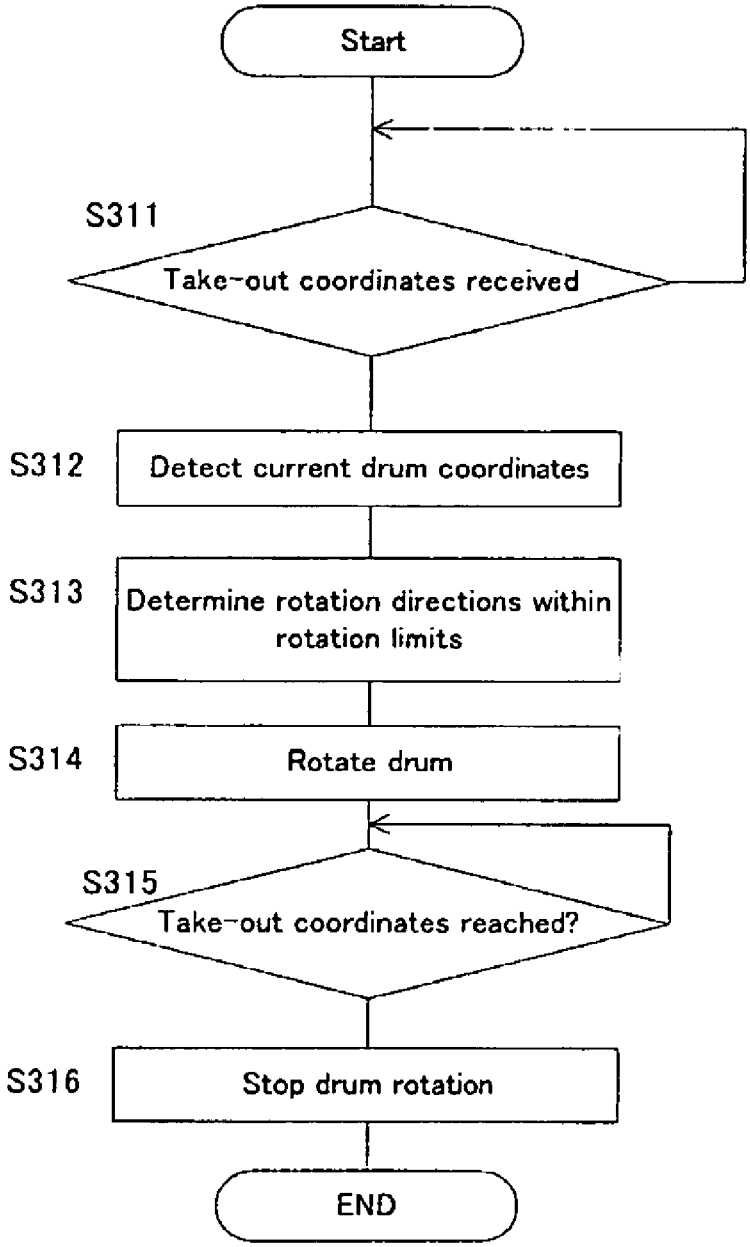

[FIG. 27]
Robot arm control
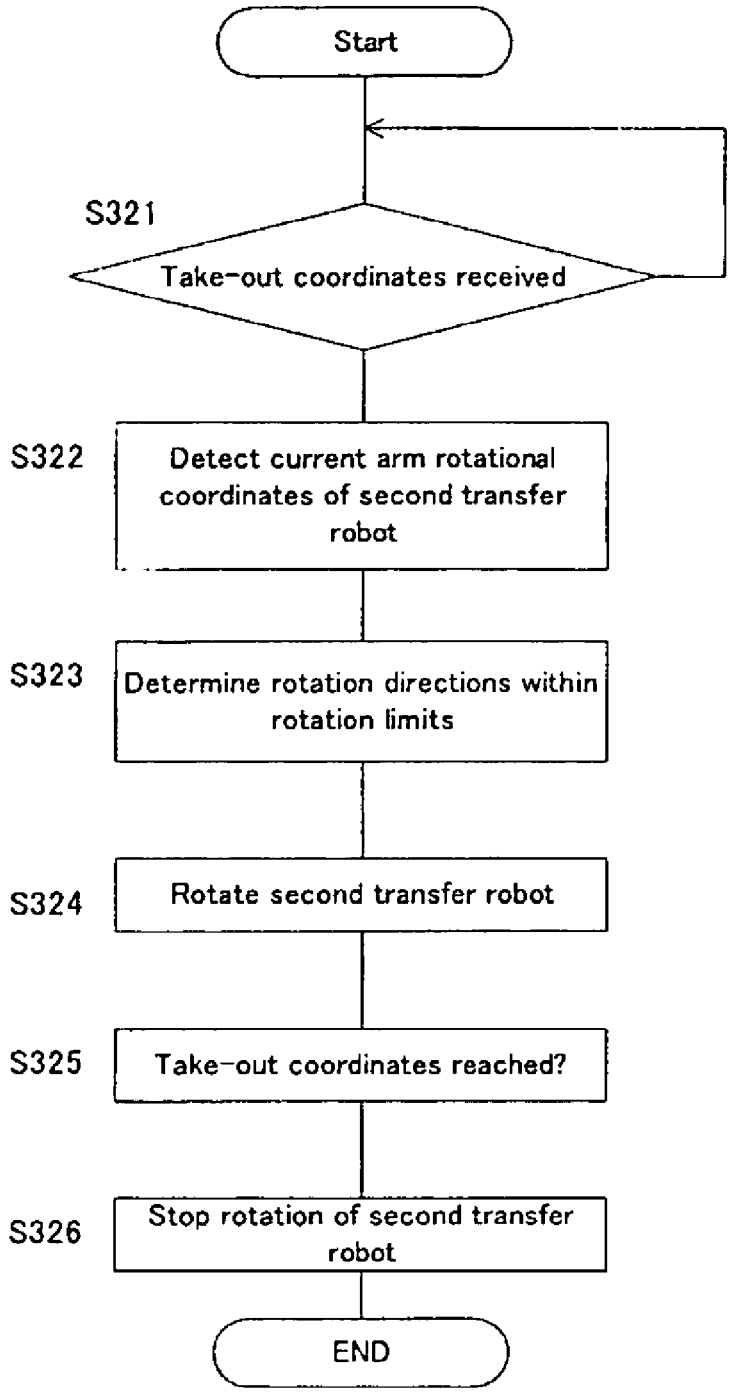

[FIG.28]
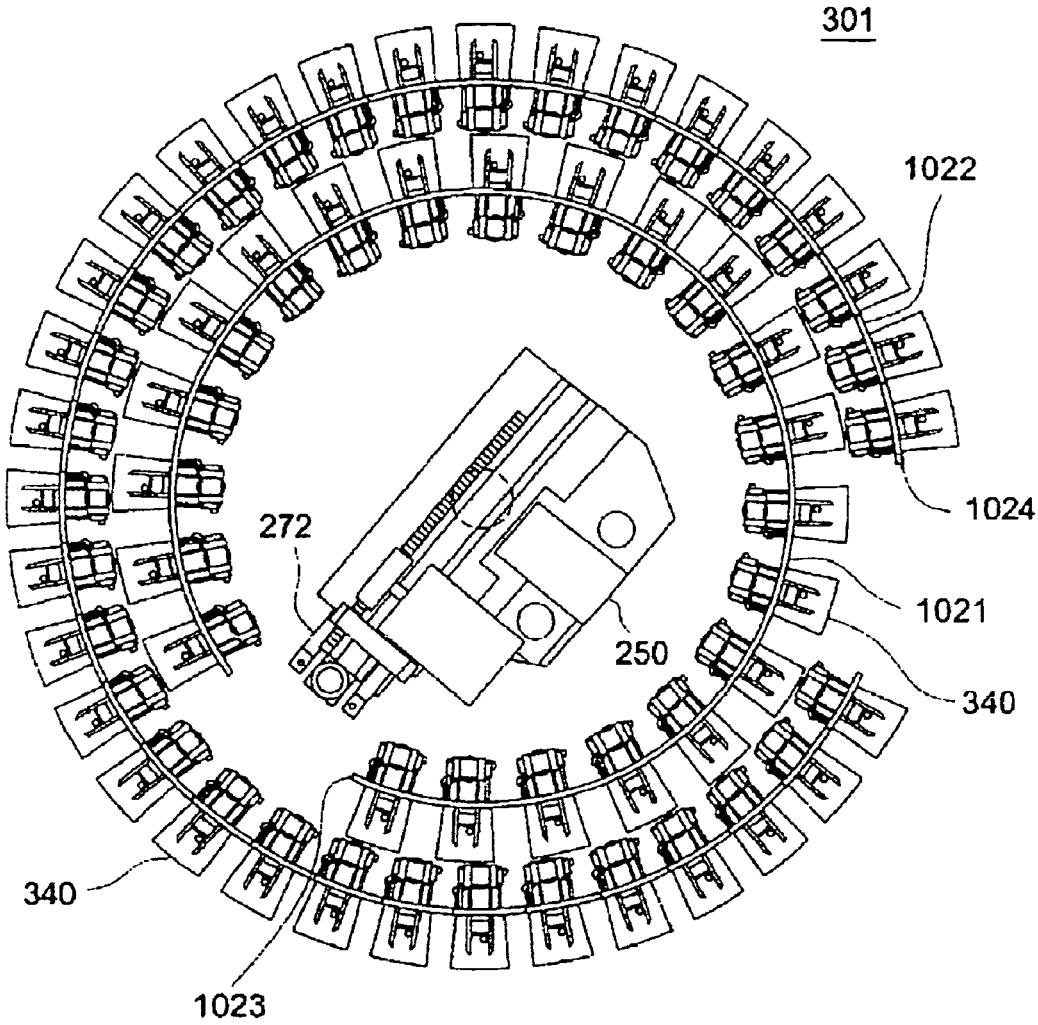

[FIG.29]
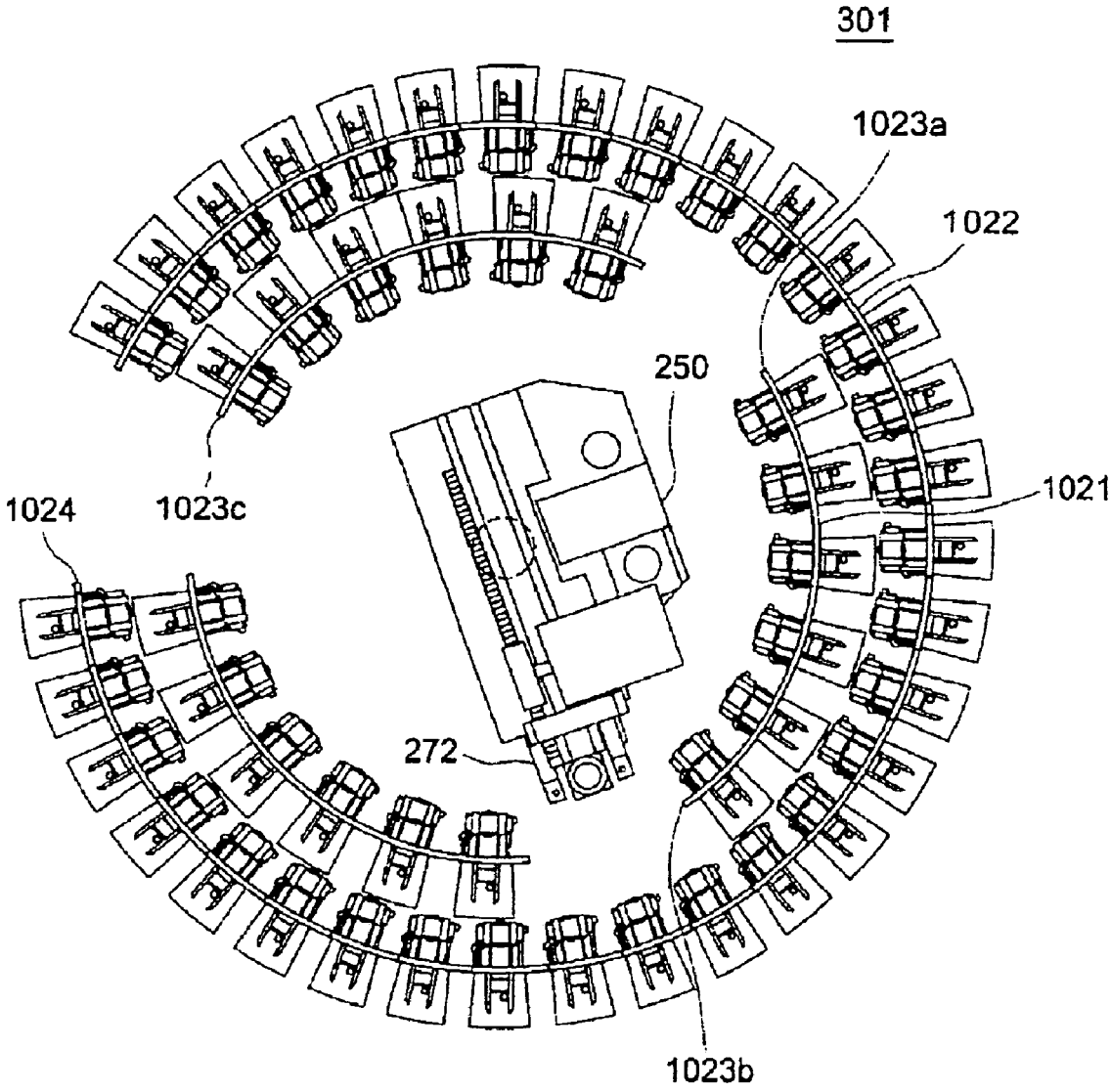

[FIG.30]
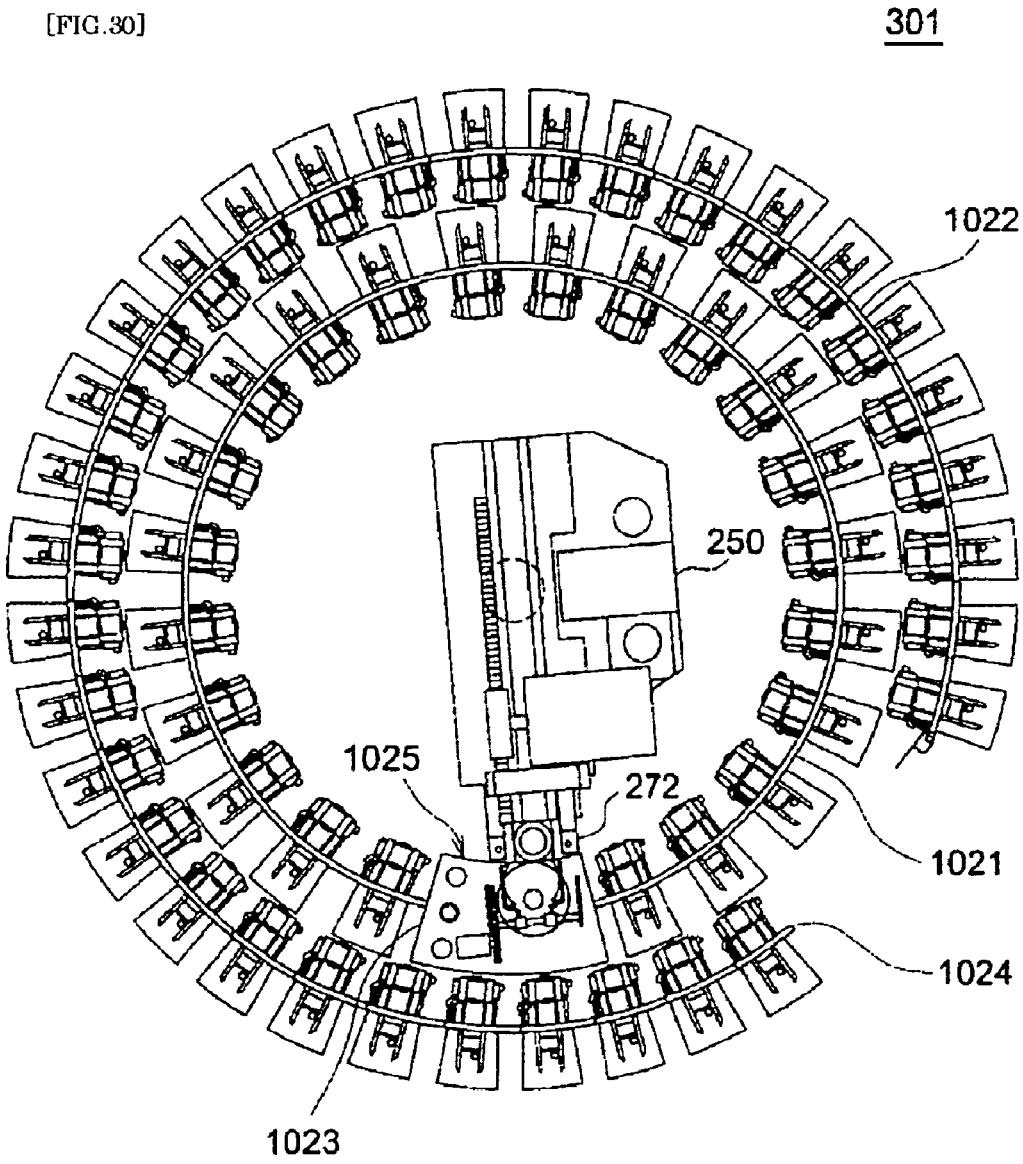

[FIG.31]
(a)
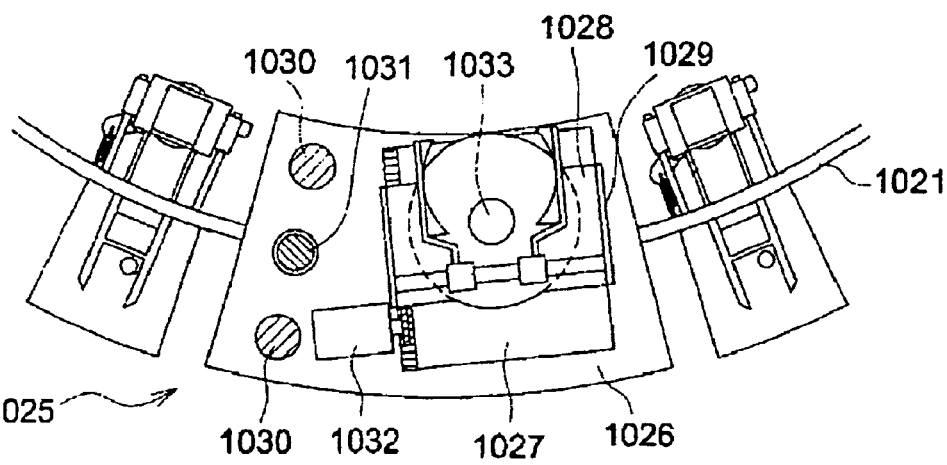
(b)
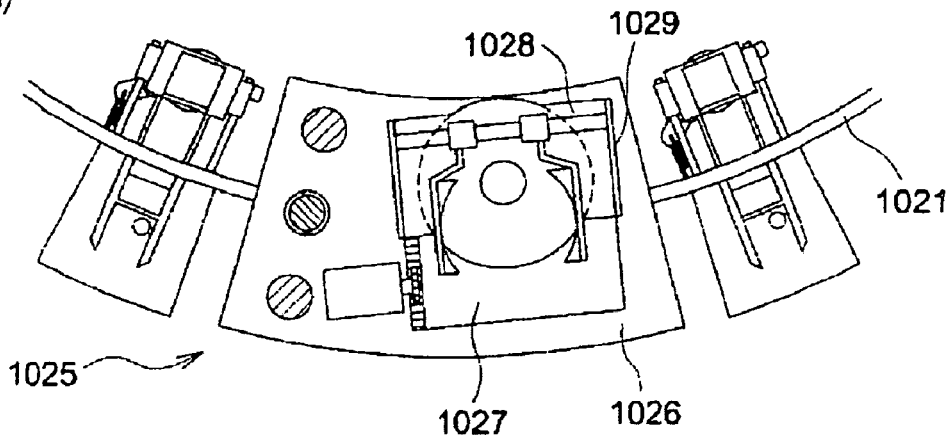
(c)
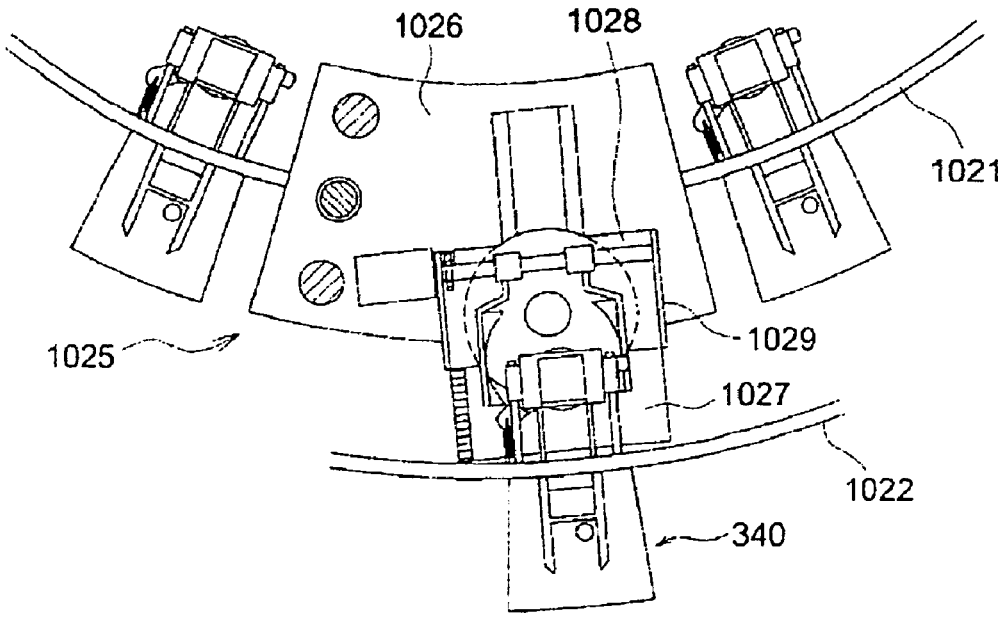

[FIG. 32]
Double drum
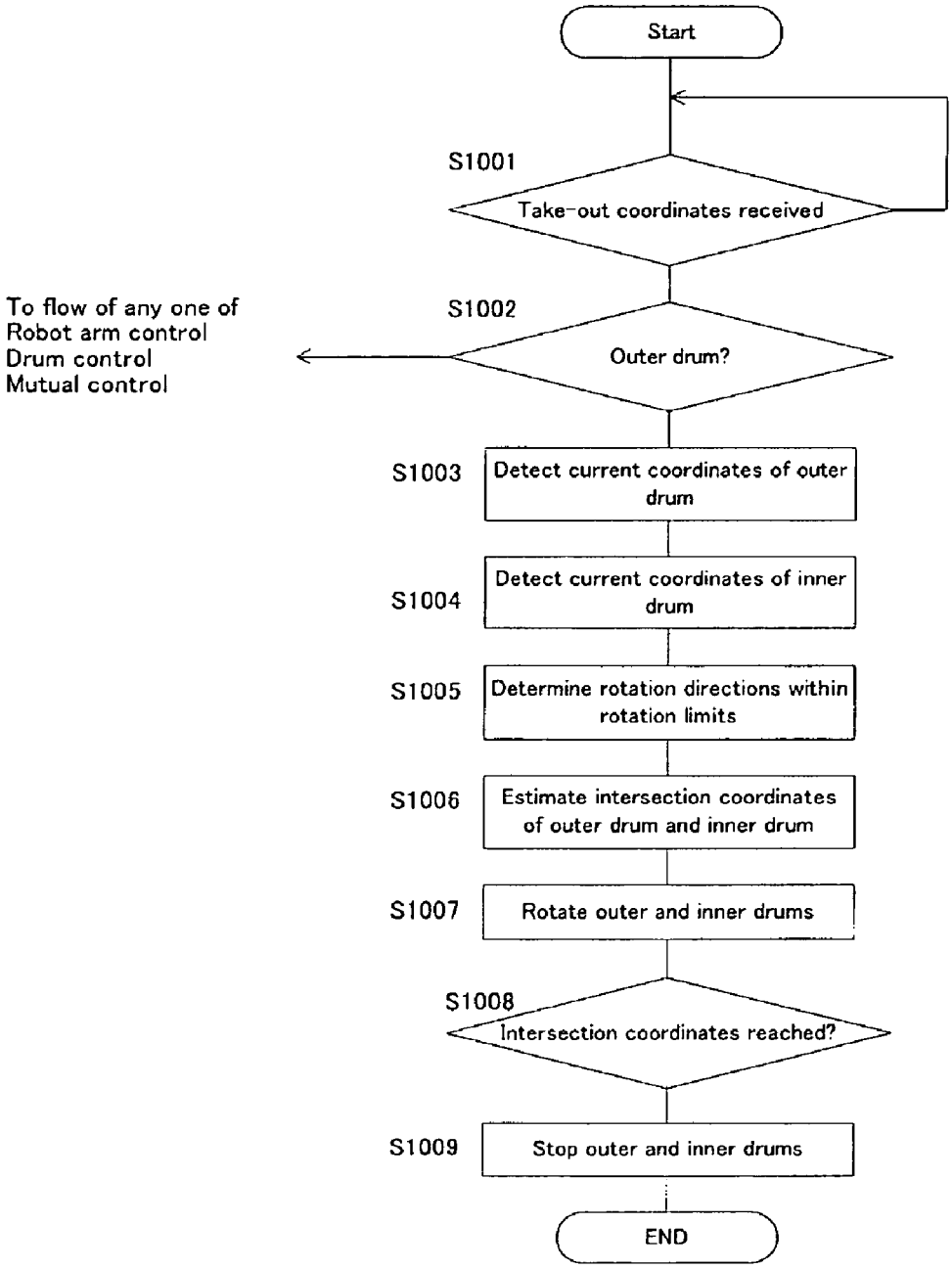

[FIG. 33]
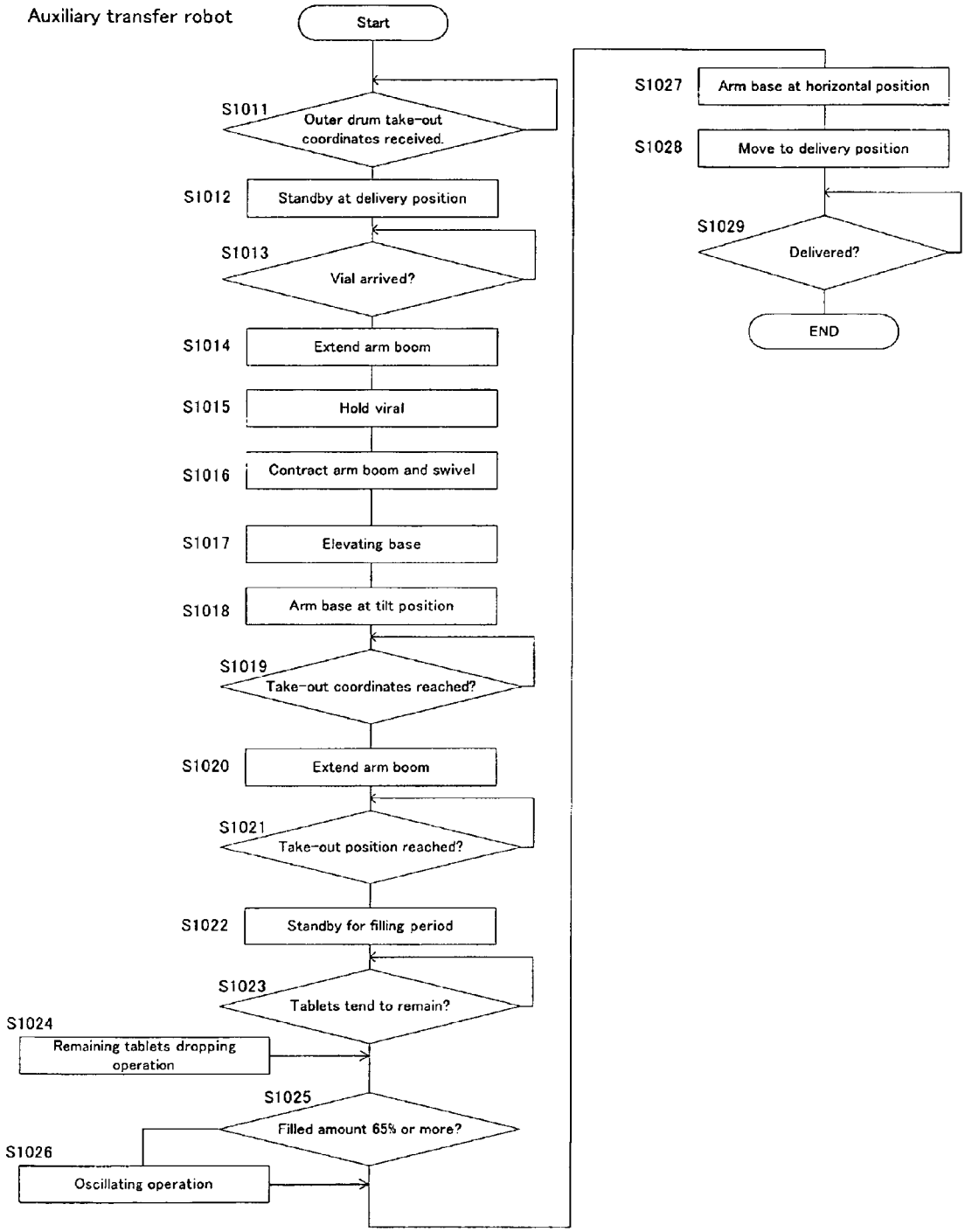

[FIG.34]
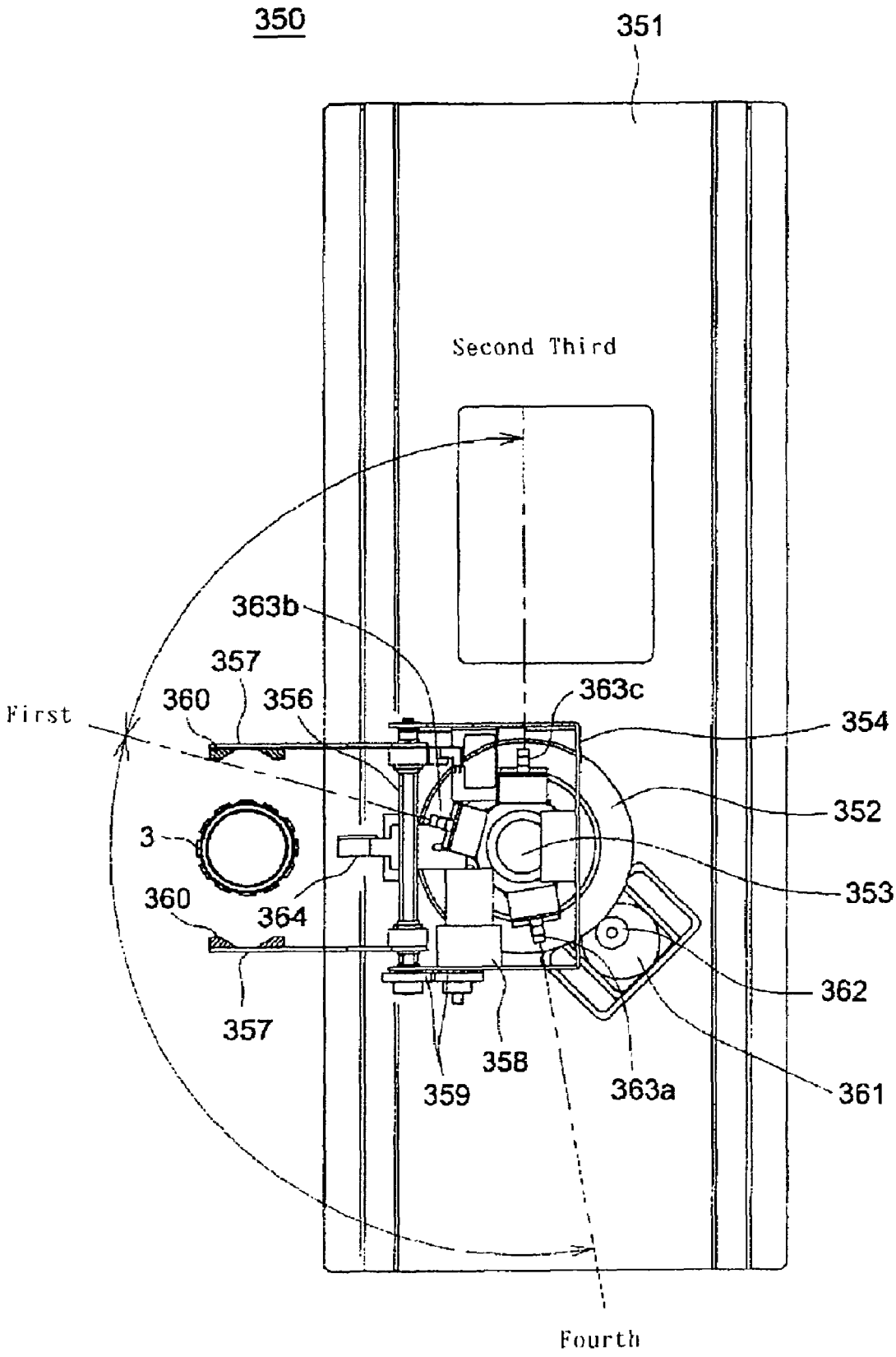

[FIG.35]
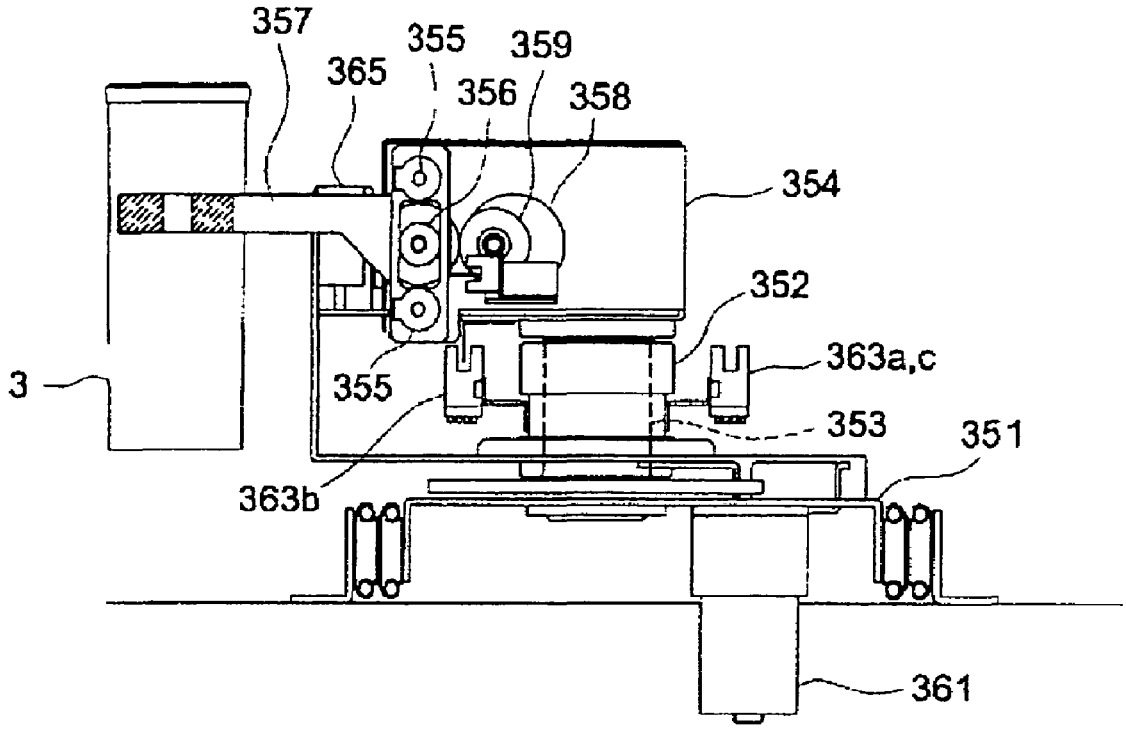

[FIG. 36]
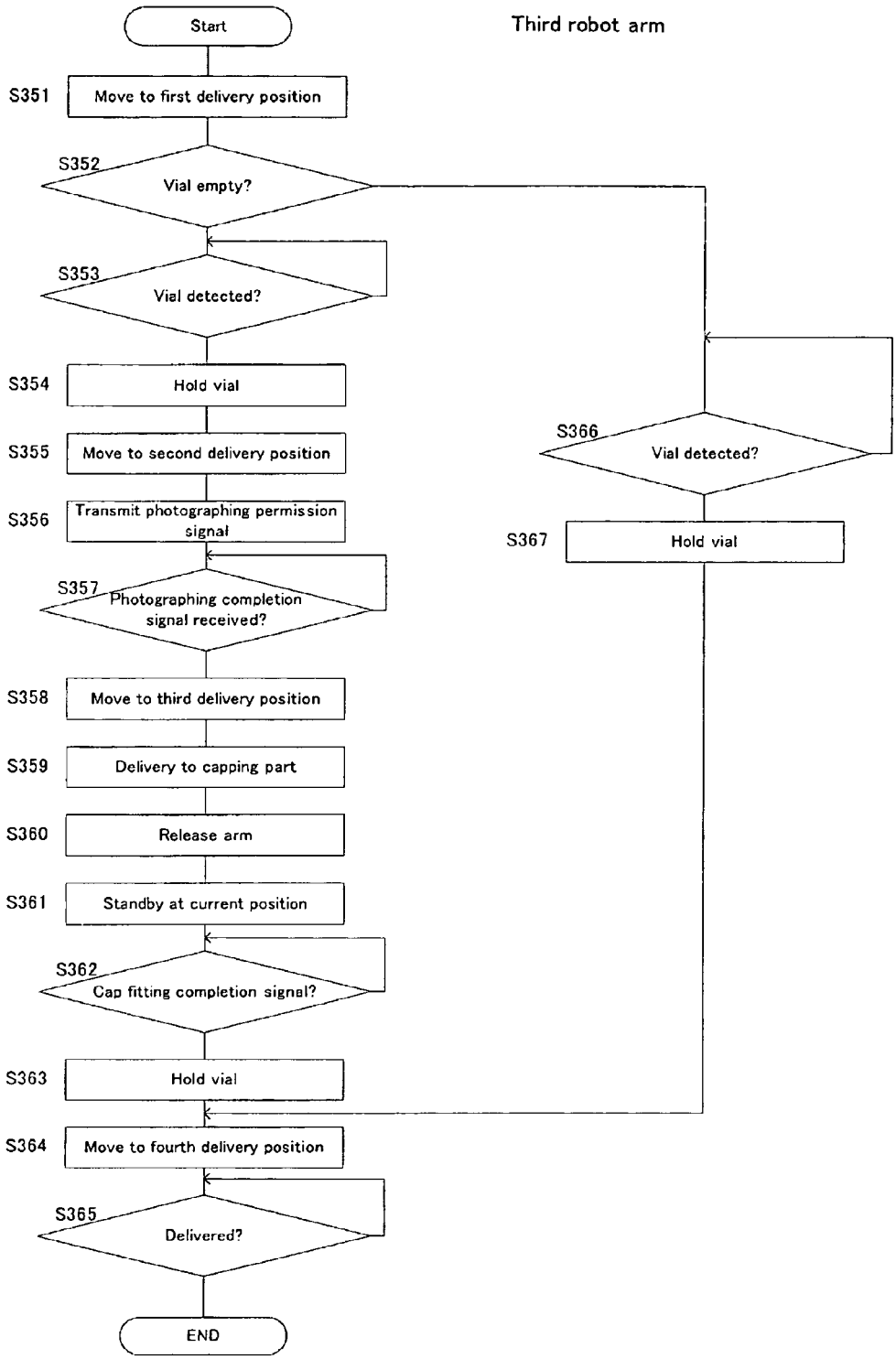

[FIG. 37]
Photographing initialization
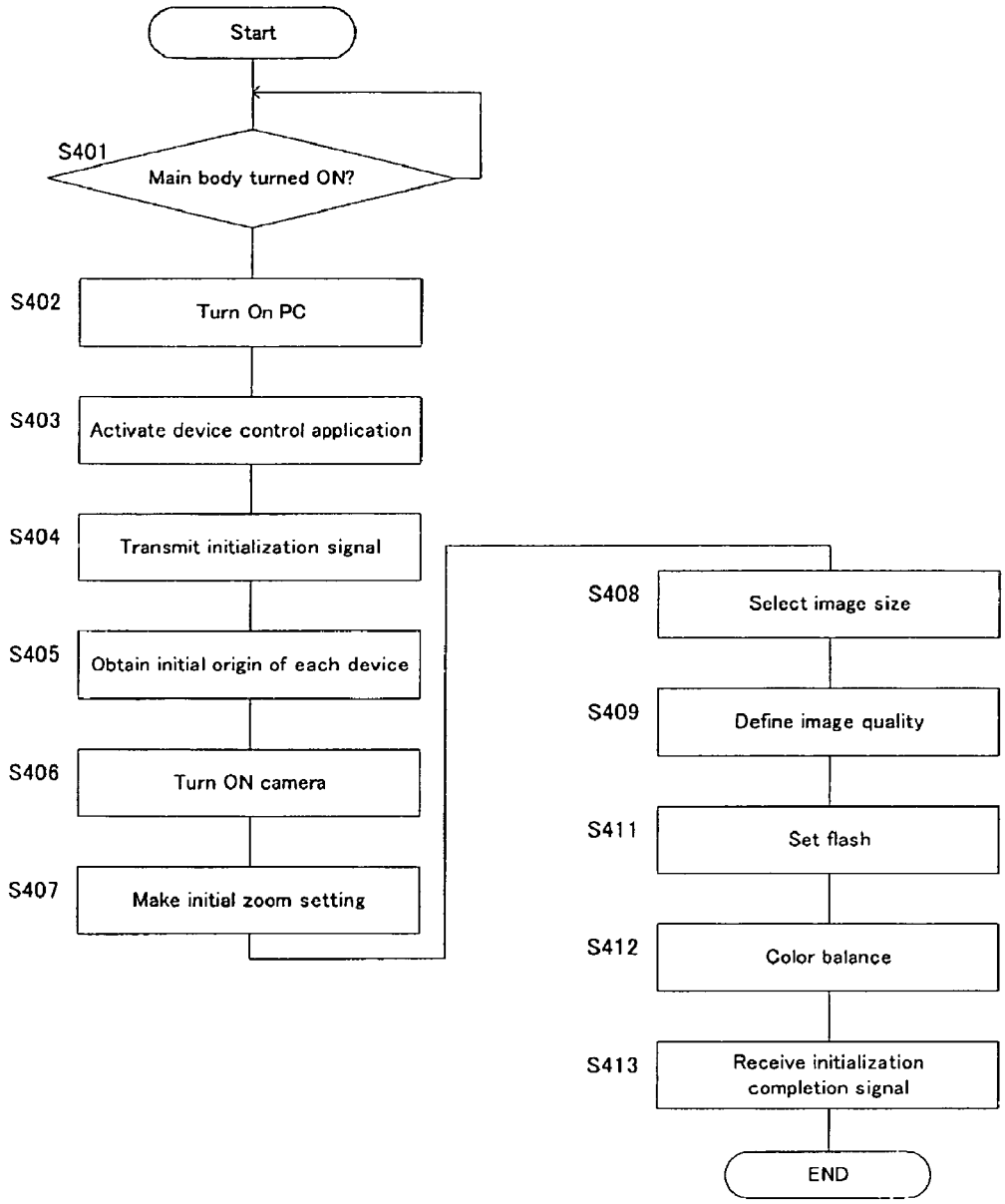

[FIG. 38]
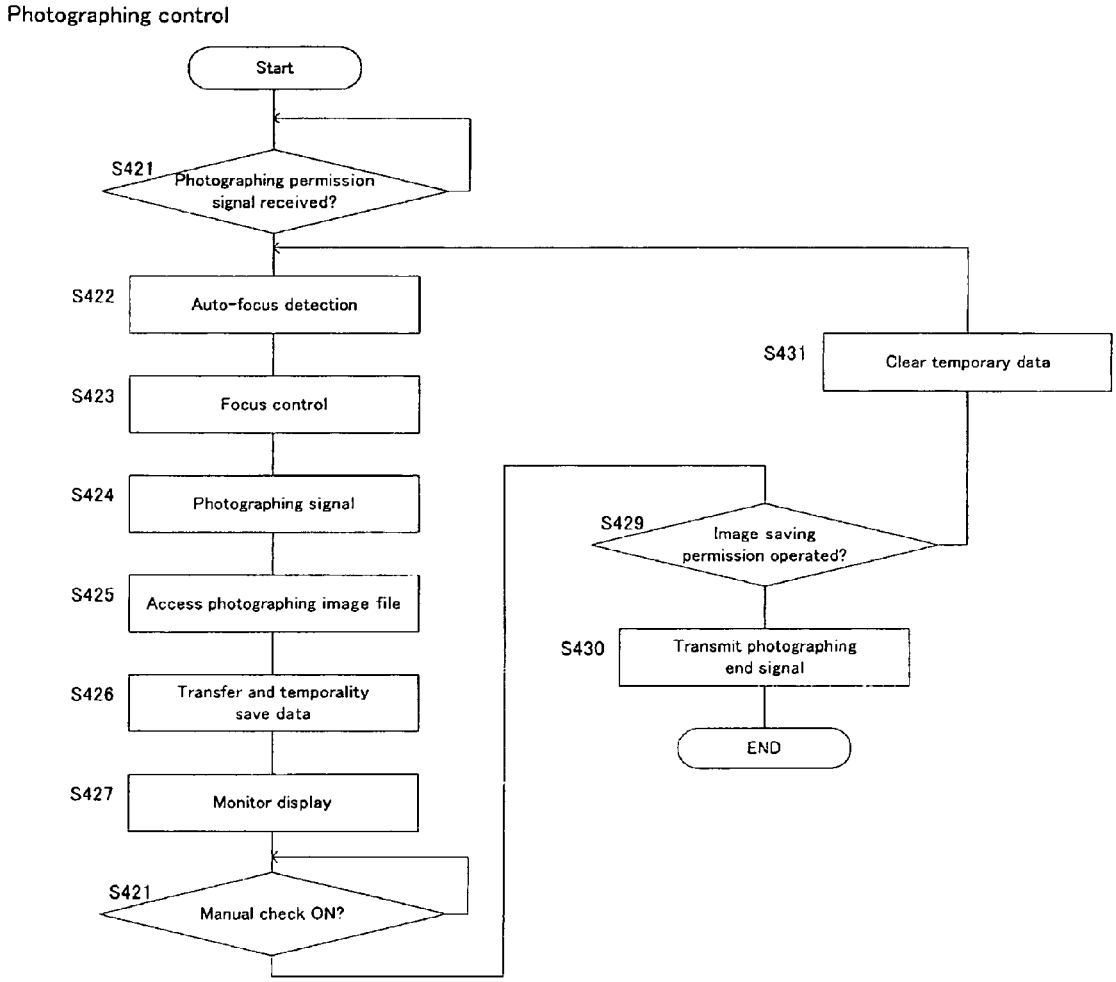

[FIG. 39]
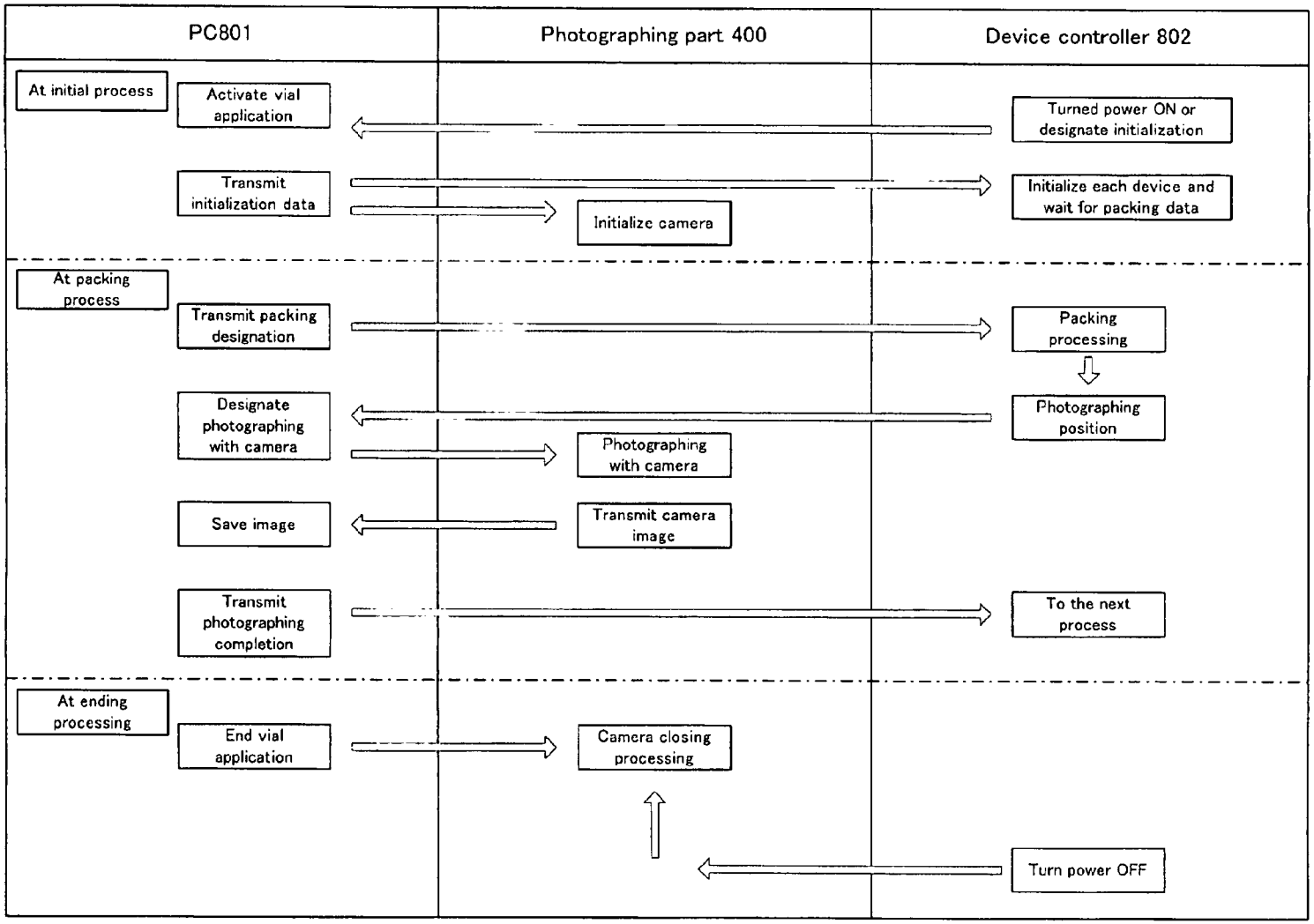

[FIG. 40]
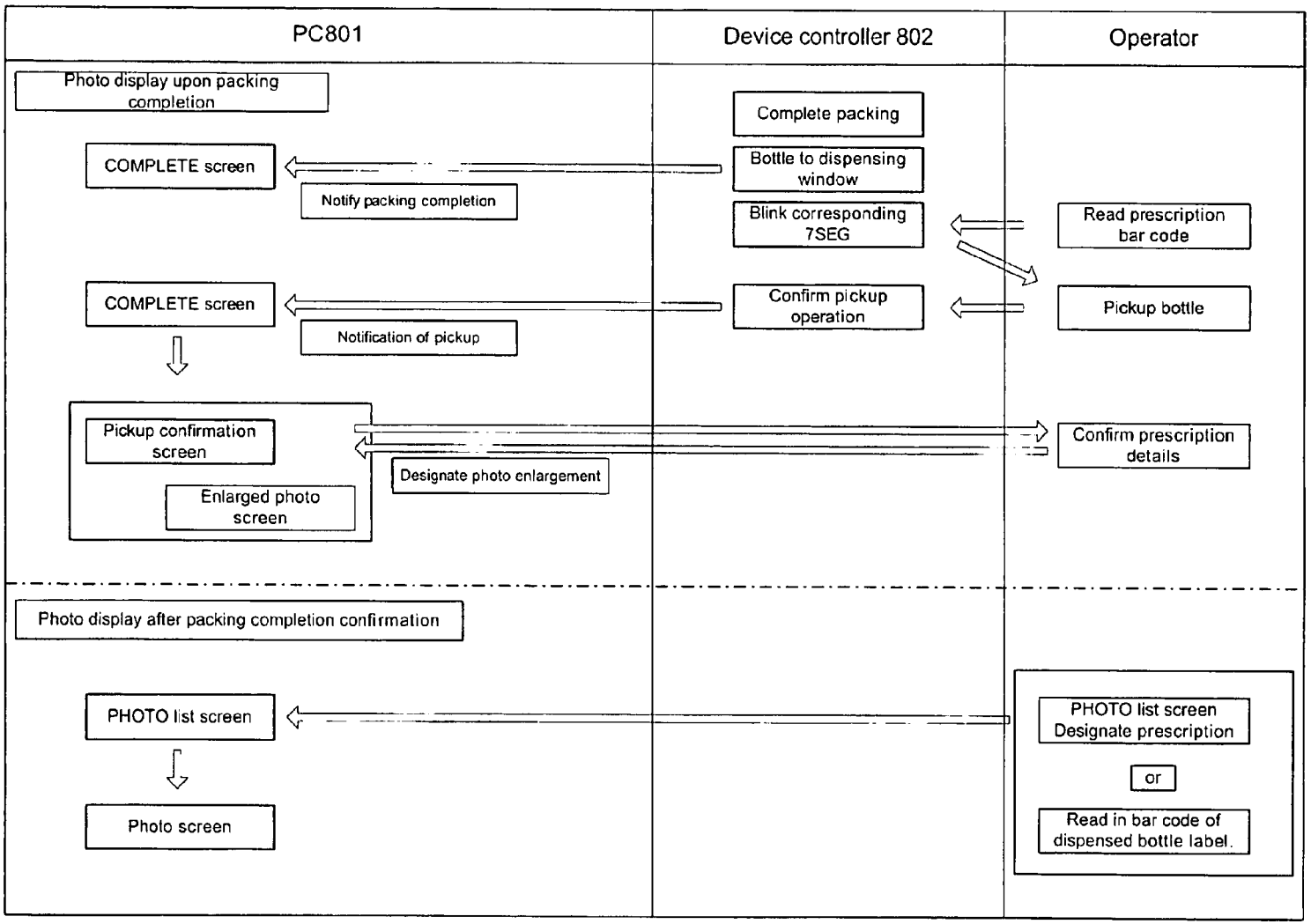

[FIG.41A]
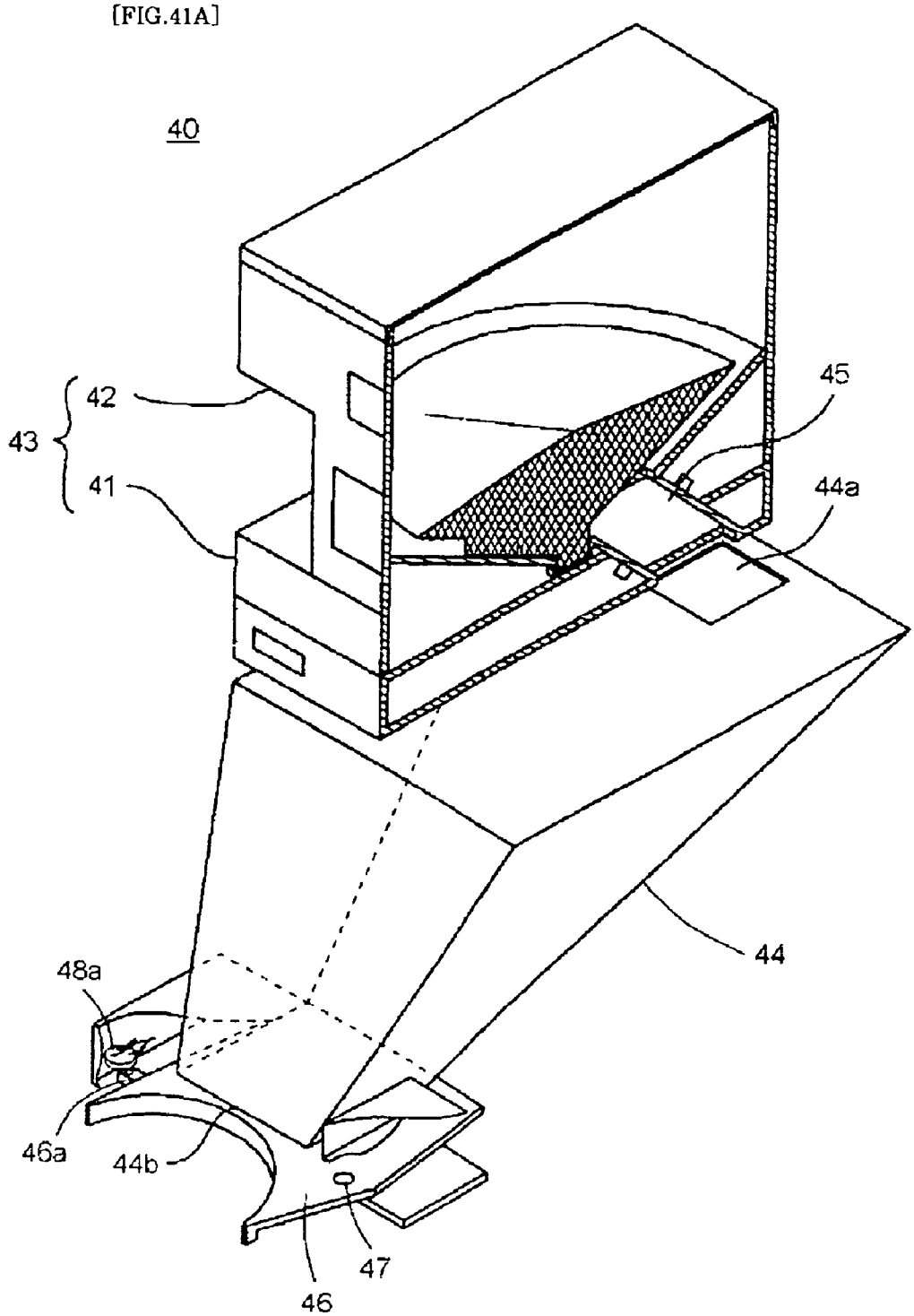

[FIG.41B]
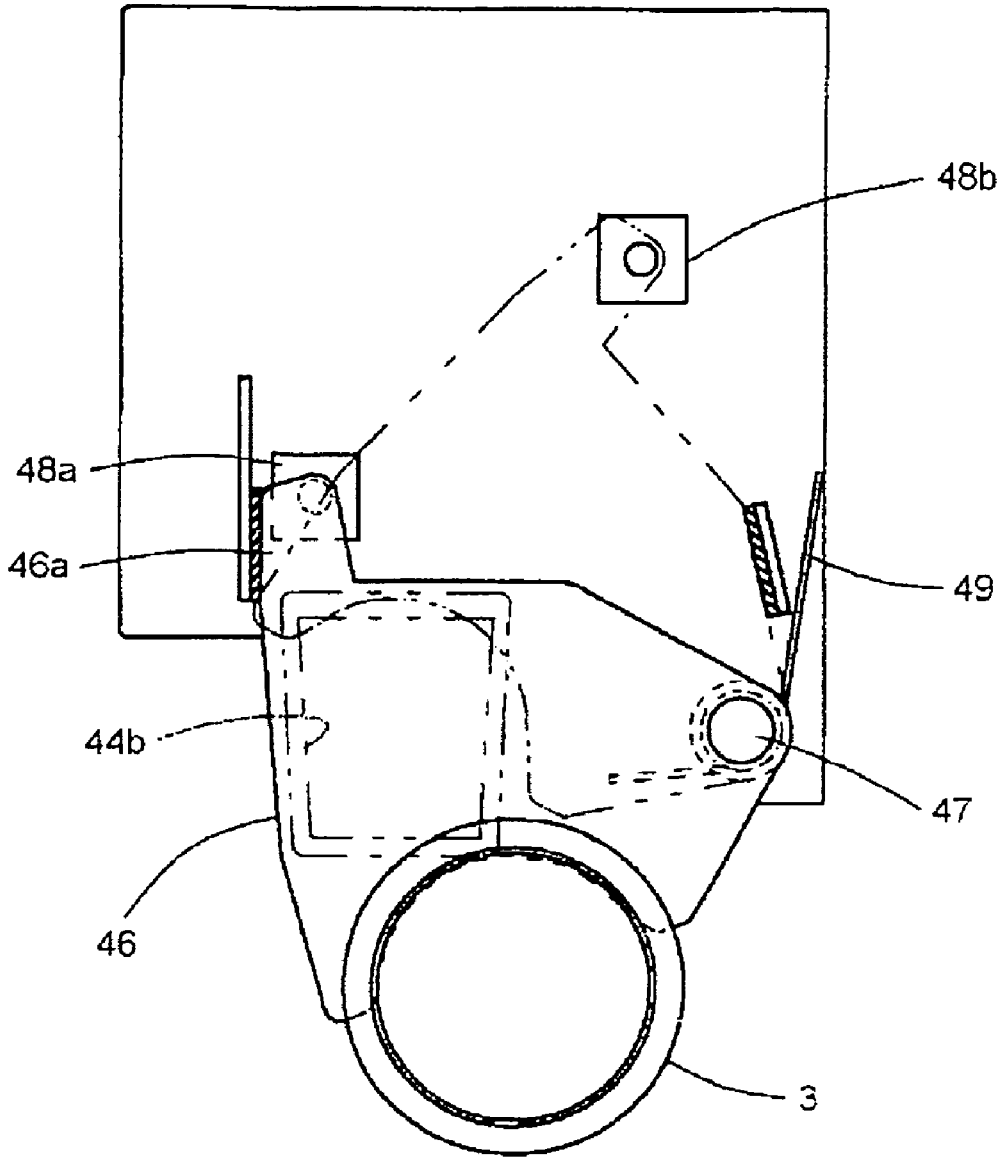

[FIG. 42]
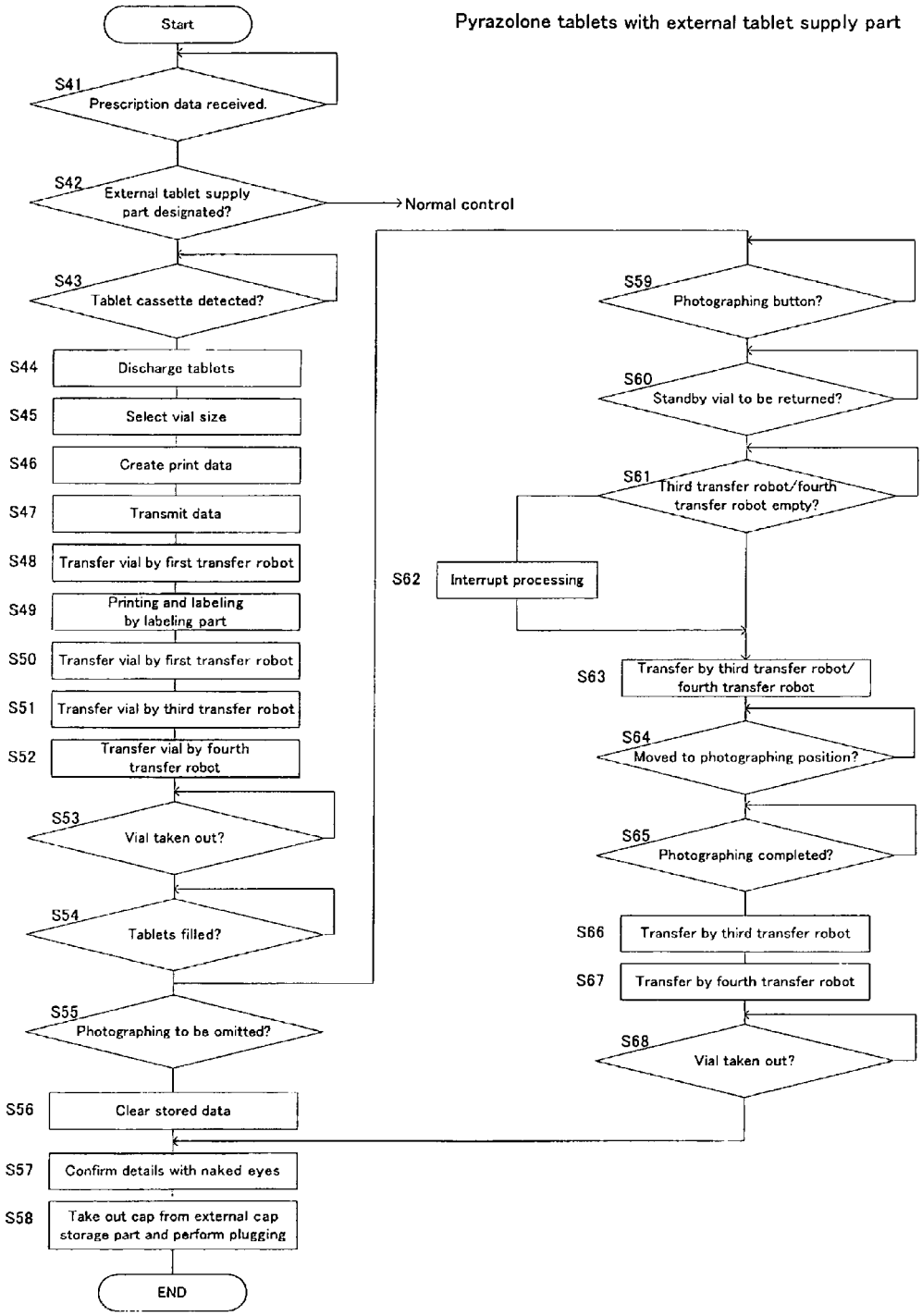

[FIG.43]
0 0 Main menu
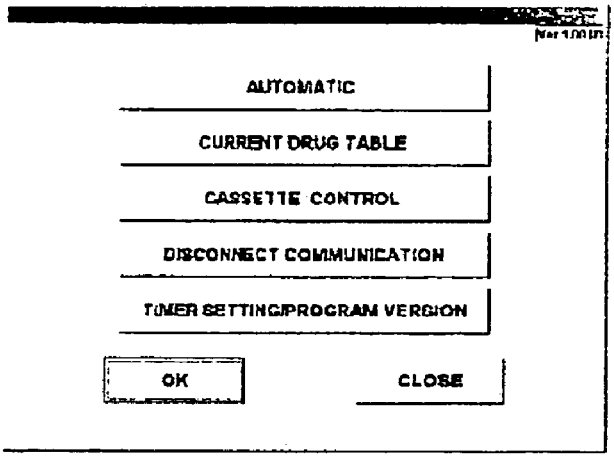
[FIG.44]
1 0 Automatic dispensing screen
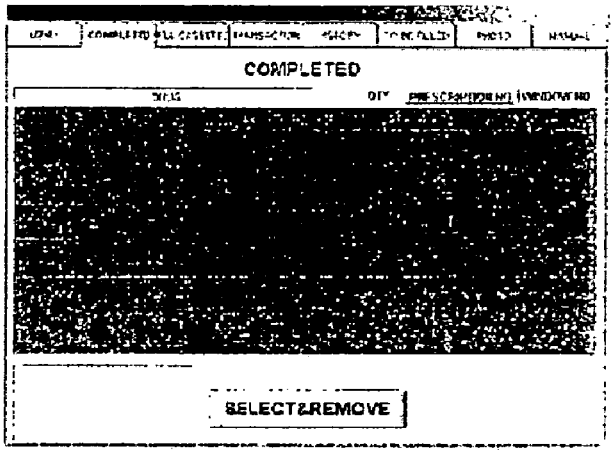
[FIG 45]
1 1 In-process prescription list screen
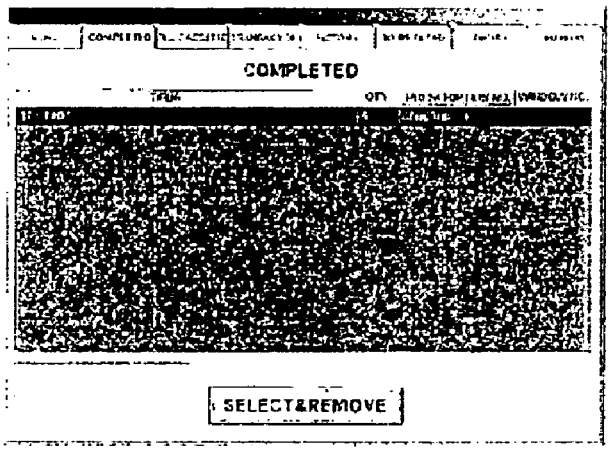

[FIG.46]
1.1.1 Vial take-out error confirmation screen
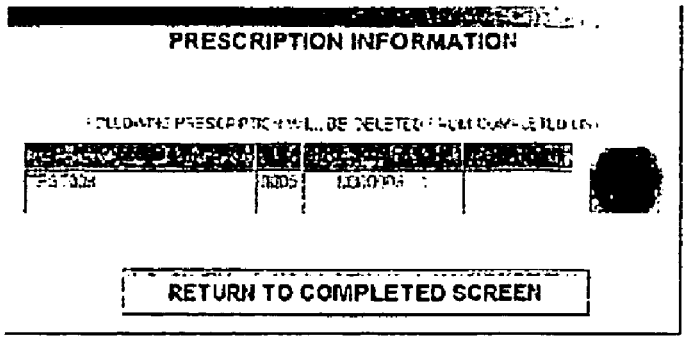
[FIG.47]
1.1.1.1 Vial interior photo display device
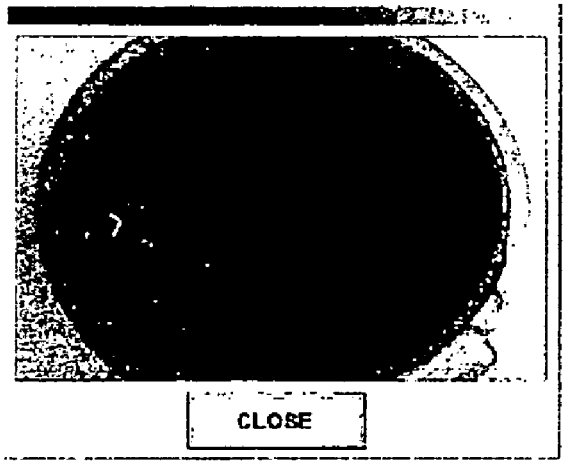
[FIG.48]
1.2 Drug filling cassette specification screen
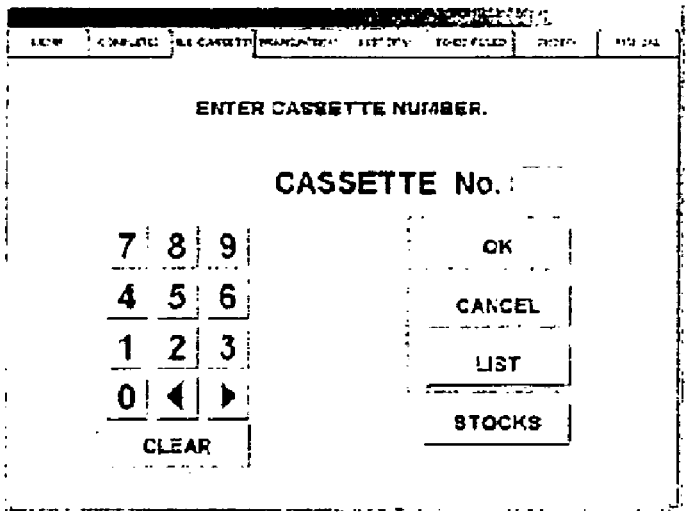

[FIG 49]
1.2.1a New drug registration screen
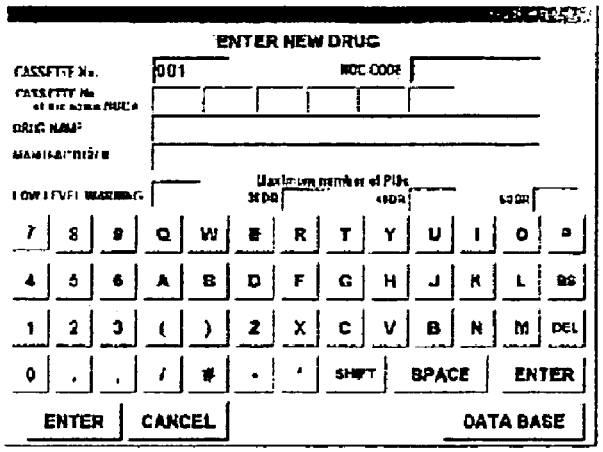
[FIG.50]
1.2.1a Drug list display screen
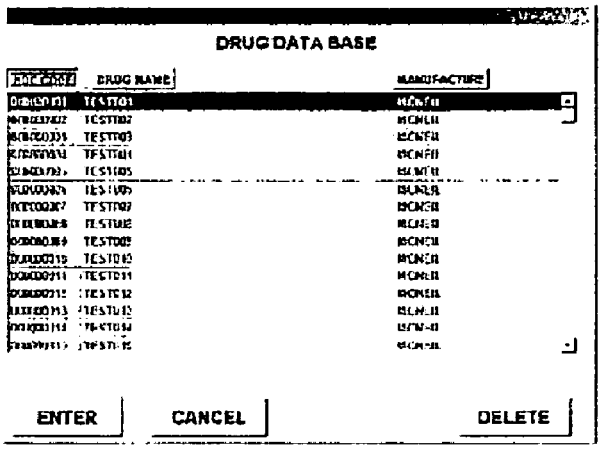
[FIG 51]
1.2.1a.1.1 NDC master drug delete screen
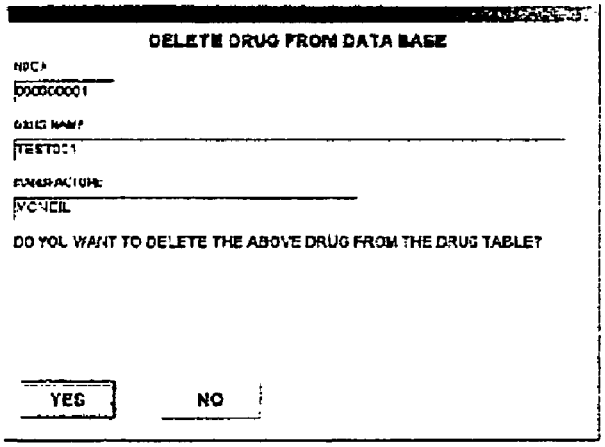

[FIG.52]
1.2.1b NDC code check screen
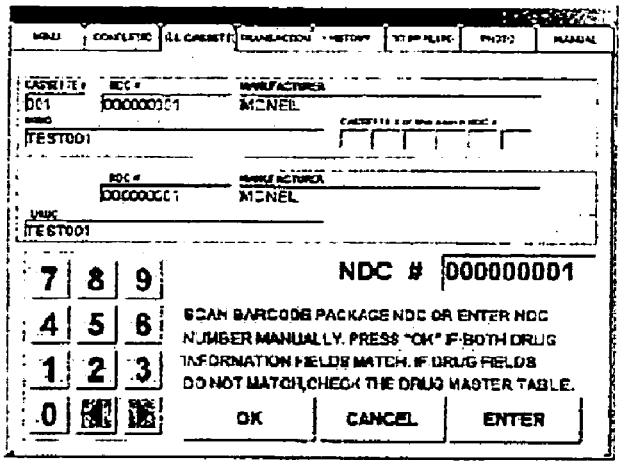
[FIG.53]
1.2.1b.1 Tablet filling screen
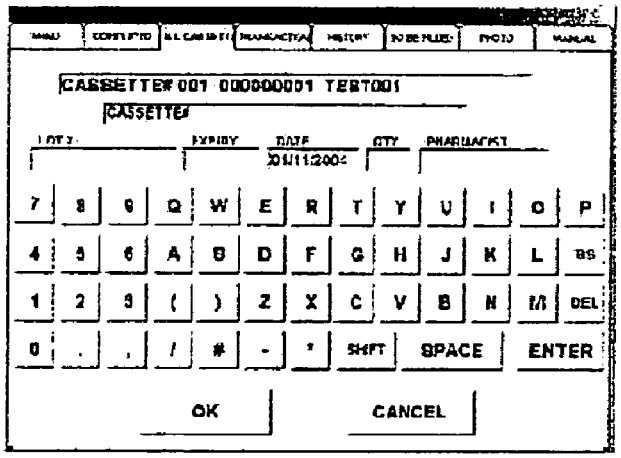
[FIG.54]
1.2.1b.1.1 Filling confirmation screen
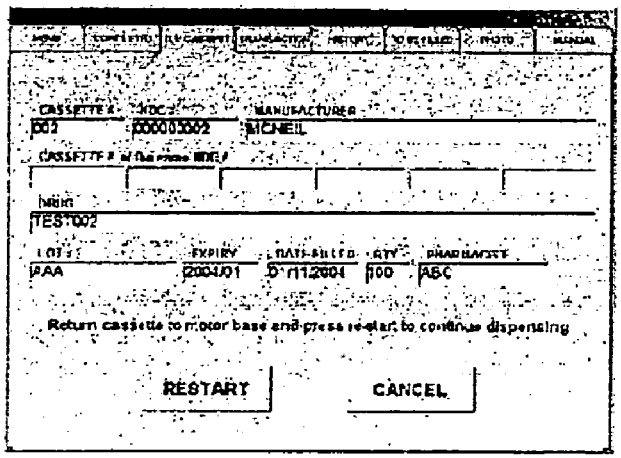

[FIG.55]
1.2.2 Cassette list screen
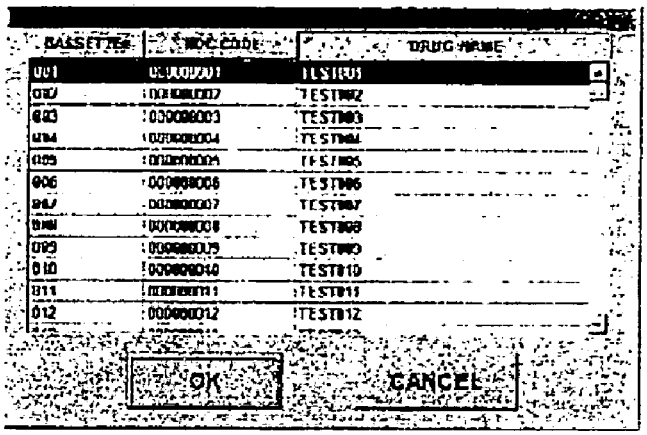
[FIG.56]
1.2.3 Cassette-by-cassette tablet inventory list screen
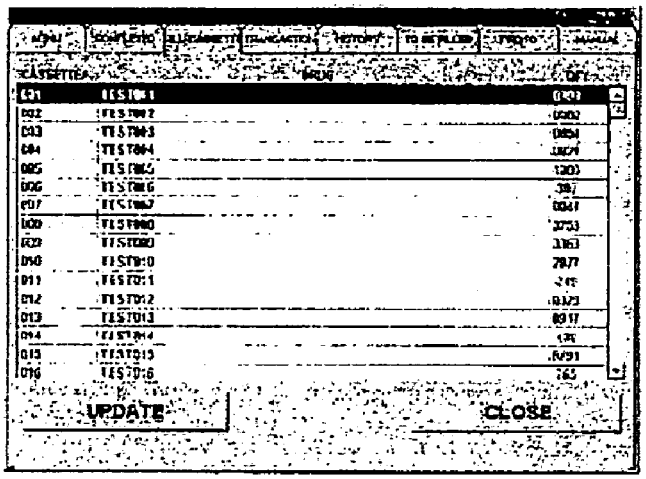
[FIG.57]
1.2.3.1 Tablet inventory change screen
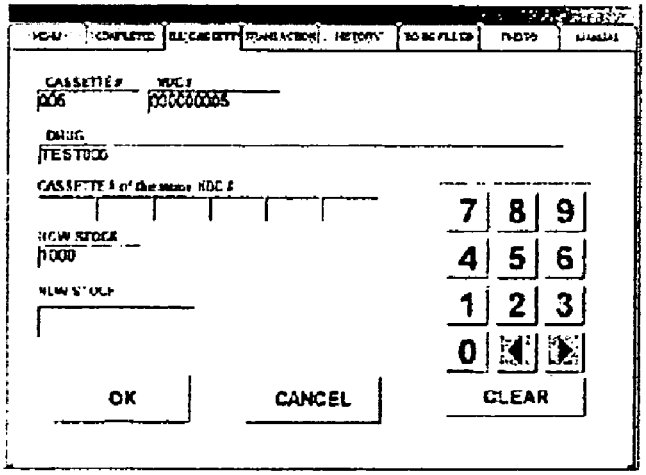

[FIG 58]
1.3 Processed prescription list screen
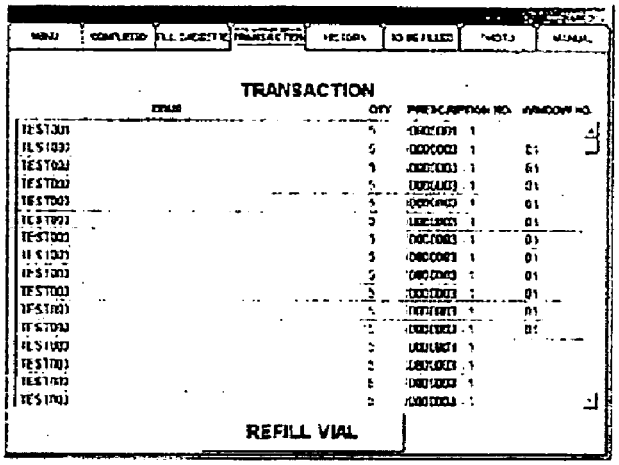
[FIG.59]
1.4 Filling history drug selection screen
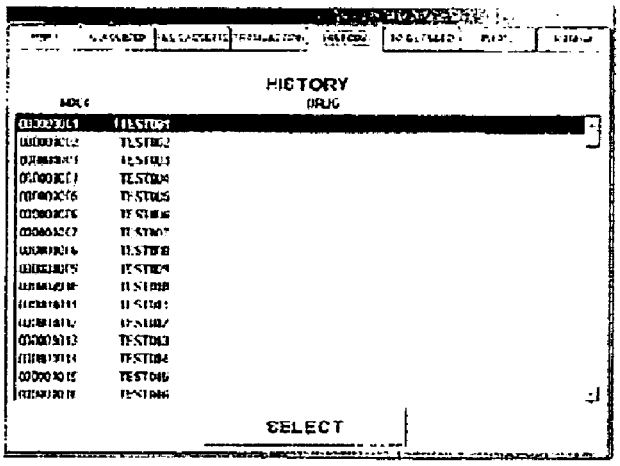
[FIG.60]
1.4.1 Filling history display screen
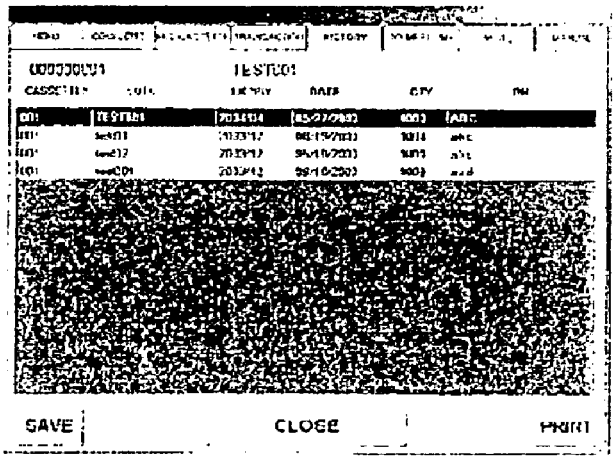

[FIG.61]
1.5 Dispensing machine not yet transmitted prescription list screen
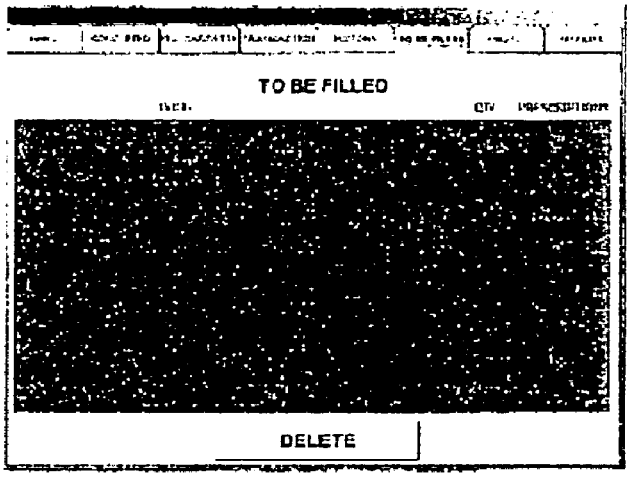
[FIG.62]
1.6 Dispensed vial photo list screen
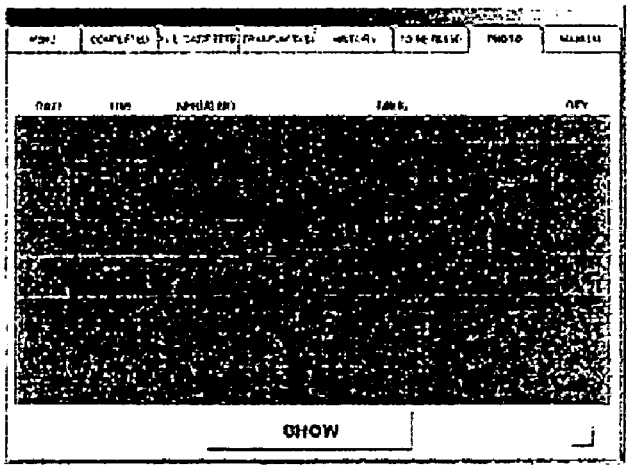
[FIG.63]
1.6.1 Photo display screen
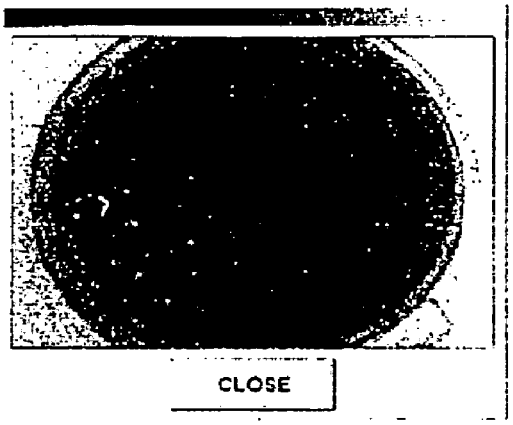

[FIG 64]
1 7 Manual dispensing cassette designation screen
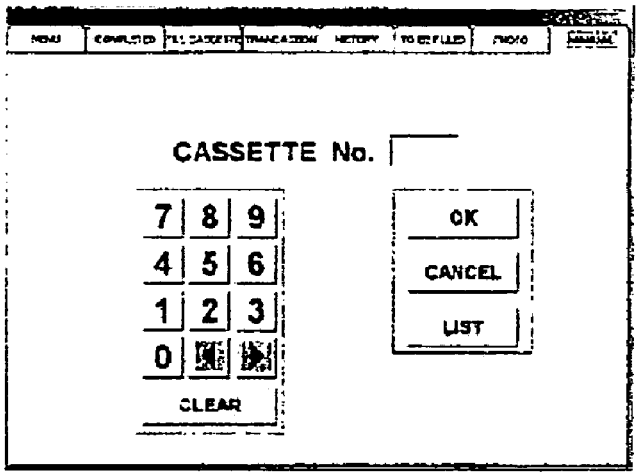
[FIG 65]
1 7.1 Manual dispensed tablet quantity designation screen
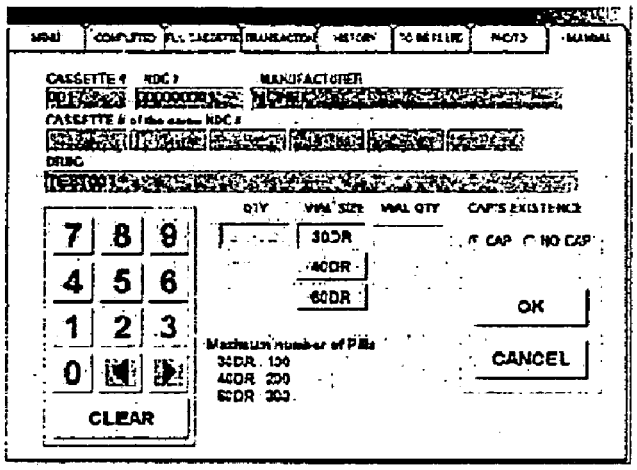
[FIG.66]
1 7 2 Cassette list screen
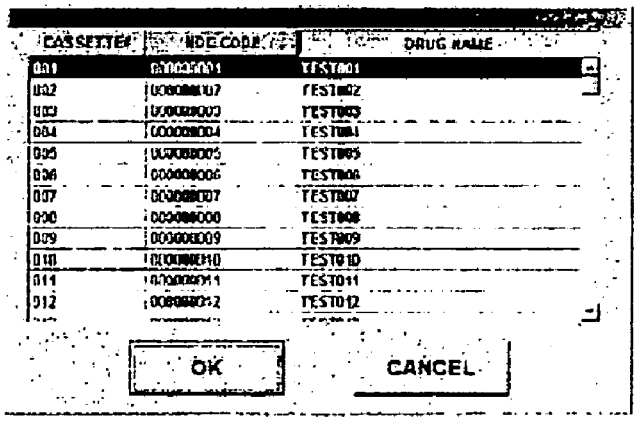

[FIG 67]
2.0 Drug table list screen
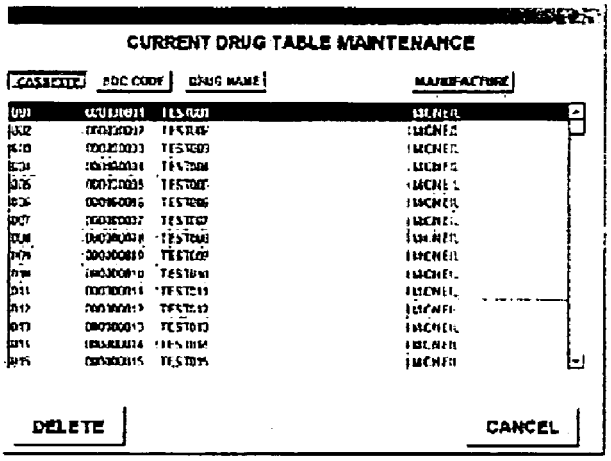
[FIG 68]
2.1 Deleted drug confirmation screen
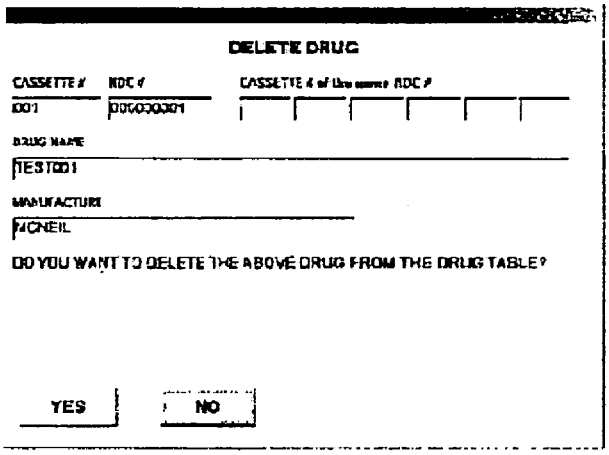
[FIG 69]
3.0 Tablet cassette control screen
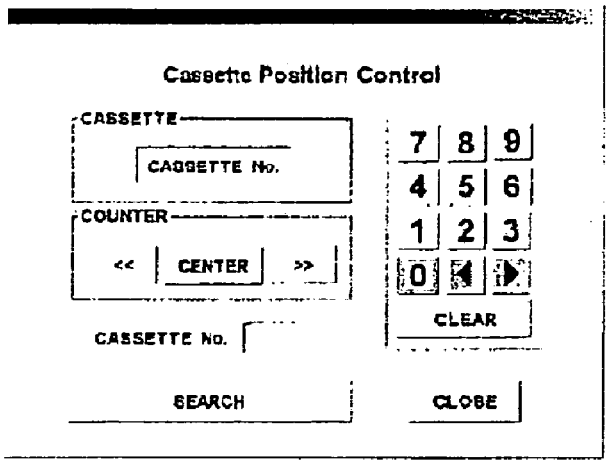

[FIG 70]
60 Host disconnection screen
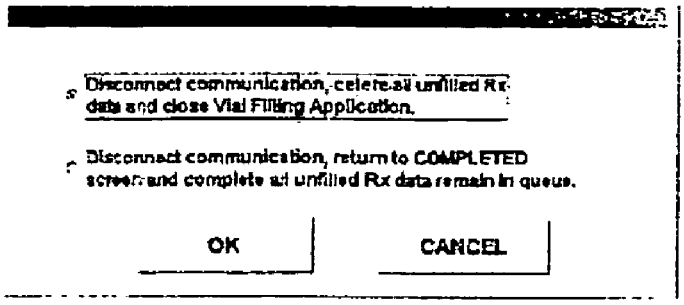
[FIG.71]
61 Date update time setting screen
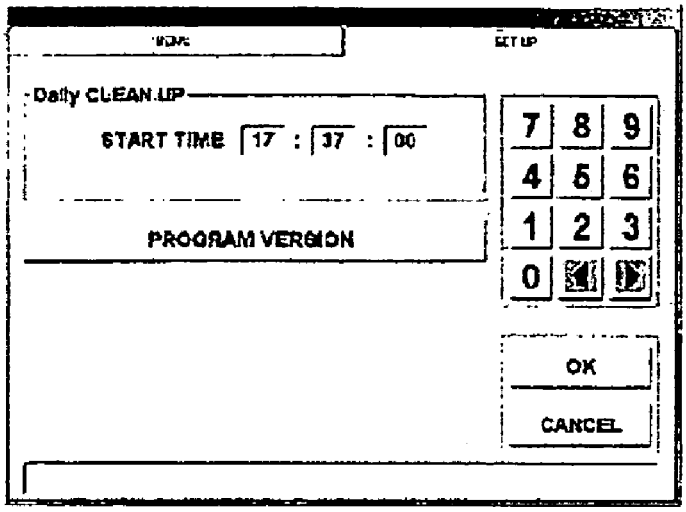
[FIG.72]
61 Program version information display screen
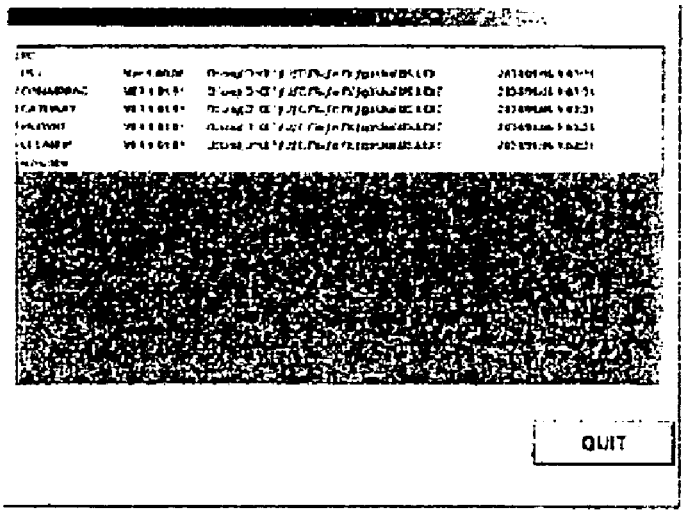

DEVICE FOR CONTAINING AND DISPENSING TABLETS

BACKGROUND OF THE INVENTION

1. Technical Field of the Invention The present invention relates to a tablet storage and take-out apparatus which stores various kinds of tablets and which fills a vial with tablets in accordance with prescription data so that the vial can be taken out.

2. Description of Related Art

As a conventional apparatus for filling a vial with tablets, Japanese Patent Application Laid-open No. H10-33636 discloses a drug filler, which has double inner and outer drums whose outer surfaces are fitted with many tablet feeders, guides tablets discharged from these tablet feeders inside the inner and outer drums, introduces the tablets through a drop guide path to a hopper provided below the inner and outer drums, and then fills the tablets into vials supplied from a vial supply part. Japanese Patent Application Laid-open No. H11-70901 discloses a tablet filling apparatus, which has a vertical wall whose surface is fitted with many tablet feeders, drops, through a drop guide path, tablets discharged from these tablet feeders into a transfer container, and transfers the transfer container to a filling part, and, on the other hand, fills the tablets contained in the transfer container into a vial transferred from a vial supply part to the filling part.

With the apparatus disclosed in JP H10-33636, since a shutter above the hopper or the transfer container is closed while tablets are being discharged to the hopper or the transfer container, tablets for the next prescription can be discharged, but tablets for the further next prescription cannot be discharged.

Moreover, JP H10-33636, a large-size hopper needs to be provided below the inner and outer drums in order to receive tablets dropped from all the tablet feeders, leading to upsizing of the apparatus accordingly. The apparatus disclosed in JP H11-70901 also requires a tablet container for receiving tablets discharged from the tablets feeders and a belt conveyor for transferring the tablet container, thus resulting in upsizing of the apparatus.

SUMMARY OF THE INVENTION

Problem to be Solved by the Invention

In view of the problem described above, the present invention has been made, and it is an object of the invention to provide a compact tablet storage and take-out apparatus capable of quickly discharging and filling tablets.

Means for Solving the Problem

To solve the problem described above, the present invention adopts the following means.

1. There are provided: a cylindrical drum which has an axis thereof in a vertical direction and which is so supported as to be rotatable about the axis; drum driving means for driving the drum into rotation; a plurality of tablet cassette mounting bases which are fitted to an outer surface of the drum; a tablet cassette which stores tablets and which is detachably mounted on the tablet cassette mounting base; a guide passage which guides inside the drum tablets discharged from the tablet cassette; a transfer robot which is provided inside the drum so as to be liftable along and also rotatable about the axis, which has a pair of arms for holding a vial, and which transfers the vial held by the arms between a delivery position located outside an opening formed in an upper end or a lower end of the drum and a tablet filling position where the tablets discharged through the guide passage are filled; and control means for controlling a position of at least one of the drum and the transfer robot so that an opening of the vial held by the transfer robot agrees with an outlet of the guide passage.

Here, the cylindrical drum refers to the one which is so formed as to have a wall located at a certain distance from the axis, and, more specifically, is formed by bending a plate material or combining it together with a pulling material into a cylinder as a whole, with one or both ends thereof open. This therefore includes those having an opening in part of the outer circumference thereof. Rotatably supporting the drum includes various structures, such as those directly and rotatably supporting the upper and lower end portions of the drum, those supporting rings or shafts fitted to the upper and lower end portions thereof, those supporting a flange fitted to the outer circumference thereof, and the like. The tablet cassette refers to one which is provided with a rotor or a disk having a groove or a partition for discharging tablets one by one, and it can be provided in any shape with any structure. The guide passage can be provided in any shape and any length. The transfer robot refers to any of those which are liftable along the axis of the drum, thus including those lifting on the axis and those lifting at a position away from the axis but parallel thereto.

<Shutter Mechanism>

2. The guide passage has a storage part which stores tablets discharged from the tablet cassette and which has in a bottom thereof an outlet and a shutter for opening and closing the outlet.

Here, the storage part may be provided inside the guide passage or in a different space that is extended from or connected to the guide passage.

3. The shutter has a detection means for detecting open and close states of the outlet of the storage part, and the control means stops the transfer robot when the detection means detects the open state of the outlet of the storage part.

4. Below the shutter, a guide member is provided which guides the tablets discharged from the storage part to the opening of the vial held by the transfer robot.

Here, the guide member prevents the tablets from diffusing due to the release of the shutter while being filled into the vial, and may be provided in any shape.

5. The guide member is fitted to the arms of the transfer robot.

6. The shutter is forced in such a direction as to constantly close the outlet of the storage part, and the shutter has a contact part which is contacted by the guide member to thereby open the storage part when the transfer robot moves.

Here, the direction in which the guide member makes in contact with the shutter may be any of the radius and circumferential directions of the drum and a direction parallel to the axis of the drum.

<Transfer Robot Mechanism>

7. The transfer robot includes: a frame which has a lifting guide extending along the axis of the drum and whose upper and lower ends are so supported as to be rotatable about the axis of the drum; a base which is liftably fitted to the lifting guide and which has the arms; rotation driving means for driving the frame into rotation about the axis of the drum; lifting driving means for lifting the base; and arm driving means for driving the arms.

Here, the arm includes those which move in the left-right direction and holds the outer circumferential surface or the inner circumferential surface of the vial, those which move in the vertical direction and holds the vial by pinching the opening and the bottom thereof, those which extends or contracts the diameter of its circular holding portion to hold the outer circumferential surface of the vial, and the like.

8. The transfer robot further has: a boom which is fitted to the base so as to be movable back and forth in a horizontal direction; and horizontal driving means for moving the base back and forth in the horizontal direction, and the arms are fitted to a leading end of the boom.

<Oscillation Mechanism>

9. The arms are so provided as to be swingable between a horizontal position where the opening of the vial held by the arms faces straight upward and a tilt position where the opening faces obliquely upward while being tilted at 45 degrees, and the boom has swinging means for swinging the arms.

<Vial Holding Mechanism>

10. The arms are provided with two rollers and two or one rollers on one side and another side of the vial, respectively, each having a shaft extending in a height direction of the vial held so as to support a side surface of the vial at four or three points.

In the case of 4-point support, the line connecting the four points may form either a square or a rectangular. In the case of 3-point support, the line connecting the three points may form either an isosceles triangle or an equilateral triangle.

According to the present invention, even when the arms are at the tilt position, the vial can be reliably held in a tilt state.

11. The arms are provided with two rollers and two or one rollers on one side and another side, respectively, of each of an upper portion and a lower portion of the held vial, each roller having a shaft extending in a height direction of the vial so as to support a side surface of the vial at eight or six points.

According to the present invention, even when the arms are at the tilt position, the vial can be even more reliably held in a tilt state.

<Drum Driving>

12. The drum driving means includes: a motor; a transmission mechanism for transmitting a driving force of the motor to the drum; and moving means for moving the transmission mechanism between a transmission position where the driving force is transmitted from the motor to the drum and a blocking position where the driving force from the motor to the drum is blocked.

Here, the transmission mechanism refers to but not limited to a gear, belt, or the like. The moving means refers to those which can move the transmission mechanism with a lever, a link, a handle, or the like between the transmission position and the blocking position. This moving means may be provided in any shape with any structure, and its moving operation may be achieved either manually or electrically. Note that the moving means may be provided with means for fixedly holding the transmission mechanism at the transmission position.

13. The transmission mechanism further has between the motor and the drum an intermediate transfer mechanism, which is moved by the moving means between the transmission position and the blocking position.

Here, the intermediate transmission mechanism refers to but not limited to a gear, a belt, or the like.

14. The moving means includes a lever which can be manually operated from outside.

<Origin Detection>

15. There are provided origin detection means for detecting an origin of the drum in a rotation direction thereof, and origin search means for searching an origin of the drum by rotating the drum by the drum driving means until the origin detection means detects the origin of the drum.

Here, the origin in the rotation direction of the drum serves as a reference for identifying the rotation angle of the drum, i.e., the position of the tablet cassette, and it includes a projection, a mark, or the like and may be provided in any physical shape with any structure as long as it can be detected by the origin detection means. The kind of the origin detection means is not limited.

According to the present invention, even when the transmission mechanism of the drum driving means is at the blocking position and thus the origin point for the free rotation of the drum is lost, the origin can be easily searched by the origin search means.

16. The origin detection means includes a first sensor and a second sensor which are adjacent each other, and which, when the first sensor first detects an origin, a position thereof is a left rotation limit, and when the second sensor first detects an origin, a position thereof is a left rotation limit.

Here, the kinds of the first and second sensors are not limited. The right and left rotation limits refer to the limited position for the drum rotation over a range between 0 and 360 degrees or a range between the 0 degrees and 400 degrees. Moreover, these sensors may be of a type that detects the rotation direction and origin of the drum or of a type that detects closeness between the drum rotation direction and the origin.

17. The origin detection sensor has a third sensor between the first sensor and the second sensor, and the drum driving means stops the drum when either the first sensor or the second sensor detects an origin and then the third sensor detects an origin.

18. Drum rotation position detection means for detecting a rotation position of the drum from the origin is provided, and, when the origin of the drum is detected by the origin detection means, the rotation position detected by the drum rotation position detection means is reset.

Here, the drum rotation position detection means includes, for example, a rotary encoder, those which directly detect the rotation position of the drum by connecting to a drum and its driving means and those which indirectly detect the rotation position of the drum by counting concavity and convexity or the like of the drum and its driving means.

<Drum Opening Mechanism>

19. The drum includes: at least two body members each having a circular-arc cross section; and rotary support rings fitted to an upper end and a lower end of the body members, and at least one of the body members has the upper end and the lower end thereof rotatably fitted to the rotary support rings so as to be capable of opening and closing the inside of the drum and also has a holding member for holding a closed state.

Here, the rotary support ring refers to a member for rotatably supporting the drum. The body member with a circular-arc cross section includes those which have a cross section in a shape of a half circle, an arc smaller than 180 degrees, and an arc larger than 180 degrees. Moreover the body member with a circular-arc cross section may be formed with a curved surface but also may be formed with flat surfaces so provided in series as to form a circular arc as a whole. Furthermore, the body member on the open side may be formed into an arc close to a flat surface or a completely flat surface. The number of body members with a circular-arc cross section is not limited to two, and thus may be three or four.

<Transfer Robot>

20. There are provided a tablet supply part including:

a cylindrical drum which has an axis thereof in a vertical direction and which is so supported as to be rotatable about the axis; drum driving means for driving the drum into rotation; a plurality of tablet cassette mounting bases which are fitted to an outer surface of the drum; a tablet cassette which is detachably mounted on the tablet cassette mounting base; and a guide passage which guides inside the drum tablets discharged from the tablet cassette, and supplying tablets in accordance with prescription;

a vial supply part which stores a large number of vials by size and which supplies, one by one, the vials of a size suitable to be filled with tablets in accordance with prescription data;

a cap supply part which stores caps for plugging the vials and which supplies the caps one by one;

a capping part which plugs the cap supplied from the cap supply part in the vial filled with the tablets;

a storage part which stores the vial filled with the tablets and plugged with the cap so that the vial can be taken out by an operator;

a first transfer robot which holds and transfers the vial taken out from the vial storage take-out part;

a second transfer robot which has a pair of arms for holding the vial, which is provided inside the drum so as to be liftable along and rotatable about the axis of the drum, and which holds and transfers the vial;

a third transfer robot which delivers an empty vial transferred from the first transfer robot to the second transfer robot and also which delivers the vial filed with the tablets and transferred by the second transfer robot to the vial closing part;

and a fourth transfer robot which transfers the vial transferred by the third transfer robot to the storage part.

21. When the tablet supply apparatus has no tablets corresponding to prescription data, the first transfer robot delivers the vial to the third transfer robot without delivering the vial to the second transfer robot and the third transfer robot delivers the vial to the fourth transfer robot without delivering the vial to the capping part.

22. A photographing part is further provided which photographs from above the vial filled with the tablets for audit of the vial, and the third vial transfer arm transfers the vial filled with the tablets and transferred by the second vial transfer arm to the tablet photographing part and then delivers the vial to the vial closing part.

23. A labeling part is further provided which puts a label with prescription information printed thereon on the vial supplied from the vial supply part, and the first transfer robot transfers the vial to the labeling part and delivers the vial provided with the label to the second transfer robot.

<Dual Drum>

24. There are provided a cylindrical first drum which has an axis thereof in a vertical direction, which is so supported as to be rotatable about the axis, and which has a first opening in a part thereof;

first drum driving means for driving the first drum into rotation;

a cylindrical second drum which is arranged to an outer side of the first drum, which is coaxial with the axis of the first drum, which is so supported as to be rotatable about the axis, and which has a second opening in a part thereof;

second drum driving means for driving the second drum into rotation;

a plurality of tablet cassette mounting bases which are fitted to an outer surface of each of the first and second drums;

tablet cassettes which are detachably mounted on the tablet cassette mounting bases of the first and second drums;

a guide passage which guides inside the first and second drums tablets discharged from the tablet cassettes;

a transfer robot which is provided inside the first drum so as to be liftable along the axis and also rotatable about the axis, which has a pair of arms for holding a vial, and which transfers the vial held by the arms between a delivery position located outside an opening in an upper end or a lower end of the first and seconds drums and a tablet filling position where the tablets discharged through the guide passages of the first drum and the second drum are filled;

and control means for controlling a position of at least one of the first drum, the second drum, and the transfer robot so that an opening of the vial held by the transfer robot agrees with an outlet of the guide passage.

Here, the opening of the first drum may be formed across the upper and lower ends of the first drum, and it may also be formed in a range where the tablet cassette mounting bases of the second drum are provided. Similarly, the opening of the second drum may be formed across the upper and lower ends of the second drum, and it may also be formed in a range where the tablet cassettes and the tablet cassette mounting bases of the first drum are provided.

25. The opening of the first drum is provided at a plurality of positions in a circumferential direction.

26. There are provided a cylindrical first drum which has an axis thereof in a vertical direction, which is so supported as to be rotatable about the axis, and which has a first opening in a part thereof first drum driving means for driving the first drum into rotation;

a cylindrical second drum which is arranged to an outer side of the first drum, which is coaxial with the axis of the first drum, which is so supported as to be rotatable about the axis, and which has a second opening in a part thereof;

second drum driving means for driving the second drum into rotation;

a plurality of tablet cassette mounting bases which are fitted to an outer surface of each of the first and second drums;

tablet cassettes which are detachably mounted on the tablet cassette mounting bases of the first and second drums;

a guide passage which guides inside the first and second drums tablets discharged from the tablet cassettes;

a main transfer robot which is provided in the first opening of the first drum so as to be liftable along an axial line parallel to axis of the first drum and also rotatable about the axial line, which has a pair of arms for holding a vial, and which transfers the vial held by the arms between a delivery position located outside an opening in an upper end or a lower end of the first and seconds drums and a tablet filling position where the tablets discharged through the guide passages of the first drum and the second drum are filled;

a sub-transfer robot which is provided in the first opening of the first drum so as to be liftable along an axial line parallel to the axis of the first drum and also rotatable about the axial line, which has a pair of arms for holding a vial, and which transfers the vial held by the arms between a delivery position where the vial held by the arm is delivered to the main transfer robot and a tablet filling position where the tablets discharged through the guide passage of the second drum are filled;

and control means for controlling a position of at least one of the drum and the transfer robot so that an opening of the vial held by the transfer robot agrees with an outlet of the guide passage.

EFFECT OF THE INVENTION

According to the present invention, a transfer robot for vials is located on the inner side of a drum, which no longer requires a space on the outer side of the drum for transferring the vials, thus achieving downsizing of the apparatus. In other words, a larger drum can be provided with a large number of tablet cassettes arranged in high density, thus increasing the types of tablets and the storage capacity.

BRIEF DESCRIPTION OF THE DRAWINGS

FIG. 1 is an elevation view of a tablet storage and take-out apparatus according to the present invention;

FIG. 2 is an elevation view of the interior of the tablet storage and take-out apparatus of FIG. 1;

FIG. 3 is a cross section taken on line III-III of FIG. 2;

FIG. 4 is a cross section taken on line IV-IV of FIG. 2;

FIG. 5 is a cross section taken on line V-V of FIG. 2;

FIG. 6 is a block diagram of control performed by a control part;

FIG. 7 is a vertical cross section of a drum;

FIG. 8 is a plan view of the drum;

FIG. 9 is a plan view of the drum in an open state;

FIG. 10 is a transverse cross section of the bottom portion of the drum;

FIG. 11A is a side view of a drum driving unit, FIG. 11B is a front view thereof, and FIG. 11C is a plan view thereof;

FIG. 12 is a perspective view of a tablet feeder;

FIG. 13 is a side view of a tablet storage case of the tablet feeder;

FIG. 14 is a plan view of the tablet case;

FIGS. 15A to 15C are plan views showing an example of an overrun mechanism of the drum;

FIG. 16 is an enlarged elevation view of a slide member of FIG. 15;

FIG. 17 is a plan view showing another example of the overrun mechanism of the drum;

FIG. 18 is an elevation view of a second transfer robot.

FIG. 19 is a right side view of FIG. 18;

FIGS. 20A and 20B are elevation views of a lifting block provided in the second transfer robot of FIG. 18;

FIG. 21 is a plan view of FIG. 20;

FIG. 22 is an enlarged right side view of FIG. 20;

FIG. 23 is an enlarged plan view of an arm of FIG. 20;

FIG. 24 is a flowchart diagram showing the operation of the second transfer robot 250;

FIG. 25 is a flowchart diagram of tablet filling position control achieved through mutual control;

FIG. 26 is a flowchart diagram of tablet filling position control achieved through drum control;

FIG. 27 is a flowchart diagram of tablet filling position control achieved through robot arm control;

FIG. 28 is a plan view showing a first modified embodiment of the drum (double drum);

FIG. 29 is a plan view showing a second modified embodiment of the drum (double drum);

FIG. 30 is a plan view showing a third modified embodiment of the drum (double drum);

FIGS. 31A to 31C are plan views showing the operation performed by an auxiliary transfer robot of FIG. 30;

FIG. 32 is a flowchart diagram of drug filling position control performed by the double drums;

FIG. 33 is a flowchart diagram of drug filling position control performed by the auxiliary transfer robot;

FIG. 34 is a flowchart diagram showing operation performed by a third transfer robot;

FIG. 35 is a flowchart diagram showing operation performed by a third transfer robot;

FIG. 36 is a flowchart diagram showing operation performed by a third transfer robot;

FIG. 37 is a flowchart diagram showing photographing initialization operation;

FIG. 38 is a flowchart diagram showing photographing control operation;

FIG. 39 shows a flow diagram of operation performed among a photographing part, PC, and a device controller;

FIG. 40 shows a flow diagram of operation performed among PC, the device controller, and an operator;

FIG. 41A is a partially cutaway perspective view of an external tablet supply part;

FIG. 41B is a plan view of a shutter;

FIG. 42 is a flowchart diagram showing tablet take-out control performed by an external tablet supply part;

FIG. 43 is a view showing Main menu screen 0.0;

FIG. 44 is a view showing Automatic dispensing screen 1.0;

FIG. 45 is a view showing In-process prescription list screen 1.1;

FIG. 46 is a view showing Vial take-out error confirmation screen 1.1.1;

FIG. 47 is a view showing Vial interior photo display screen 1.1.1.1;

FIG. 48 is a view showing Drug filling cassette specification screen 1.2;

FIG. 49 is a view showing New drug registration screen 1.2.1*a;*

FIG. 50 is a view showing Drug list display screen 1.2.1*a*.1;

FIG. 51 is a view showing NDC master drug delete screen 1.2.1*a*.1.1;

FIG. 52 is a view showing NDC code check screen 1.2.1*b;*

FIG. 53 is a view showing Tablet filling screen 1.2.1*b*.1;

FIG. 54 is a view showing Filling confirmation screen 1.2.1*b*.1.1;

FIG. 55 is a view showing Cassette list screen 1.2.2;

FIG. 56 is a view showing Cassette-by-cassette tablet inventory list screen 1.2.3;

FIG. 57 is a view showing Tablet inventory change screen 1.2.3.1;

FIG. 58 is a view showing Processed prescription list screen 1.3;

FIG. 59 is a view showing Filling history drug selection screen 1.4;

FIG. 60 is a view showing Filling history display screen 1.4.1;

FIG. 61 is a view showing Dispensing machine not-yet-transmitted prescription list screen 1.5;

FIG. 62 is a view showing Dispensed vial photo list screen 1.6;

FIG. 63 is a view showing Photo display screen 1.6.1;

FIG. 64 is a view showing Manual dispensing cassette designation screen 1.7;

FIG. 65 is a view showing Manual dispensed tablet quantity designation screen 1.7.1;

FIG. 66 is a view showing Cassette list screen 1.7.2;

FIG. 67 is a view showing Drug table list screen 2.0;

FIG. 68 is a view showing Deleted drug confirmation screen 2.1;

FIG. 69 is a view showing Tablet cassette control screen 3.0;

FIG. 70 is a view showing Host disconnection screen 4.0;

FIG. 71 is a view showing Program version information display screen 5.1; and FIG. 72 is a view showing Date update time setting screen 5.0.

DETAILED DESCRIPTION OF THE INVENTION

FIG. 1 is an elevation view of a tablet storage and take-out apparatus 1 according to the invention. FIG. 2 is an elevation view of the interior of the tablet storage and take-out apparatus 1. FIG. 3 is a cross section taken on line III-III of FIG. 2. FIG. 4 is a cross section taken on line IV-IV of FIG. 2. FIG. 5 is a cross section taken on line V-V of FIG. 2.

1. Overall Arrangement and Construction

First, a description will be given on the overall arrangement and construction of the tablet storage and take-out apparatus 1. As shown in FIG. 1, at the upper center of a main body 10 as viewed from the front, an operation display panel 20 is provided which provides displays-required for operating the tablet storage and take-out apparatus 1. To the lower right of the operation display panel 20, three vial take-out ports 30*a*, 30*b*, and 30*c* are provided. To the lower left thereof are provided auxiliary tablet supply parts 40 (40*a*, 40*b*), under which an auxiliary cap storage part 50 is provided. The auxiliary tablet supply parts 40 store two different kinds of pyrazolone tablets respectively, and supply tablets in accordance with prescription data. The auxiliary cap storage part 50 randomly stores a large number of caps 2 and permits them to be manually taken out when necessary. At the upper right side of the tablet storage and take-out apparatus 1 as viewed from the front is provided a door 60*a* for replacing a vial 3. At the left side thereof is provided a door 60*b* for replacing and refilling tablets. At the bottom thereof are also provided doors 60*c*, 60*d*, and 60*e* for maintenance.

Inside the tablet storage and take-out apparatus 1, as shown in FIGS. 2, 3, 4, and 5, there are provided: a vial supply part 100, a labeling part 200, a tablet supply part 300, a photographing part 400, a cap supply part 500, a capping part 600, and a storage part 700. The vial supply part 100 is provided on the right side of the main body 10 as viewed from the front, as shown in FIG. 2, and stores a large number of vials 3 by size and supplies, one by one, vials 3 of a size suitable for filling tablets in accordance with prescription data. The labeling part 200 is provided at the lower center of the main body 10 as viewed from the front, and puts a label with printed prescription information on a vial 3 supplied from the vial supply part 100. The tablet supply part 300 is provided on the left side of the main body 10, and stores a large number of tablets (non-pyrazolone) by type and supplies tablets in accordance with prescription data. The photographing part 400 is provided, as shown in FIG. 4, on the center back side of the main body 10, and photographs a vial 3 from above for the purpose of auditing the tablets delivered to the vial 3. The cap supply part 500 is provided, as shown in FIG. 3, on the right side of the main body 10 and behind the vial supply part 100, and stores caps 2 for plugging the vials 3, and supplies the caps one by one. The capping part 600 is provided on the center back side of the main body 10, and plugs a vial 3, which is filled with tablets, with a cap 2 supplied from the cap supply part 500. The storage part 700, as shown in FIG. 5, stores vials 3 filled with tablets and plugged with a cap 2 so that they can be taken out by an operator through take-out ports 30*a*, 30*b*, and 30*c*.

The tablet storage and take-out apparatus 1 is further provided, as shown in FIG. 2, with a first transfer robot 150, a second transfer robot 250, a third transfer robot 350, and a fourth transfer robot 450. The first transfer robot 150 is provided below the vial supply part 100, and can hold a vial 3 supplied from the vial supply part 100, transfer it leftward from the vial supply part 100 to the labeling part 200 in the horizontal direction of the main body, and transfer it upward from the labeling part 200 to the second transfer robot 250 or the third transfer robot 350. The second transfer robot 250 is provided inside the tablet supply part 300, and can hold a vial 3 delivered from the first transfer robot 150, transfer it to supply ports of the tablet supply part 300, and transfer it from the supply ports to the third transfer robot 350. The third transfer robot 350 is provided above the first transfer robot 150 in the main body 10, and can deliver, between the capping part 600 and the fourth transfer robot 450, a vial 3 delivered from the first transfer robot 150 or the second transfer robot 250. The fourth transfer robot 450 is provided above the third transfer robot 350, and can transfer a vial 3 delivered from the third transfer robot 350 upward to the storage part 700.

In the tablet storage and take-out apparatus 1, as shown in FIG. 4, a control part 800 is provided on the right side of the main body 10. The control part 800 is shown in FIG. 6 and composed of: a personal computer (PC) 801 in which apparatus control applications are installed; and a device controller 802 composed of a micro computer and the like. The PC 801 is connected to a host computer 900 installed in a hospital or a drug store, and receives inputted data such as prescription data and the like. The PC 801 is also connected to the operation display panel 20, and outputs display information required for the operation of the tablet storage and take-out apparatus 1 and also receives operation information inputted through the touch panel on the operation display panel 20. Furthermore, the PC 801 is connected to a digital camera provided in the photographing part 400. The device controller 802 is connected to sensors and driving devices of the vial supply part 100, the labeling part 200, the tablet supply part 300, the cap supply part 500, the capping part 600, and the storage part 700 so as to drive and control these parts. Moreover, the device controller 802 is connected to sensors and driving devices of the first transfer robot 150, the second transfer robot 250, the third transfer robot 350, and the fourth transfer robot 450 so as to drive and control these parts.

Hereinafter, a detailed description will be given on the tablet supply part 300, the second transfer robot 250, the third transfer robot 350, and the photographing part 400 of the tablet storage and take-out apparatus 1 provided with the overall arrangement and construction as described above. The other parts are not related to the present invention, and thus are omitted from the description.

2. Tablet supply part 300

The tablet supply part 300 is composed of a drum 301 and tablet feeders 340.

2.1 Drum

FIGS. 7 to 10 show the structure of the drum 301. The drum 301 is composed of a fixed half drum 301*a* and a movable half drum 301*b*. The fixed half drum 301*a* and the movable half drum 301*b* are each formed by bending a metal plate material, such as stainless steel, into a polyhedral half-cylinder (half-cylindrical polyhedron). The fixed half drum 301*a* and the movable half drum 301*b* are combined together into a cylinder which is then arranged with its axis oriented vertically.

To the upper end of the fixed half drum 301*a*, a half top panel 302*a* is fixed which has a substantially fan-like shape as shown in FIG. 9. On the half top panel 302*a*, an upper ring 304 is fitted with three spacers 303 in between as shown in FIG. 8. In a space facing the inner circumference of the upper ring 304 is integrally provided a stay 304*a* for fitting the second transfer robot 250. To the outer circumference of the upper ring 304, a plurality of support rollers 305 are fitted which are respectively placed in a rollable manner on the upper surface of an upper support member 306 provided in the main body 10. The outer circumferential end surface of the upper ring 304 is guided by guide rollers 307 fitted to the upper support member 306. As shown in FIG. 7, to the lower end of the fixed half drum 301*a* is fixed a half ring 308*a*, below which a lower ring 309 is fitted. On the outer circumferential end surface of the lower ring 309, a gear 310 is formed. The bottom surface of the lower ring 309 is supported by a plurality of support rollers 312 that are fitted to a lower support member 311 provided in the main body 10. The outer circumferential end surface of the lower ring 309 is guided by a plurality of guide rollers 313 fitted to the lower support member 311.

To the upper end of the movable half drum 301*b*, a half top panel 302*b* is provided which has a substantially fan-like shape as shown in FIG. 9, and to the lower end thereof, a half ring 308*b* is fixed as shown in FIG. 10. Spindles 314 provided at the top and bottom ends of one circumferential end portion of the movable half drum 301*b* are, as shown in FIGS. 8 and 9, rotatably fitted to one ends of links 316 whose the other ends are rotatably fitted with spindles 315 in between to the upper ring 304 and the lower ring 309, respectively. This permits the movable half drum 301*b* to be rotatable between a working position, where the movable half drum 301*b* faces the fixed half drum 301*a* so as to be formed together into a cylinder, and an open position as shown in FIG. 9, where the movable half drum 301*b* separates from the fixed half drum 301*a* thereby opening the inside of the drum 301. The other circumferential end of the movable half drum 301*b* is disengageably coupled to a circumferential end portion of the fixed half drum 301*a*. The link 316 moves when the fixed half drum 301*a* is opened from the working position to the open position, thus permitting this opening operation at a wide angle while preventing the tablet feeders 340 of the movable half drum 301*b* from interfering with the tablet feeders 340 of the fixed half drum 301*a*.

2.2 Drum Driving Part

FIGS. 11A to 11C show a driving unit 317 for driving the drum 301 into rotation and a manual operation unit 318. These units 317 and 318 are provided on the bottom surface of a base 10*a* in the main body 10. The driving unit 317 is formed by fitting a drum rotation driving motor 320 to the bottom surface of a slide plate 319 and fitting a driving gear 321 to a driving shaft projecting therefrom. A slide plate 319 is so fitted as to be slidable by a pair of guides 322 so that the driving gear 321 is disengaged from the gear 310 of the drum 301. From the bottom surface of the slide plate 319, a driving pin 323 is projected. To the top surface of the slide plate 319, a detected piece 325 is fitted which is to be detected by a sensor 324 provided on the base 10*a*. The manual operation unit 318 is built by fitting a control lever 327, a link 328, and a slide shaft 329 to a support plate 326 fitted to the lower support member 311 of the main body 10. The control lever 327 is fitted so as to be rotatable about a spindle 327*a*. The link 328 is fitted near the spindle 327*a* of the control lever 327 so as to be rotatable by a pin 328*a*. The slide shaft 328 is inserted in a guide member 330 so as to be slidable in the same direction as the slide plate 319. The slide shaft 329 has one end thereof rotatably fitted to the link 328 with a pin 328*b* in between and has the other end thereof fitted to the driving pin 323 of the slide plate 319.

In the drum driving part described above, pressing the control lever 327 toward the drum 301 as shown in FIG. 11 causes the slide shaft 329 to move through the link 328, whereby the driving pin 323 is pressed. This causes the slide plate 319 to slide to engage with the gear 310 of the drum 301 as shown in FIG. 10, thereby permitting rotation of the drum 301 by the drum rotation driving motor 320. On the other hand, pulling back the control lever 327 away from the drum 301 causes the driving gear 321 to separate from the gear 310 of the drum 301, thereby permitting manual rotation of the drum 301. At this point, the detected piece 325 of the slide plate 319 is detected by the sensor 324, whereby the rotation of the drum 301 is prohibited.

2.3 Origin Detection Mechanism

As shown in FIG. 10, the lower ring 309 of the drum 301 is provided with a contact piece 332 which is brought into contact with an origin detection sensor (limit switch) 331*a* fitted on the base 10*a* of the main body 10. The contact piece 332 is fitted with a detected piece 333, which is detected by first and second rotation limit detection sensors (optical sensors) 331*b* and 331*c* fitted to both sides of the origin detection sensor (limit switch) 331*a*. When the first rotation limit detection sensor 331*b* first detects an origin, the position thereof is defined as a left rotation limit. When the second rotation limit detection sensor 331*c* first detects the origin, the position thereof is defined as a right rotation limit. When the origin detection sensor 331*a* detects the origin after these rotation limits have been detected, the drum 301 stops. The rotation position of the drum 301 from the origin is configured to be detected by a rotary encoder 335, which rotates through a gear 334 engaging with the gear 310 of the lower ring 309 of the drum 301. Upon detection of an origin of the drum 301 by the origin detection sensor 331*a*, the rotation position detected by the rotary encoder 335 is reset. Note that, as shown in FIG. 8, the upper ring 304 of the drum 301 is fitted with a projecting piece 337, which comes into contact with a stopper 336 provided on the upper support member 306. This can prevent the drum 301 from rotating through 360 degrees or more when the drum 301 is rotated manually.

2.4 Tablet Feeder

FIG. 12 shows a tablet feeder 340. The tablet feeder 340 is composed of a motor base 341 and a tablet cassette 342. The motor bases 341 are circumferentially arranged along the outer surface of the drum 301 and vertically provided in multi-stages. Each motor base 341 has a built-in motor 341*b* fitted with a driving gear 341*a*, as also shown in FIG. 13. In the motor base 341, a guide passage 341*c* is also formed which guides tablets discharged from the tablet cassette 342 into the drum 301. The tablet cassette 342 is a box with a cover 342*a* which stores multiple tablets and which is attachable to and detachable from the motor base 341. The tablet cassette 342 has therein a rotor 342*c* provided with a driving gear 342*b* that engages with the driving gear 341*a* of the motor base 341. When the driving motor 341*b* of the motor base 341 is driven, the rotor 342*c* of the tablet cassette 342 rotates through the driving gear 341*a* and the driving gear 342*b*, and thereby tablets inside are discharged one by one and then led through the guide passage 341*c* to the inside of the drum 301.

2.5 Tablet Storage Case and Shutter

The tablet storage case 343 is fitted inside the drum 301, as shown in FIG. 13. The tablet storage case 343 has an upper end opening 343*a* facing the guide passage 341*c* of the motor base 341 and a lower end opening 343*b*. Below the lower end outlet 343*b* of the tablet storage case 343, a shutter 344 is provided as shown in FIG. 14. The shutter 344 is slidably fitted to a pair of guide bars 345 projecting from the inner surface of the drum 301 so that the shutter 344 is movable between a closed position where the lower end opening 343*b* of the tablet storage case 343 is closed and an open position where this lower end opening 343*b* is open. On the bottom surface of the shutter 344, a projecting part 344*a* is formed which is pressed by a guide member 292 of the second transfer robot 250. Below the shutter 344, a return lever 346 is provided, which is fitted to a projecting piece 347 fitted to the inner surface of the drum 301 so as to be rotatable through a pin 348, with one end in contact with the projecting part 344*a* of the shutter 344 and with the other end connected through a spring 349 to the projecting piece 347. This permits the shutter 344 to be opened with its projecting piece 347 being pressed by the guide member 292 of the second transfer robot 250 and to be closed by the return lever 346. The return lever 346 is fitted with: a detected piece 346*a* to be detected by a sensor 293*a* that detects the start position of shutter opening operation performed by the second transfer robot 250; and a detected piece 346*b* to be detected by a sensor 293*b* that detects the end position of shutter opening operation performed by the second transfer robot 250.

2.6 Modified Embodiment 1 of the Tablet Supply Part (Overrun Mechanism)

In the embodiment described above, the drum 301 does not rotate through 360 degrees. However, providing the overrun mechanism to be described below permits the drum 301 and the second transfer robot 250 to rotate through 360 degrees or more (a range of approximately 400 degrees). Thus, even when, for example, the rotation range of the drum 301 is limited during a replenishment operation performed with the tablet cassette 342, due to the ability to rotate through 360 degrees or more with reference to the origin, the second transfer robot 250 can fill a target tablet case 343 from any direction, thus achieving efficient tablet supply operation.

FIG. 15 shows an example of this mechanism, in which a deceleration point detection sensor 1001 is arranged on the upper support member 306, and, on both sides of the deceleration point detection sensor 1001, rotation limit detection sensors 1002*a*, 1002*b*, and overrun detection sensors 1003*a*, 1003*b* are arranged in such a manner that they are separated from one another by predetermined angles. On the upper support member 306, a guide plate 1005 is also fitted in which two guide grooves 1004 are formed in the shape of a circular arc having the same center as that of the drum 301. To this guide plate 1005, as shown in FIG. 16, a slide member 1008 composed of two slide plates 1006 sandwiching the guide plate 1005 and four guide pins 1007 placed between the slide plates 1006 and inserted in the guide groove 1004 is slidably fitted along the guide groove 1004. The slide member 1008 is provided with: a projecting piece 1010 with which a projection 1009 fitted to the upper ring 304 of the drum 301 makes contact; and a detected piece 1011 to be detected by the five sensors 1001, 1002*a*, 1002*b*, 1003*a*, and 1003*b* described above. In this embodiment, when the drum 301 rotates counterclockwise and thereby the projection 1009 thereof presses the slide member 1008 located at the position defined by a chain double-dashed line of FIG. 15A, it is assumed that the drum 301 has rotated through 360 degrees. When the drum 301 rotates further counterclockwise to thereby slide the slide member 1008 and then the deceleration point detection sensor 1001 detects the detected piece 1011 of the slide member 1008, the drum 301 starts to decelerate. Then, when the rotation limit detection sensor 1002*a* detects the detected piece 1011 of the slide member 1008, this position is defined as the rotation limit in the counterclockwise direction. When the overrun detection sensor 1003*a* detects the detected piece 1011, the drum 301 stops. The same applies to clockwise rotation of the drum 301 from the state as shown FIG. 15B to the state as shown in FIG. 15C. As a result, the drum 301 can rotate through 360 degrees or more.

FIG. 17 shows still another embodiment, in which a deceleration point detection sensor 1001 is arranged on the upper support member 306, and on both sides of the deceleration point detection sensor 1001, rotation limit detection sensors 1002*a*, 1002*b* and overrun detection sensors 1003*a*, 1003*b* are arranged in the same manner as in the embodiment of FIG. 16. To the main body 10, a guide arm 1012 is provided in such a manner as to be rotatable, between two stoppers 1013, about an axis 1012*a* located on the axis of the drum 301. The tip of the guide arm 1012 is configured to be detected by the sensors 1001, 1002*a*, 1002*b*, 1003*a*, and 1003*b*. The guide arm 1012 is configured to be contacted by the projection 1009 fitted to the upper ring 304 of the drum 301. In this embodiment, when the drum 301 rotates counterclockwise and thereby the projection 1009 thereof presses the guide arm 1012 located at the position defined by a chain double-dashed line of FIG. 17, it is assumed that the drum 301 has rotated through 360 degrees. When the drum 301 rotates further counterclockwise to thereby turn the slide member 1008 and then the deceleration point detection sensor 1001 detects the guide arm 1012, the drum 301 starts to decelerate. Then, when the rotation limit detection sensor 1002*a* detects the guide arm 1012, this position is defined as the rotation limit in the counterclockwise direction. When the overrun detection sensor 1003*a* detects the detected piece 1011, the drum 301 stops. The same applies to clockwise rotation, i.e., in the direction opposite to the direction in FIG. 17. As a result, the drum 301 can rotate through 360 degrees or more.

In order to prevent the drum 301 from stopping at the overrun detection sensors 1003*a* and 1003*b* when the drum 301 is rotated manually, if a spring which presses back the projection 1009, the detected piece 1011, or the guide arm 1012 at least toward the rotation limit detection sensors 1002*a* and 1002*b* is provided, no error occurs at the time of origin acquisition.

3. Second Transfer Robot.

The second transfer robot 250 is composed of a rotary block 251 and a lifting block 252, as shown in FIGS. 18 and 19.

The rotary block 251 is composed of a frame 253 extending along the axis of the drum 301. An upper end shaft 254 of the frame 253 is rotatably supported through a bearing 255 by the upper ring 304 of the drum 301, and a lower end shaft 256 thereof is supported through 258 by a support base 257 provided in the main body 10. The lower end shaft 256 of the frame 253 is coupled through a gear 260 to a rotation driving motor 259 fitted to the main body 10. This permits the frame 253 to rotate around the axis of the drum 301. The frame 253 has two guide rods 261 arranged in parallel to the line connecting the upper and lower end shafts 254 and 256 with a gear belt 262 arranged between the guide rods 261. The gear belt 262 is stretched over an upper gear 263 provided at the upper end portion of the frame 253 and a lower gear 264 provided at the lower end portion thereof. The upper gear 263 is coupled to a lifting driving motor 265 fitted to the frame 253. This permits the gear belt 262 to run vertically. To the upper and lower ends of the frame 253, an origin position detection sensor 266*a* and an end point position detection sensor 266*b* are fitted respectively. To the lower end of the frame 253, a detected piece 268 is fitted which is detected by a delivery position sensor 267*a* for detecting delivery from the first transfer robot 150 and a delivery position detection sensor 267*b* for detecting delivery from the third transfer robot 350, both provided in the main body 10.

The lifting block 252 is, as shown in FIGS. 20A to 20B through 23, composed of a lifting base 269, a lifting table 270, a boom 271, an arm base 271, and two pairs of arms 273*a* and 273*b*. The lifting base 269 is slidably fitted to the guide rod 261 of the rotary block 251 and firmly fixed to part of the gear belt 262 described above so that the lifting base 269 can be lifted by running of the gear belt 262. The gear belt 262 is fitted with a balance weight 274 so as to be balanced with the lifting block 252. The lifting table 270 is fitted to the side surface of the lifting base 269. The boom 271 is fitted below the lifting table 270 with guides 275*a* and 275*b* in between so as to be slidable horizontally. To the top surface of the boom 271, a rack 276 is fitted which engages with a pinion 278 of an extension-contraction driving motor 277 fitted to the lifting table 270. This permits the boom 271 to extend and contract horizontally. From the boom 271, a detected piece 280 is projected which is detected by three position detection sensors 279*a*, 279*b*, and 279*c* provided on the lifting table 270.

The arm base 271 as shown in FIG. 22, an inverted-V shape as viewed horizontally and is swingably fitted to the lower ends of the boom 271 with a swing shaft 281 in between. To the middle of the swing shaft 281, a bevel gear 282 is fitted which engages with a gear 284 of an oscillation driving motor 283 fitted to the boom 271. This permits the arm base 272 to swing between a horizontal position and a tilt position. The arm base 272 is fitted with a detected piece 286 which is detected by two position detection sensors 285*a* and 285*b* provided on the boom 271. To the ends of the arm base 272, guide bars 287 are fitted in pairs at the upper and the lower positions, respectively, with a ball screw 288 stretched in between.

The base ends of the two pairs of arms 273*a* to 273*d* are slidably joined to the guide bars 287 and also screwed with the ball screw 288. One end of the ball screw 288 is coupled with a gear 289 in between to an arm driving motor 289 fitted to the arm base 272 with a gear 290 in between. This permits the distance between the arms 273*a* and 273*b* to become wider or narrower when the arm driving motor 289 is driven, thereby permitting holding and releasing a vial 3. To the end and middle of each of the arms 273*a* to 273*d*, support rollers 291 are fitted. This permits, as shown in FIG. 23, the two pairs of arms 273*a* to 273*d* to support a vial 3 at the eight points with the eight support rollers 291.

The arm base 272 is fitted with a funnel-shaped guide member 292 above the two pairs of the arms 273*a* to 273*b*. The guide member 292 has an outlet thereof facing the opening of a vial 3 held by one pair of the arm members 273*a*-273*d* and has an inlet thereof so shaped as to be tilted through substantially 45 degrees when the arm base 272 is at the horizontal position and to be oriented horizontally when the arm base 272 is at a tilt position. To both sides of the guide member 292, sensors 293*a* and 293*b* are fitted which detect the detected pieces 343*a* and 346*b*, respectively, of the return lever 346 of the shutter 344 provided in the tablet supply part 300.

The operation of the second transfer robot 250 constructed as described above will be described with reference to the flowchart diagram of FIG. 24. First, the second transfer robot 250 moves to the delivery position of the first transfer robot 150 in step S251. If the second transfer robot 250 detects a vial 3 in step S252, it extends the boom 271 in step S253. If the second transfer robot 250 is located at the holding position in step S254, it stops the extension of the boom 271 in step S255 and then holds the vial 3 in step S256. The second transfer robot 250 contracts the boom 271 and returns to the origin position in step S257. If the second transfer robot 250 receives take-out coordinates from the PC801 in step S258, the second transfer robot 250 rotates the rotary block 251 and lifts the lifting block 252 in step S259 and tilts the arm base 272 to the tilt position in step S260. If the second transfer robot 250 reaches take-out coordinates in step S261, the second transfer robot 250 extends the boom 271 in step S262. If the boom 271 reaches the take-out coordinates in step S263, it stands by for a predetermined filling period in step S264, whereby tablets are filled into the vial 3. Subsequently, the second transfer robot 250 detects in step S265 whether or not the tablets are of a type that tends to remain. Here, tablets of a type that tends to remain refer to those which tend to remain adhering to the guide passage due to the viscosity of its surface that is variable depending on ambient temperature and humidity. If the tablets are of a type that tends to remain, the second transfer robot 250 performs an operation of dropping off the remaining tablets by extending and contracting the boom 271 two or three times in step S266. If the tablets are not of a type that tends to remain, the second transfer robot 250 judges in step S267 whether or not the filled amount of tablets is 65% or more. Here, the filled amount of tablets of 65% or more refers to the filled amount of tablets accounts for 65% or more of the capacity of a viral 3. If the filled amount is 65% or more, since the tablets are filled beyond the opening edge of the tilted vial 3 and thus are spilled over the guide member 292, there is a possibility that the tablets spill out when the vial 3 is delivered to the third transfer robot 350. Thus, the second transfer robot 250 performs an oscillating operation by tilting the arm base 272 through minus 5 degrees in step S268. This oscillating operation permits the tablets spilled over the guide member 292 to be filled back into the vial 3. If the filled amount is less than 65%, the second transfer robot 250 locates the arm base 272 at the horizontal position in step S269, moves to the delivery position of the third transfer robot 350 in step S270, and, upon confirmation of the delivery in step S271, ends its operation.

If the filled amount is 65% or more, instead of the oscillating operation performed in step S268, the vial 3 may be returned to the horizontal position so that a member with a flat tip is pressed against the opening of the vial 3 to provide an even surface for tablet filling.

4. Tablet Filling Position Control

The tablet filling position control performed when a vial 3 grasped by the arms 273*a* to 273*d* of the second transfer robot 250 is to be filled with tablets supplied from the tablet feeder 340 of the drum 301 includes mutual control, drum control, and robot arm control. These controls will be described below with reference to the flowchart diagrams of FIGS. 25 to 27.

<Mutual Control>

In FIG. 25, when take-out coordinates are received in step S300, the current coordinates of the tablet supply part 300 are detected in step S302, the current arm rotational coordinates of the second transfer robot 250 are detected in step S303, and, based on these coordinates, the rotation directions of both the drum 301 and the second transfer robot 250 within the rotation limits are determined in step S304. Then, the coordinates of the intersection of the drum coordinates and the arm coordinates are estimated in step S305, the drum 301 is rotated in step S306, and the second transfer robot 250 is rotated in step S307. If both reach the intersection coordinates in step S308, both rotations are stopped in step S309.

<Drum Control>

In FIG. 26, when take-out coordinates are received in step S311, the current drum coordinates are detected in step S312, and, based on the coordinates, the rotation direction of the drum 301 within the rotation limit is determined in step S313. Then, the drum 301 is rotated in step S314, and, if it is detected that the drum 301 has reached the take-out coordinates in step S315, the rotation of the drum 301 is stopped in step S316.

<Robot Arm Control>

In FIG. 27, when take-out coordinates are received in step S321, the current arm rotation coordinates of the second transfer robot are detected in step S322, and, based on the coordinates, the rotation direction of the second transfer robot 250 within the rotation limit is determined in step S323. Then, the second transfer robot 250 is rotated in step S324, and, if it is detected that the second transfer robot 250 has reached the take-out coordinates in step S325, the rotation of the second transfer robot 250 is stopped in step S326.

5. Modified Embodiment of the Tablet Supply Part (Double Drum Mechanism)

In the embodiment described above, one drum 301 is provided. Doubling this drum 301 increases the number of tablets cassettes 340 to be fitted, thereby permitting a large number of tablets to be stored and taken out.

FIG. 28 shows a first modified embodiment of the tablet supply part 300 in which the drum 301 is doubled. This drum 301 is composed of an inner drum 1021 and an outer drum 1022 arranged on the outer side of the inner drum 1021 coaxially therewith. The inner drum 1021 and the outer drum 1022 are rotatably supported as in the embodiment described above. In the inner drum 1021, an opening 1023 is formed which permits the arm 272 of the second transfer robot 250 to pass therethorugh. The opening 1023 of the inner drum 1021 is formed across the upper end and the lower end of the inner drum 1021, and may also be formed over the range where the tablet storage case 343 of the outer drum 1022 is provided. In the outer drum 1022, an opening 1024 is formed which permits access to the tablet feeders 340 of the inner drum 1021 from outside. The opening 1024 of the outer drum 1022 is also formed across the upper end and the lower end of the outer drum 1022, and may also be formed over the range where the tablet feeders 340 of the inner drum 1021 are provided. In this modified embodiment, operation for receiving the supply of tablets from the tablet feeder 340 of the inner drum 1021 is performed in the same manner as in the embodiment described above. To receive the supply of tablets from the tablet feeders 340 of the outer drum 1022, the arm base 272 of the second transfer robot 250 is brought into agreement with the opening 1023 of the inner drum 1021.

FIG. 29 shows a second modified embodiment in which the inner drum 1021 of the first modified embodiment includes openings 1023*a*, 1023*b*, and 1023*c* that are formed circumferentially at regular intervals. In this modified embodiment, to receive the supply of tablets from the tablet feeder 340 of the outer drum 1022, the arm base 272 of the second transfer robot 250 may be brought into agreement with the closest of the openings 1023*a*, 1023*b*, and 1023*c*, thus permitting a reduction in the rotation amount of the second transfer robot 250 or the inner drum 1021.

FIG. 30 shows a third modified embodiment in which an auxiliary transfer robot 1025 is provided in the opening 1023 of the inner drum 1021 of the first modified embodiment. The auxiliary transfer robot 1025 is composed of, as shown in FIGS. 31A to 31C, a lifting table 1026, a boom 1027, a swivel table 1028, and an arm head 1029. The lifting table 1026 is guided by a pair of guide bars 1030 arranged in parallel with the axis of the inner drum 1021, screwed with a ball screw 1031 provided between the guide bars 1030, and is capable of lifting by driving the ball screw 1031 by a motor (not shown). The boom 1027 is provided on the lifting table 1026 so as to be slidable along the radius direction of the inner drum 1021 through a rack-pinion mechanism by being driven by a motor 1032. The swivel table 1028 is provided on the boom 1027 so as to be capable of swiveling about a swivel shaft 1033 by a motor (not shown). The arm base 1029 is provided on the swivel table 1028 with the same construction as is employed for the arm base 272 of the second transfer robot 250 so that the arm base 1029 is capable of holding a vial 3. This auxiliary transfer robot 1025 receives a vial 3 from the second transfer robot 250 when in the state shown in FIG. 31A, and then swivels the swivel table 1028 through 180 degrees so as to orient the arm base 1029 to face outward as shown in FIG. 31B. Subsequently, the auxiliary transfer robot 1025 rotates the inner drum 1021 or the outer drum 1022 and lifts the lifting table 1026, thereby orienting the arm base 1029 to face the position of a target tablet feeder 340. Then, as shown in FIG. 31C, the auxiliary transfer robot 1025 carries the boom 1027 forward to the outer drum 1022 to receive the supply of tablets. Subsequently, the auxiliary transfer robot 1025 swivels the swivel table 1028 to orient the arm base 1029 to face inward and delivers the vial 2 to the second transfer robot 250.

<Drug Filling Position Control of the Double Drum in Modified Embodiments 1 and 2>

The drug filling position control performed in the double drum in the modified embodiments of FIGS. 28 and 29 will be described below with reference to the flowchart diagram of FIG. 32. When take-out coordinates are received in step S1001, it is judged whether or not the take-out coordinates apply to the outer drum 1022 in step S1002. If the take-out coordinates apply not to the outer drum 1022 but to the inner drum 1021, the flow of any one of the mutual control, the drum control, and the robot arm control according to the aforementioned embodiment shown in FIGS. 25 to 27 is performed. If the take-out coordinates apply to the outer drum 1022, the current coordinates of the outer drum 1027 are detected in step S1003, the current coordinates of the inner drum 1021 are detected in step S1004, the rotation directions of the inner drum 1021 and the outer drum 1022 within their rotation limits are determined based on these coordinates in step S1005, and the intersection coordinates of the outer drum 1022 and the inner drum 1021 are estimated in step S1006. The inner drum 1021 and the outer drum 1022 rotate in step S1007, and if the intersection coordinates are reached in step S1008, the inner and outer drums 1021 and 1022 stop in step S1009.

<Drug Filling Position Control of the Double Drum in Modified Embodiment 3>

The drug filling position control performed in the double drum by the auxiliary transfer robot 1025 in the modified embodiment 3 of FIG. 30 will be described below with reference to the flowchart diagram of FIG. 33. Upon receiving take-out coordinates of the outer drum 1022 in step S1011, the auxiliary transfer robot 1025 stands by at the delivery position of the second transfer robot 250 in step S1012. If the auxiliary transfer robot 1025 detects in step S1013 that a vial 3 held by the second transfer robot 250 has arrived, it extends the boom 1027 in step S1014, and holds the vial 3 in step S1015. The auxiliary transfer robot 1025 contracts the boom 1027 and swivels the swivel table 1028 toward the drum 1022 in step S1016. The auxiliary transfer robot 1025 lifts the lifting table 1026 in step S1017, and tilts the arm base 1029 at the tilt position in step S1018. If the auxiliary transfer robot 1025 reaches the take-out coordinates in step S1019, it extends the boom 1027 in step S1020. If the boom 1027 reaches the take-out position in step S1021, it stands by for a predetermined filling time in step S1022. This permits tablets to be filled into the vial. Subsequently, the auxiliary transfer robot 1025 detects in step S1023 whether or not the tablets are of a type that tends to remain. If the tablets are of a type that tends to remain, the auxiliary transfer robot 1025 performs operation of dropping off the remaining tablets by extending and contracting the boom 1027 two or three times in step S1024. If the tablets are not of a type that tends to remain, the auxiliary transfer robot 1025 judges in step S1025 whether or not the filled amount of tablets is 65% or more. If the filled amount is 65% or more, the auxiliary transfer robot 1025 performs oscillating operation by tilting the arm base 1029 through minus 5 degrees in step S1026. If the filled amount is less than 65%, the auxiliary transfer robot 1025 locates the arm base 1029 at the horizontal position in step S1027, moves to the delivery position of the second transfer robot 250 in step S1028, and, upon confirmation of the delivery in step S1029, ends it operation.

6. Third Transfer Robot 350

The third transfer robot 350 has, as shown in FIGS. 34 and 35, a rotation shaft 353 that is rotatably and vertically supported by a base 352 of a fitting base 351 fitted to the main body 10. To the ends of the arm base 354, guide bars 355 are fitted in pairs at the upper and the lower positions, respectively, with a ball screw 356 stretched in between. One pair of arms 357 have base ends thereof slidably joined to the guide bars 355 and also screwed with the ball screw 356. One end of the ball screw 356 is coupled with a gear 359 in between to an arm driving motor 358 fitted to the arm base 354. This permits the distance between the arms 357 to become wider or narrower when the arm driving motor 358 is driven, thereby permitting holding and releasing the vial 3. To the ends of the arms 357, pads 360 are fitted which press against the vial 3. The lower end of the rotation shaft 353 is coupled with a gear 362 in between to a rotation driving motor 361 fitted to the fitting base 351. This permits the arm base 354 to be rotatable about the rotation shaft 353.

The base 352 is fitted with three position detection sensor 363*a*, 363*b*, and 363*c* which are located around the rotation shaft 353 for detecting rotation position of the arm base 354. This permits the arm 357 to be rotatably move between a first delivery position for receiving the vial 3 transferred by the first transfer robot 150 or the second transfer robot 250, a second delivery position for passing over the vial 3 to the photographing part 400, a third delivery position for passing over the vial 3 to the capping part 600 (the same as the second deliver position in this embodiment), and a fourth delivery position for passing over the vial 3 to the a fourth transfer robot 450. Moreover, the rotation shaft 353 is fitted with a vial detection sensor 364 for detecting that the vial 3 is at a position that permits the arms 357 to hold the vial 3. Furthermore, the arm base 354 is fitted with a position detection sensor 365 for detecting open-close position of the arms 357.

The operation performed by the third transfer robot 350 with the construction described above will be described referring to the flowchart diagram FIG. 36. The third transfer robot 350 moves to an origin, i.e., the first delivery position, in step S351, and judges whether or not the vial is empty in step S352. If the vial is not empty, processing proceeds to step S353. If the third transfer robot 350 detects the viral at the first delivery position in this step, it holds the viral in step S354, moves to the second delivery position in step S355, and transmits a photographing permission signal to the PC801 in step S356. If the third transfer robot 350 receives a photographing end signal from the PC801 in step S357, it moves to the third delivery position in step S358, delivers it to the capping part 600 in step S359, releases the arms 357 in step S360, and stands by at the current position in step S361. If the third transfer robot 350 receives a cap-fitting signal from the device controller 802 in step S362, it holds the viral in step S363, moves to the fourth delivery position in step S364, and, upon confirmation of the delivery in step S365, ends its operation. If the vial 3 is empty in step S352, the processing proceeds to step S366. If the third transfer robot 350 detects the viral 3 at the first delivery position in this step, it holds the viral 3 in step S367, moves to the fourth delivery position in step S364, and, upon confirmation of the delivery in step S365, end its operation.

7. Photographing Part 400

The photographing part 400 is, as shown in FIG. 5, built by fitting a digital camera 402 to the end of a support member 401 fitted to the main body 10 such that the lens of the digital camera 402 faces downward. The digital camera 402 is so configured as to be capable of photographing the interior of the vial 3 already filled with tablets and delivered by the third transfer robot 350 from above the vial 3. The support member 401 is movable horizontally in the anteroposterior direction and the left-right direction and also liftable vertically with respect to the main body 10, by a driving motor (not shown) which is driven and controlled by the device controller 802.

Photographing initialization operation performed by the device controller 802 on the photographing part 400 will be described referring to the flowchart diagram shown in FIG. 37. If the main body 10 is turned ON in step S401, the PC801 is turned ON in step S402, whereby the device control application is activated in step S403. The device controller 802 transmits an initialization signal to each device in step S404, and obtains the initial origin of each device in step S405. Subsequently, the device controller 802 turns ON the digital camera 402 in response to directions from the software in step S406, and makes setting in steps S407 to 411, i.e., initial zoom setting, image size selection, image quality setting, flash setting, and color balance, respectively. Upon receiving an initialization end signal in step S412, the device controller 802 ends its operation.

Next, photographing control operation will be described referring to the flowchart diagram of FIG. 38. First, when a photographing permission signal is received in step S421, and auto-focus detection is performed to thereby obtain an average over a plurality of times in step S422. Based on this detected value, focus control is performed in step S423, and a photographing signal is transmitted in step S424. An image file is accessed in step S425, data of the image file is transferred and temporality saved in step S426, and a monitor is displayed on the operation display panel 20 in step S427. If manual-check is turned ON in step S428 and image saving permission is operated in step S429, a photographing end signal is transmitted in step S430, thereby ending the operation. If the image saving permission is not operated in step S429, the temporarily saved data is cleared in step S431, and the processing returns to step S422 to repeat the steps described above.

As described above, in the photographing part 400, the interior of a vial 3 filled with tablets can be photographed by the digital camera 402 before the vial 3 is plugged with the cap 2, and the resulting image can be confirmed on the operation display panel 20, thus permitting quick and simple audit operation without opening the cap 2 of the vial 3 which has been taken out. Moreover, if the image confirmed on the operation display panel 20 during photographing is not clear, photographing can be performed once again, thus permitting obtaining a clear image at any time.

FIG. 39 shows an operation flow among the photographing part 400, the PC801, and the device controller 802. At initial processing, when the main body is turned ON, the PC801 is turned ON to activate the device control application. When the device controller 802 provides an initialization designation to the PC801, the PC801 initializes the digital camera 402 of the photographing part 400 and transmits the initialization data to the device controller 802. Subsequently, the device controller 802 initializes the devices installed in the main body 10 and waits for packing data.

At packing processing, when the PC801 transmits a packing designation signal to the device controller 802, the device controller 802 controls the devices to perform packing. When the vial 3 filled with tablets reaches the photographing position, the device controller 802 transmits a camera-photographing signal to the PC801. The PC801 causes the digital camera 402 of the image-taking part 400 to perform camera-photographing. When the digital camera 402 transmits a camera image to the PC801, the PC801 saves the image and transmits a photographing completion signal to the device controller 802. The device controller 802 causes the devices to perform the next packing operation.

At ending processing, the PC801 causes the digital camera 402 of the photographing part 400 to perform camera-closing processing. When the main body is turned OFF, the device controller 802 causes the digital camera 402 of the photographing part 400 to perform camera-closing processing.

FIG. 40 shows a flow of operation performed among the PC801, the device controller 802, and the operator. Upon completion of individual packaging, the device controller 802 transfers the vial 3 to the take-out ports 30*a-c* for storage, and notifies the PC801 of packing completion, whereby the PC801 displays already packed prescriptions on in-process prescription list screen 1.1 of the operation display panel 20 prescription as shown in FIG. 45. When the operator is prompted to read the bar code of the prescription, the device controller 802 blinks the 7SEG display of the take-out port 30*a*-30*c* that stores the vial 3 concerned. When the operator takes out the vial 3 through this take-out port 30*a-c*, the device controller 802 notifies the PC801 that the vial 3 has been taken out. The PC801 opens on the operation display panel 20 the vial take-out error confirmation screen 1.1 shown in FIG. 46. Then the operator confirms the details of the prescription, and when he or she touches the photographed image shown on the screen, the PC801 displays a vial interior photograph display screen 1.1.1.1 shown in FIG. 47.

After confirmation of packing, the operator specifies the prescription while viewing a dispensed vial photo list screen 1.5 shown in FIG. 61, or when the bar code of the vial 3 is read, the PC801 opens on the operation display panel 20 a photo display screen 1.6.1 shown in FIG. 63 displaying the interior photo of the vial 3.

8. Tablet Take-Out Control Performed by an External Tablet Supply Part

FIG. 41A shows the external tablet supply part 40. When tablets corresponding to prescription data are of a special type, such as pyrazolone, the external tablet supply part 40 instead of the tablet supply part 300 is used. The external tablet supply part 40 is composed of: a tablet feeder 43 that is composed of a motor base 41 and a tablet cassette 42; and a tablet storage case 44. The motor base 41 is identical to the motor base 341 of the tablet supply part 300, except in that the outlet of the guide passage 341*c* of the motor base 341 included in the tablet supply part 300 is formed in the back surface of the motor base 341 while the outlet of a guide passage 45 is formed in the bottom surface of the motor base 41. The tablet cassette 42 is identical to the tablet cassette 342 of the tablet supply part 300. The tablet storage case 44 is different from that of the tablet supply part 300 in that it is provided below the motor base 41. The tablet storage case 44 has, at its upper end an inlet 44*a*, connecting to the guide passage 45 and, at its lower end, an outlet 44*b*. The outlet 44*b* is provided with a shutter 46 which is arranged so as to be rotatable about a pin 47. The shutter 46 is, as shown in FIG. 41B, provided with a projected piece 46*a* which is detected by sensors 48*a* and 48*b* at the closing position and the open position. The shutter 46 is forced by a spring 49 in the closing direction. When tablets are discharged from the tablet cassette 42 to the tablet storage case 44 through the guide passage 45 of the motor base 41, the operator can manually fill the tablets into a vial 3 by holding the vial 3 and pressing it against the shutter 46.

The tablet take-out control performed by this external tablet supply part 40 will be described below with reference to the flowchart diagram of FIG. 42. If prescription data is received in step S41, it is judged in step S42 whether or not the data is designated for the external tablet supply part 40. If the data is not designated for the external tablet supply part 40, normal tablet take-out control is performed. If the data is designated for the external tablet supply part, the external tablet supply part 40 detects the tablet cassette 42 corresponding to the prescription data in step S43, and discharges tablets in step S44. Subsequently, the vial size is selected in step S45, print data is created in step S46, and the print data is transmitted to the labeling part 200 in step S47. The vial 3 is delivered to the labeling part 200 by the first transfer robot 150 in step S48, printing and labeling are performed by the labeling part 200 in step S49, and the vial 3 is delivered by the first transfer robot 150 to the third transfer robot 350 in step S50. The vial 3 is transferred and delivered to the fourth transfer robot 450 by the third transfer robot 350 in step S51, and the vial 3 is transferred by the fourth transfer robot 450 to the storage part 700 in step S52. Then, if the operator takes out the vial 3 through the take-out ports 30*a-c* in step S53, the operator is asked in step S54 whether or not tablets have been filled. If the tablets have been filled, the operator is asked in step S55 whether or not to omit photographing. If photographing is to be omitted, the data stored in the storage part 700 is cleared in step S56. The operator confirms the interior of the vial 3 with his or her naked eyes in step S57, and the cap 2 is taken out from the external cap supply part 50 for plugging the vial 3 in step S58.

If photographing is to be performed in step S55, a photographing button is pressed in step S59, and the vial 3 is returned in step S60. If the third transfer robot 350 or the fourth transfer robot 450 is occupied in step S61, interrupt processing is performed in step S62. If they are unoccupied, the vial 3 is delivered by the fourth transfer robot 450 to the third transfer robot 350, and the vial 3 is transferred by the third transfer robot 350 to the photographing part 400 in step S63. If it is detected that the vial 3 is located at the photographing position in step S64 and photographing is completed in step S65, the vial 3 is delivered by the third transfer robot 66 to the fourth transfer robot 450 in step S66, and the vial 3 is transferred by the fourth transfer robot 450 to the storage part 700 in step S67. If the vial 3 is taken out in step S68, processing returns to step S56, the operator confirms the vial with his or her naked eyes, and the cap 2 is taken out from an outer cap storage part 50 for plugging the vial 3 in step S58.

9. Operation Display Panel

Next, a description will be given on the embodiment of display and operation performed on the operation display panel 20. When the power button of the main body 10 is turned ON, the PC801 and the device controller 802 are turned ON, and the device controller 802 makes initial setting on each device and then transmits the position information of each device to the PC801, whereby initialization is completed and the PC801 turns into a standby state.

<Main Menu Screen>

In the standby state, the operation display panel 20 opens the Main Menu screen 0.0 shown in FIG. 43. If the "AUTOMATIC" button, the "CURRENT DRUG TABLET" button, the "CASSETTE CONTROL" button, the "DISCONNECT COMMUNICATION" button, and the "TIMER SETTING/PROGRAM VERSION" button are respectively pressed and OK is pressed, the Automatic Dispending screen 1.0 of FIG. 44, the Drug Table List screen 2.0 of FIG. 67, the Tablet Cassette Control screen 3.0 of FIG. 69, the Host Disconnection screen 4.0 of FIG. 70, and the Update Time Setting screen 5.0 of FIG. 71 open respectively.

<Automatic Dispending Screen>

On the Automatic Dispending screen shown 1.0 of FIG. 44, clicking the "COMPLETED" tab, the "FILL CASSETTE" tab, the "TRANSACTION" tab, the "HISTORY" tab, the "TO BE FILLED" tab, the "PHOTO" tab, and the "MANUAL" tab open the In-process prescription list screen 1.1 of FIG. 45, the Drug filling cassette designation screen 1.2 of FIG. 48, the Processed prescription list screen 1.3 of FIG. 58, the Filling history drug selection screen 1.4 of FIG. 59, the Dispensing machine not-yet transmitted prescription list screen 1.5 of FIG. 61, the Dispensed vial photo list screen 1.6 of FIG. 62, and the Manual dispensing cassette designation screen 1.7 of FIG. 64, respectively.

<In-Process Prescription List Screen>

On the In-process prescription list screen 1.1 of FIG. 45, a list of prescriptions under dispensing is displayed. When a vial with which filling has been completed is taken out through the take-out port, the Vial take-out error confirmation screen 1.1.1 of FIG. 46 opens, prompting confirmation of the prescription and contents of the vial taken out. Touching the photo area on this Vial take-out error confirmation screen 1.1.1 opens the Vial interior photo display screen 1.11.1 of FIG. 47, displaying the photo of the interior of the vial on an enlarged scale.

<Drug Filling Cassette Specification Screen>

On the Drug filling cassette specification screen 1.2 of FIG. 48, the tablet cassette for filling drug is specified. When the tablet cassette number is inputted and OK is pressed, the New drug registration screen 1.2.1*a* of FIG. 49 opens if the tablet has not yet been registered for the tablet cassette concerned, or the NDC code check screen 1.2.1*b* of FIG. 52 opens if the tablets have been already registered. Pressing the "LIST" opens the Cassette list screen 1.2.2 of FIG. 55. Pressing the "STOCKS" button opens the Cassette-by-cassette tablet inventory list screen 1.2.3 of FIG. 56.

On the New drug registration screen 1.2.1*a* of FIG. 49, the tablets to be registered for the specified tablet cassette and master-slave cassette information are set. Tablets that are frequently dispensed in a large amount are filled using not one tablet cassette but a plurality of tablet cassettes. Here, it is defined that a tablet cassette serving as a main cassette is a master cassette while a tablet cassette serving as a subordinate cassette is a slave cassette. Pressing the "ENTER" button registers the tablets for the specified tablet cassette and opens the NDC code check screen 1.2.1*b* of FIG. 52. Pressing the "DATA BASE" button opens the Drug list display screen 1.2.1*a*.1 of FIG. 50 whereby a list of the contents of NDC masters is displayed. Selecting the drug to be deleted and pressing the "DELETE" button on this Drug list display screen 1.2.1*a*.1 opens the NDC master drug delete screen 1.2.1*a*.1.1 of FIG. 51, confirming if the drug selected on the list may be deleted from the NDC masters. Thus, the selected drug is deleted if it is accepted.

On the NDC code check screen 1.2.1*b* of FIG. 52, it can be checked, by reading the inputted tablet cassettes information and the bar code information printed on the drug to be filled, if the drug to be filled is appropriate. Manually inputting the NDC code and pressing the "ENTER" button can achieve the same operation as is achieved when the bar code is used. If the check result is OK, pressing OK opens the Tablet filling screen 1.2.1*b*.1 of FIG. 53. On this screen, inputting the tablet filling information and then pressing OK opens the Filling confirmation screen 1.2.1*b*.1.1 of FIG. 54, where it is checked if the inputted filling information is correct. If the check result is OK, the "RESTART" button is to be pressed.

On the Cassette list screen 1.2.2 of FIG. 55, a list is displayed indicating tablet cassettes and corresponding drugs registered for these tablet cassettes. Selecting the tablet cassette and then pressing OK permits transfer of this information to the new Drug registration screen 1.2.1*a*.

On the Cassette-by-cassette tablet inventory list screen 1.2.3 of FIG. 56, a list is displayed indicating inventories of tablets registered for their corresponding tablet cassettes. To change the inventory, selecting the corresponding tablet cassette and pressing the "UPDATE" button opens the Tablet inventory change screen 1.2.3.1 of FIG. 57, permitting the new number of tablets to be set.

<Processed Prescription List Screen>

On the processed prescription list screen 1.3 of FIG. 58, a list of processed prescriptions is displayed. Selecting a prescription suffering from a filling failure or contamination and pressing the "REFILL VIAL" permits providing a designation for dispensing the selected prescription again.

<Filling History Drug Selection Screen>

On the Filling history drug selection screen 1.4 of FIG. 59, a list of tablets filled into the tablet cassettes is displayed. Selecting the tablets and pressing the "SELECT" button opens the Filling history display screen 1.4.1 of FIG. 60, displaying a list of filling history of the selected tablets. Pressing the "SAVE" button causes the filling history data to be written into the floppy disk, and pressing the "PRINT" button causes the filling history to be printed out.

<Dispensing Machine Non-Yet-Transmitted Prescription List Screen>

On the Dispensing machine non-yet-transmitted prescription list screen 1.5 of FIG. 61, a list is displayed indicating data of prescriptions which were received from the host computer or manually inputted but not have yet been transmitted to the device controller. On this screen, selecting the prescription and then pressing the "DELETE" button permits deletion of this prescription.

<Dispensed Vial Photo List Screen>

On the Dispensed vial photo list screen 1.6 of FIG. 62, a list is displayed indicating prescriptions whose tablets in the vial have been photographed by the photographing part 400. Selecting the prescription and pressing the "SHOW" button opens the Photo display screen 1.6.1 of FIG. 63, displaying the photo of the interior of the viral corresponding to the selected prescription. By reading the bar code on the label of a vial taken out through the take-out port, the photo of the interior of this vial can be displayed on the Photo display screen 1.6.1 of FIG. 63. Viewing these photos permits audit whether the tablets have been filled in accordance with the prescription and also whether any contamination is present therein.

<Manual Dispensing Cassette Designation Screen>

On the Manually dispensing cassette designation screen 1.7 of FIG. 64, if no prescription data is received from the host computer, prescription data can be manually inputted to dispense tablets. Inputting the cassette number and pressing OK on this Manual dispensing cassette designation screen 1.7 opens the Manual dispensed tablet quantity specification screen 1.7.1 of FIG. 65, permitting specification of the quantity of tablets to be dispensed, the type of vial, and the presence or absence of a cap and then permitting transmission of these data. If the cassette number is unknown, pressing the "LIST" button on the Manual dispensing cassette designation screen 1.7 of FIG. 64 opens the cassette list screen 1.7.2 of FIG. 66, displaying a list of tablet cassettes and their corresponding registered drugs. Selecting the tablet cassette and pressing OK on this screen causes delivery of this information to the Manual dispensing cassette designation screen 1.7.

<Drug Table List Screen>

On the Drug table list screen 2.0 of FIG. 67, a list of drug masters currently registered can be displayed. Selecting the drug and pressing the "DELETE" button opens the Delete drug confirmation screen 2.1 of FIG. 68, where it is confirmed if the selected tablets may be deleted from the drug masters, and the selected tablets are deleted if it is accepted.

<Tablet Cassette Control Screen>

On the Tablet cassette control screen 3.0 of FIG. 69, a tablet cassette can be moved to the regular position for tablet filling or for maintenance of the motor base. Inputting the cassette number and pressing the "CENTER" button and then the "SEARCH" button permits rotation of the drum to thereby automatically move the specified tablet cassette from the current position to the regular position located on the front of the main body. Pressing the button "<<" or ">>" permits the drum to be moved to the left or to the right by one pitch.

<Host Disconnection Screen>

On the Host disconnection screen 4.0 of FIG. 70, it is specified what action to be taken with the remaining processing on data in process when the application end processing is performed due to mechanical problems or the like occurring during the operation of this apparatus. To block the communication, delete unprocessed Rx data, and close the vial filling application, the check item indicated above is to be selected and then OK is to be pressed. To block the communication, return to the automatic dispensing screen 1.0, and complete all the un-dispensed Rx data remaining in the queue, the check item indicated below is to be selected and OK is to be pressed.

<Date Update Time Setting Screen>

On the Date update time setting screen 5.0 of FIG. 71, the time for executing date updating on backup data can be inputted and OK can be pressed to make this setting. Pressing the "PROGRAM VESION" button opens the Program version information display screen 5.1 of FIG. 72, permitting display of the program version.

REFERENCE NUMERALS

1. Tablet storage and take-out apparatus
2. Cap
3. Viral
20. Operation display panel
40. External tablet supply part
50. External cap storage part
100. Viral supply part
200. Labeling part
300. Tablet supply part
301. Drum
340. Tablet feeder
301*a*. Fixed half drum
301*b*. Movable half drum
317. Driving unit
318. Manual operation unit
320. Drum rotation driving unit
321. Driving gear
327. Control lever
331*a*. Origin detection sensor
332. Contact piece
331*a*, 331*b*. Rotation limit detection sensor
333. Detected piece
334. Gear
335. Rotary encoder
341. Motor base
342. Tablet cassette
341*c*. Guide passage
343. Tablet storage case
344*a*. Projecting portion
400. Photographing part
500. Cap supply part
600. Capping part
700. Storage part
800. Control part
900. Host computer
150. First transfer robot
250. Second transfer robot
253. Frame
259. Rotation driving motor
261. Guide rod
265. Lifting driving motor
270. Lifting table
271. Boom
272. Arm base
273. Arm
277. Extension-contraction driving motor
283. Oscillating motor
289. Arm driving motor
292. Guide member
350. Third transfer robot
450. Fourth transfer robot
1021. Inner drum
1022. Outer drum
1023. Opening
1024. Opening
1025. Auxiliary transfer robot

The invention claimed is:

1. A tablet storage and take-out apparatus comprising:

a cylindrical drum having a vertical axis and being supported so as to be rotatable about the axis;

drum driving means for rotatably driving the drum;

a plurality of tablet cassette mounting bases fitted to an outer surface of the drum;

a plurality of tablet cassettes for storing tablets, the tablet cassettes being detachably mounted on the tablet cassette mountings bases, respectively;

a plurality of guide passages for guiding tablets discharged from the tablet cassettes, respectively;

a transfer robot disposed inside the drum so as to be liftable along and also rotatable about the axis of the drum, the transfer robot having a pair of arms for holding a vial, and being operable to transfer the vial held by the arms between a delivery position located outside an opening formed in an end of the drum and a tablet filling position inside the drum where the tablets discharged through a specified one of the guide passages are to be supplied to the vial; and control means for controlling a position of at least one of the drum and the transfer robot so that an opening of the vial held by the transfer robot is aligned with an outlet of the specified guide passage.

2. The tablet storage and take-out apparatus according to claim 1, wherein each of the guide passages has a storage part which stores tablets discharged from the tablet cassette and which has in a bottom thereof an outlet and a shutter for opening and closing the outlet.

3. The tablet storage and take-out apparatus according to claim 2, wherein the shutter has detection means for detecting open and closed states of the outlet of the storage part, and wherein the control means is operable to stop the transfer robot when the detection means detects the open state of the outlet of the storage part.

4. The tablet storage and take-out apparatus according to claim 2, wherein a guide member is disposed below the shutter so as to guide the tablets discharged from the storage part to the opening of the vial held by the transfer robot.

5. The tablet storage and take-out apparatus according to claim 4, wherein the guide member is fitted to the arms of the transfer robot.

6. The tablet storage and take-out apparatus according to claim 5, wherein the shutter is biased in a direction to close the outlet of the storage part, and wherein the shutter has a contact part which can be contacted by the guide member to thereby open the storage part upon movement of the transfer robot.

7. The tablet storage and take-out apparatus according to claim 1, wherein the transfer robot comprises:

a frame having a lifting guide extending along the axis of the drum, the lifting guide having upper and lower ends that are supported so as to be rotatable about the axis of the drum;

a base liftably fitted to the lifting guide, the arms of the transfer robot being supported on the base;

rotation driving means for rotatably driving the frame about the axis of the drum;

lifting driving means for lifting the base; and arm driving means for driving the arms.

8. The tablet storage and take-out apparatus according to claim 7, wherein the transfer robot further comprises a boom which is fitted to the base so as to be movable back and forth in a horizontal direction; and horizontal driving means for moving the base back and forth in the horizontal direction, and wherein the arms or the transfer robot are fitted to a leading end of the boom.

9. The tablet storage and take-out apparatus according to claim 8, wherein the arms of the transfer robot are swingable between a horizontal position where the opening of the vial held by the arms faces straight upward and a tilt position where the opening faces obliquely upward while being tilted at 45 degrees, and wherein the boom has swinging means for swinging the arms of the transfer robot.

10. The tablet storage and take-out apparatus according to claim 1, wherein the arms are provided with first and second rollers for engaging sides of the vial, respectively, each roller having a shaft extending in a height direction of the vial held so as to support a side surface of the vial at two-points.

11. The tablet storage and take-out apparatus according to claim 1, wherein each of the first and second arms are provided with two rollers each of the rollers having a shaft extending in a height direction of the vial so as to support a side surface of the vial at a plurality of points.

12. The tablet storage and take-out apparatus according to claim 1, wherein the drum driving means comprises:

a motor;

a transmission mechanism for transmitting a driving force of the motor to the drum; and moving means for moving the transmission mechanism between a transmission position where the driving force is transmitted from the motor to the drum and a blocking position where the driving force from the motor to the drum is blocked.

13. The tablet storage and take-out apparatus according to claim 12, wherein the transmission mechanism further has, between the motor and the drum, an intermediate transfer mechanism, which is moved by the moving means between the transmission position and the blocking position.

14. The tablet storage and take-out apparatus according to claim 12, wherein the moving means includes a lever which can be manually operated from outside of the drum.

15. The tablet storage and take-out apparatus according to claim 12, further comprising origin detection means for detecting an origin of the drum in a rotation direction thereof, wherein an origin of the drum can be determined by rotating the drum by the drum driving means until the origin detection means detects the origin of the drum.

16. The tablet storage and take-out apparatus according to claim 15, wherein the origin detection means comprises a first sensor and a second sensor which are adjacent each other, and the first sensor being operable to detect a left rotation limit of the drum, and the second sensor being operable to detect a right rotation limit of the drum.

17. The tablet storage and take-out apparatus according to claim 16, wherein the origin detection means further comprises a third sensor disposed between the first sensor and the second sensor, and wherein the drum driving means is operable to stop the drum in response to a detection by either the first sensor or the second sensor and then a detection by the third sensor.

18. The tablet storage and take-out apparatus according to claim 15, further comprising drum rotation position detection means for detecting a rotation position of the drum relative to the origin, and wherein, when the origin of the drum is detected by the origin detection means, the rotation position detected by the drum rotation position detection means is reset.

19. The tablet storage and take-out apparatus according to claim 1, wherein the drum comprises at least two body members each having a circular-arc cross section; and rotary support rings fitted to an upper end and a lower end of the body members, and wherein at least one of the body members has the upper end and the lower end thereof rotatably fitted to the rotary support rings so as to be capable of opening and closing the inside of the drum and also has a holding member for holding a closed state of the drum.

20. A tablet storage and take-out apparatus comprising:

a tablet supply unit including a cylindrical drum which has a vertical axis and is supported so as to be rotatable about the axis;

drum driving means for rotatably driving the drum;

a plurality of tablet cassette mounting bases fitted to an outer surface of the drum;

a plurality of tablet cassettes detachably mounted on the tablet cassette mountings bases, respectively;

a plurality of guide passages for guiding the tablets upon discharge from the tablet cassettes, respectively and supplying tablets in accordance with prescription data;

a vial supply unit for storing a large number of vials by size, the vial supply unit being operable to supply, one by one, vials of a size suitable to be filled with tablets in accordance with the prescription data;

a cap supply unit for storing caps for plugging the vials and supplying the caps one by one;

a capping unit for applying one of the caps, from the cap supply unit, to the vial supplied with the tablets;

a storage unit for storing the capped and filled vial so that the vial can be taken out of the storage unit by an operator;

a first transfer robot for holding and transferring a vial taken out from the vial storage unit;

a second transfer robot disposed inside the drum, the second transfer robot having a pair of arms and being liftable along and rotatable about the axis of the drum, the second transfer robot being operable to hold and transfer the vial from the first transfer robot to a selected one of the plurality of guide passages;

a third transfer robot for transferring an empty vial from the first transfer robot to the second transfer robot, the third transfer robot being operable to deliver the vial filed with the tablets and transferred by the second transfer robot to the capping unit; and a fourth transfer robot for transferring the vial from the third transfer robot to the storage unit.

21. The tablet storage and take-out apparatus according to claim 20, wherein, when the tablet cassettes do not have tablets corresponding to the prescription data, the first transfer robot delivers the vial to the third transfer robot without delivering the vial to the second transfer robot, and the third transfer robot subsequent the vial to the fourth transfer robot without delivering the vial to the capping unit.

22. The tablet storage and take-out apparatus according to claim 20, further comprising a photographing unit for taking photographs from above the vial supplied with the tablets for the purpose of inspecting the vial, wherein the third vial transfer arm is operable to transfer the vial supplied with the tablets and transferred by the second vial transfer robot to the tablet photographing unit and then to deliver the vial to the vial capping unit.

23. The tablet storage and take-out apparatus according to claim 20, further comprising a labeling unit for placing a label with prescription information printed thereon on the vial supplied from the vial supply unit, wherein the first transfer robot is operable to transfer the vial to the labeling unit and deliver the vial provided with the label to the second transfer robot.

24. A tablet storage and take-out apparatus comprising:

a first cylindrical drum having a vertical axis and being supported as to be rotatable about the axis, the first cylindrical drum having a first opening;

first drum driving means for rotatably driving the first cylindrical drum;

a second cylindrical drum arranged radially outwardly of the first cylindrical drum, the second cylindrical drum being coaxial with respect to the first cylindrical drum, and being supported so as to be rotatable about the axis, wherein the second cylindrical drum has a second opening;

second drum driving means for rotatably driving the second drum;

a plurality of tablet cassette mounting bases fitted to an outer surface of each of the first and second cylindrical drums;

a plurality of tablet cassettes detachably mounted on the tablet cassette mounting bases, respectively;

a plurality of guide passages provided on the first cylindrical drum for guiding tablets, discharged from the tablet cassettes mounted on the tablet cassette mounting bases that are fitted to the first cylindrical drum, interiorly of the first cylindrical drum;

a plurality of guide passages provided on the second cylindrical drum for guiding tablets, discharged from the tablet cassettes mounted on the tablet cassette mounting bases that are fitted to the second cylindrical drum, interiorly of the second cylindrical drum;

a transfer robot disposed inside of the first cylindrical drum so as to be liftable along the axis and also rotatable about the axis, the transfer robot having a pair of arms for holding a vial, and transferring the vial held by the pair of arms between a delivery position, located outside an opening in an upper end or a lower end of the first and seconds drums and a tablet supply position where the tablets discharged through the guide passages of the first cylindrical drum and the second cylindrical drum are supplied to the vial; and control means for controlling a position of at least one of the first cylindrical drum, the second cylindrical drum, and the transfer robot so that an opening of the vial held by the transfer robot is aligned with an outlet of a selected one of the guide passages.

25. The tablet storage and take-out apparatus according to claim 24, wherein the at least one opening of the first cylindrical drum includes a plurality of openings provided at a plurality of positions in a circumferential direction of the first cylindrical drum.

26. A tablet storage and take-out apparatus comprising:

a first cylindrical drum having a vertical axis and being rotatable supported as to be rotatable about the axis, the first cylindrical drum defining a first opening;

first drum driving means for rotatably driving the first cylindrical drum;

a second cylindrical drum disposed radially outward relative to an outer side of the first cylindrical drum, the second cylindrical drum being coaxial with the first cylindrical drum, and supported so as to be rotatable about the axis, wherein the second cylindrical drum includes a second opening;

second drum driving means for rotatable driving the second drum;

a plurality of tablet cassette mounting bases fitted to an outer surface of each of the first and second cylindrical drums;

a plurality of tablet cassettes detachably mounted on the tablet cassette mounting bases of the first and second cylindrical drums, respectively;

a first plurality of guide passages, associated with the table cassette mounting bases on the first cylindrical drum, for guiding tablets that have been discharged from the associated tablet cassettes to a location radially inside of the first cylindrical drum;

a second plurality of guide passages, associated with the table cassette mounting bases on the second cylindrical drum, for guiding tablets that have been discharged from the associated tablet cassettes to a location inside of the second cylindrical drum;

a main transfer robot provided in the first opening of the first cylindrical drum so as to be liftable along and rotatable about a line parallel to the axis of the first cylindrical drum, the main transfer robot having a pair of arms for holding a vial, transferring the vial held by the arms between a delivery position located outside an opening in an upper end or a lower end of the first and seconds drums and a tablet filling position at a selected one of the guide passages where the tablets discharged through the selected guide passage are supplied to the vial;

a sub-transfer robot provided in the first opening of the first drum so as to be liftable along an axial line parallel to the axis of the first drum and also rotatable about the axial line, the sub-transfer robot having a pair of arms for holding a vial, and transferring the vial held by the arms between a delivery position where the vial held by the arms of the sub-transfer robot is delivered to the main transfer robot and a tablet filling position where the tablets discharged through the selected guide passage of the second drum are supplied to the vial; and control means for controlling a position of at least one of the first and second drums and the main transfer robot so that an opening of the vial held by the main transfer robot is aligned with an outlet of the selected guide passage.

* * * * *